US007121352B2

(12) United States Patent
Cook et al.

(10) Patent No.: US 7,121,352 B2
(45) Date of Patent: Oct. 17, 2006

(54) ISOLATION OF SUBTERRANEAN ZONES

(75) Inventors: Robert Lance Cook, Katy, TX (US); Kevin Karl Waddell, Houston, TX (US); Lev Ring, Houston, TX (US); David Paul Brisco, Duncan, OK (US); Vikram Rao, Houston, TX (US)

(73) Assignee: Enventure Global Technology, Houston, TX (US)

( * ) Notice: Subject to any disclaimer, the term of this patent is extended or adjusted under 35 U.S.C. 154(b) by 209 days.

(21) Appl. No.: 10/619,285

(22) Filed: Jul. 14, 2003

(65) Prior Publication Data

US 2004/0123983 A1 Jul. 1, 2004

Related U.S. Application Data

(63) Continuation-in-part of application No. 09/969,922, filed on Oct. 3, 2001, now Pat. No. 6,634,431, which is a continuation-in-part of application No. 09/440,338, filed on Nov. 15, 1999, now Pat. No. 6,328,113.

(60) Provisional application No. 60/108,558, filed on Nov. 16, 1998.

(51) Int. Cl.
*E21B 43/12* (2006.01)

(52) U.S. Cl. ..... 166/387; 166/50; 166/117.6

(58) Field of Classification Search ..... 166/50, 166/387, 117.5, 117.6, 66.6, 205
See application file for complete search history.

(56) References Cited

U.S. PATENT DOCUMENTS

| | | | | |
|---|---|---|---|---|
| 46,818 | A | 3/1865 | Patterson | |
| 331,940 | A | 12/1885 | Bole | |
| 332,184 | A | 12/1885 | Bole | |
| 341,237 | A | 5/1886 | Healey | |
| 519,805 | A | 5/1894 | Bavier | |
| 802,880 | A | 10/1905 | Phillips, Jr. | |
| 806,156 | A | 12/1905 | Marshall | |
| 958,517 | A | 5/1910 | Mettler | |
| 984,449 | A | 2/1911 | Stewart | |
| 1,233,888 | A | 7/1917 | Leonard | |
| 1,494,128 | A | 5/1924 | Primrose | |
| 1,589,781 | A | 6/1926 | Anderson | |
| 1,590,357 | A | 6/1926 | Feisthamel | |
| 1,756,531 | A | 4/1930 | Aldeen et al. | |
| 1,880,218 | A | 10/1932 | Simmons | |
| 1,981,525 | A | 11/1934 | Price | |
| 2,046,870 | A | 7/1936 | Clasen et al. | |
| 2,087,185 | A | 7/1937 | Dillom | |
| 2,094,691 | A * | 10/1937 | Williams | 277/314 |
| 2,122,757 | A | 7/1938 | Scott | |
| 2,145,168 | A | 1/1939 | Flagg | |
| 2,160,263 | A | 5/1939 | Fletcher | |

(Continued)

FOREIGN PATENT DOCUMENTS

AU 767364 2/2004

(Continued)

OTHER PUBLICATIONS

Letter From Baker Oil Tools to William Norvell in Regards to Enventure's Claims of Baker Infringement Of Enventure's Expandable Patents Apr. 1, 2005.

(Continued)

*Primary Examiner*—Frank S. Tsay
(74) *Attorney, Agent, or Firm*—Haynes and Boone LLP; Todd Mattingly

(57) ABSTRACT

One or more subterranean zones are isolated from one or more other subterranean zones using a combination of solid tubulars and perforated tubulars.

69 Claims, 12 Drawing Sheets

U.S. PATENT DOCUMENTS

| | | | |
|---|---|---|---|
| 2,187,275 | A | 1/1940 | McLennan |
| 2,204,586 | A | 6/1940 | Grau |
| 2,214,226 | A | 9/1940 | English |
| 2,226,804 | A | 12/1940 | Carroll |
| 2,273,017 | A | 2/1942 | Boynton |
| 2,301,495 | A | 11/1942 | Abegg |
| 2,371,840 | A | 3/1945 | Otis |
| 2,383,214 | A | 8/1945 | Prout |
| 2,447,629 | A | 8/1948 | Beissinger et al. |
| 2,500,276 | A | 3/1950 | Church |
| 2,546,295 | A | 3/1951 | Boice |
| 2,583,316 | A | 1/1952 | Bannister |
| 2,627,891 | A | 2/1953 | Clark |
| 2,734,580 | A | 2/1956 | Layne |
| 2,796,134 | A | 6/1957 | Binkley |
| 2,812,025 | A | 11/1957 | Teague et al. |
| 2,907,589 | A | 10/1959 | Knox |
| 3,015,362 | A | 1/1962 | Moosman |
| 3,015,500 | A | 1/1962 | Barnett |
| 3,018,547 | A | 1/1962 | Marskell |
| 3,067,819 | A | 12/1962 | Gore |
| 3,068,563 | A | 12/1962 | Reverman |
| 3,104,703 | A | 9/1963 | Rike et al. |
| 3,111,991 | A | 11/1963 | O'Neal |
| 3,167,122 | A | 1/1965 | Lang |
| 3,175,618 | A | 3/1965 | Lang et al. |
| 3,179,168 | A | 4/1965 | Vincent |
| 3,188,816 | A | 6/1965 | Koch |
| 3,191,677 | A | 6/1965 | Kinley |
| 3,191,680 | A | 6/1965 | Vincent |
| 3,203,451 | A | 8/1965 | Vincent |
| 3,203,483 | A | 8/1965 | Vincent |
| 3,209,546 | A | 10/1965 | Lawton |
| 3,210,102 | A | 10/1965 | Joslin |
| 3,233,315 | A | 2/1966 | Levake |
| 3,245,471 | A | 4/1966 | Howard |
| 3,270,817 | A | 9/1966 | Papaila |
| 3,297,092 | A | 1/1967 | Jennings |
| 3,326,293 | A | 6/1967 | Skipper |
| 3,343,252 | A | 9/1967 | Reesor |
| 3,353,599 | A | 11/1967 | Swift |
| 3,354,955 | A | 11/1967 | Berry |
| 3,358,760 | A | 12/1967 | Blagg |
| 3,358,769 | A | 12/1967 | Berry |
| 3,364,993 | A | 1/1968 | Skipper |
| 3,371,717 | A | 3/1968 | Chenoweth |
| 3,412,565 | A | 11/1968 | Lindsey et al. |
| 3,419,080 | A | 12/1968 | Lebourg |
| 3,424,244 | A | 1/1969 | Kinley |
| 3,427,707 | A | 2/1969 | Nowosadko |
| 3,477,506 | A | 11/1969 | Malone |
| 3,489,220 | A | 1/1970 | Kinley |
| 3,498,376 | A | 3/1970 | Sizer et al. |
| 3,528,498 | A | 9/1970 | Carothers |
| 3,568,773 | A | 3/1971 | Chancellor |
| 3,578,081 | A | 5/1971 | Bodine |
| 3,605,887 | A | 9/1971 | Lambie |
| 3,667,547 | A | 6/1972 | Ahlstone |
| 3,669,190 | A | 6/1972 | Sizer et al. |
| 3,682,256 | A | 8/1972 | Stuart |
| 3,687,196 | A | 8/1972 | Mullins |
| 3,691,624 | A | 9/1972 | Kinley |
| 3,693,717 | A | 9/1972 | Wuenschel |
| 3,704,730 | A | 12/1972 | Witzig |
| 3,709,306 | A | 1/1973 | Curington |
| 3,711,123 | A | 1/1973 | Arnold |
| 3,712,376 | A | 1/1973 | Owen et al. |
| 3,746,068 | A | 7/1973 | Deckert et al. |
| 3,746,091 | A | 7/1973 | Owen et al. |
| 3,746,092 | A | 7/1973 | Land |
| 3,764,168 | A | 10/1973 | Kisling et al. |
| 3,776,307 | A | 12/1973 | Young |
| 3,779,025 | A | 12/1973 | Godley et al. |
| 3,780,562 | A | 12/1973 | Kinley |
| 3,785,193 | A | 1/1974 | Kinley et al. |
| 3,797,259 | A | 3/1974 | Kammerer, Jr. |
| 3,812,912 | A | 5/1974 | Wuenschel |
| 3,818,734 | A | 6/1974 | Bateman |
| 3,866,954 | A | 2/1975 | Slator et al. |
| 3,885,298 | A | 5/1975 | Pogonowski |
| 3,887,006 | A | 6/1975 | Pitts |
| 3,893,718 | A | 7/1975 | Powell |
| 3,898,163 | A | 8/1975 | Mott |
| 3,915,478 | A | 10/1975 | Al et al. |
| 3,935,910 | A | 2/1976 | Gaudy et al. |
| 3,942,824 | A | 3/1976 | Sable |
| 3,945,444 | A | 3/1976 | Knudson |
| 3,948,321 | A | 4/1976 | Owen et al. |
| 3,970,336 | A | 7/1976 | O'Sickey et al. |
| 3,977,473 | A | 8/1976 | Page, Jr. |
| 3,997,193 | A | 12/1976 | Tsuda et al. |
| 4,011,652 | A | 3/1977 | Black |
| 4,026,583 | A | 5/1977 | Gottlieb |
| 4,053,247 | A | 10/1977 | Marsh, Jr. |
| 4,069,573 | A | 1/1978 | Rogers et al. |
| 4,076,287 | A | 2/1978 | Bill et al. |
| 4,096,913 | A | 6/1978 | Kennedy et al. |
| 4,098,334 | A | 7/1978 | Crowe |
| 4,125,937 | A | 11/1978 | Brown et al. |
| 4,152,821 | A | 5/1979 | Scott |
| 4,190,108 | A | 2/1980 | Webber |
| 4,205,422 | A | 6/1980 | Hardwick |
| 4,253,687 | A | 3/1981 | Maples |
| 4,274,665 | A | 6/1981 | Marsh, Jr. |
| RE30,802 | E | 11/1981 | Rogers |
| 4,304,428 | A | 12/1981 | Grigorian et al. |
| 4,355,664 | A | 10/1982 | Cook et al. |
| 4,359,889 | A | 11/1982 | Kelly |
| 4,363,358 | A | 12/1982 | Ellis |
| 4,366,971 | A | 1/1983 | Lula |
| 4,368,571 | A | 1/1983 | Cooper, Jr. |
| 4,379,471 | A | 4/1983 | Kuenzel |
| 4,380,347 | A | 4/1983 | Sable |
| 4,391,325 | A | 7/1983 | Baker et al. |
| 4,393,931 | A | 7/1983 | Muse et al. |
| 4,396,061 | A | 8/1983 | Tamplen et al. |
| 4,401,325 | A | 8/1983 | Tsuchiya et al. |
| 4,402,372 | A | 9/1983 | Cherrington |
| 4,407,681 | A | 10/1983 | Ina et al. |
| 4,411,435 | A | 10/1983 | McStravick |
| 4,413,395 | A | 11/1983 | Garnier |
| 4,413,682 | A | 11/1983 | Callihan et al. |
| 4,420,866 | A | 12/1983 | Mueller |
| 4,421,169 | A | 12/1983 | Dearth et al. |
| 4,422,507 | A | 12/1983 | Reimert |
| 4,423,889 | A | 1/1984 | Weise |
| 4,423,986 | A | 1/1984 | Skogberg |
| 4,429,741 | A | 2/1984 | Hyland |
| 4,440,233 | A | 4/1984 | Baugh et al. |
| 4,444,250 | A | 4/1984 | Keithahn et al. |
| 4,449,713 | A * | 5/1984 | Ishido et al. ..... 277/312 |
| 4,462,471 | A | 7/1984 | Hipp |
| 4,467,630 | A | 8/1984 | Kelly |
| 4,468,309 | A | 8/1984 | White |
| 4,469,356 | A | 9/1984 | Duret et al. |
| 4,473,245 | A | 9/1984 | Raulins et al. |
| 4,483,399 | A | 11/1984 | Colgate |
| 4,485,847 | A | 12/1984 | Wentzell |
| 4,501,327 | A | 2/1985 | Retz |
| 4,505,017 | A | 3/1985 | Schukei |
| 4,508,129 | A | 4/1985 | Brown |
| 4,511,289 | A | 4/1985 | Herron |
| 4,519,456 | A | 5/1985 | Cochran |
| 4,526,232 | A | 7/1985 | Hughson et al. |

4,530,231 A 7/1985 Main
4,541,655 A 9/1985 Hunter
4,550,782 A 11/1985 Lawson
4,553,776 A 11/1985 Dodd
4,573,248 A 3/1986 Hackett
4,576,386 A 3/1986 Benson et al.
4,590,227 A 5/1986 Nakamura et al.
4,590,995 A 5/1986 Evans
4,592,577 A 6/1986 Ayres et al.
4,595,063 A 6/1986 Jennings et al.
4,605,063 A 8/1986 Ross
4,611,662 A 9/1986 Harrington
4,629,218 A 12/1986 Dubois
4,630,849 A 12/1986 Fukui et al.
4,632,944 A 12/1986 Thompson
4,634,317 A 1/1987 Skogberg et al.
4,635,333 A 1/1987 Finch
4,637,436 A 1/1987 Stewart et al.
4,646,787 A 3/1987 Rush et al.
4,649,492 A 3/1987 Sinha et al.
4,651,836 A 3/1987 Richards
4,656,779 A 4/1987 Fedeli
4,660,863 A 4/1987 Bailey et al.
4,662,446 A 5/1987 Brisco et al.
4,669,541 A 6/1987 Bissonnette
4,682,797 A 7/1987 Hildner
4,685,191 A 8/1987 Mueller et al.
4,685,834 A 8/1987 Jordan
4,693,498 A 9/1987 Baugh et al.
4,711,474 A 12/1987 Patrick
4,714,117 A 12/1987 Dech
4,730,851 A 3/1988 Watts
4,735,444 A 4/1988 Skipper
4,739,654 A 4/1988 Pilkington et al.
4,739,916 A 4/1988 Ayres et al.
4,754,781 A 7/1988 Putter
4,758,025 A 7/1988 Frick
4,776,394 A 10/1988 Lynde et al.
4,778,088 A 10/1988 Miller
4,793,382 A 12/1988 Szalvay
4,796,668 A 1/1989 Depret
4,817,710 A 4/1989 Edwards et al.
4,817,712 A 4/1989 Bodine
4,817,716 A 4/1989 Taylor et al.
4,827,594 A 5/1989 Cartry et al.
4,828,033 A 5/1989 Frison
4,830,109 A 5/1989 Wedel
4,836,579 A 6/1989 Wester et al.
4,854,338 A 8/1989 Grantham
4,865,127 A 9/1989 Koster
4,872,253 A 10/1989 Carstensen
4,887,646 A 12/1989 Groves
4,892,337 A 1/1990 Gunderson et al.
4,893,658 A 1/1990 Kimura et al.
4,904,136 A 2/1990 Matsumoto
4,907,828 A 3/1990 Change
4,911,237 A 3/1990 Melenyzer
4,913,758 A 4/1990 Koster
4,915,177 A 4/1990 Claycomb
4,915,426 A 4/1990 Skipper
4,917,409 A 4/1990 Reeves
4,919,989 A * 4/1990 Colangelo ..... 428/66.4
4,930,573 A 6/1990 Lane et al.
4,934,312 A 6/1990 Koster et al.
4,938,291 A 7/1990 Lynde et al.
4,941,512 A 7/1990 McParland
4,941,532 A 7/1990 Hurt et al.
4,942,926 A 7/1990 Lessi
4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,370 A 7/1991 Jewett
5,031,699 A 7/1991 Artynov et al.
5,040,283 A 8/1991 Pelgrom
5,044,676 A 9/1991 Burton et al.
5,052,483 A 10/1991 Hudson
5,059,043 A 10/1991 Kuhne
5,064,004 A 11/1991 Lundel
5,079,837 A 1/1992 Vanselow
5,083,608 A 1/1992 Abdrakhmanov et al.
5,093,015 A 3/1992 Oldiges
5,095,991 A 3/1992 Milberger
5,107,221 A 4/1992 N'Guyen et al.
5,119,661 A 6/1992 Abdrakhmanov et al.
5,150,755 A 9/1992 Cassel et al.
5,156,043 A 10/1992 Ose
5,156,213 A 10/1992 George et al.
5,156,223 A 10/1992 Hipp
5,174,376 A 12/1992 Singeetham
5,181,571 A 1/1993 Mueller et al.
5,195,583 A * 3/1993 Toon et al. ..... 166/187
5,197,553 A 3/1993 Leturno
5,209,600 A 5/1993 Koster
5,226,492 A 7/1993 Solaeche et al.
5,242,017 A 9/1993 Hailey
5,253,713 A 10/1993 Gregg et al.
5,282,508 A 2/1994 Ellingsen et al.
5,286,393 A 2/1994 Oldiges et al.
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,327,964 A 7/1994 O'Donnell et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,339,894 A 8/1994 Stotler
5,343,949 A 9/1994 Ross et al.
5,346,007 A 9/1994 Dillon et al.
5,348,087 A 9/1994 Williamson, Jr.
5,348,093 A 9/1994 Wood et al.
5,348,095 A 9/1994 Worrall et al.
5,348,668 A 9/1994 Oldiges et al.
5,351,752 A 10/1994 Wood et al.
5,360,292 A 11/1994 Allen et al.
5,361,843 A 11/1994 Shy et al.
5,366,010 A 11/1994 Zwart
5,366,012 A 11/1994 Lohbeck
5,368,075 A 11/1994 Baro et al.
5,370,425 A 12/1994 Dougherty et al.
5,375,661 A 12/1994 Daneshy et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,405,171 A 4/1995 Allen et al.
5,425,559 A 6/1995 Nobileau
5,426,130 A 6/1995 Thurber et al.
5,431,831 A 7/1995 Vincent
5,435,395 A 7/1995 Connell
5,439,320 A 8/1995 Abrams
5,447,201 A 9/1995 Mohn
5,454,419 A 10/1995 Vloedman
5,456,319 A 10/1995 Schmidt et al.
5,458,194 A 10/1995 Brooks 5,462,120 A 10/1995 Gondouin
5,467,822 A 11/1995 Zwart
5,472,055 A 12/1995 Simson et al.
5,474,334 A 12/1995 Eppink
5,494,106 A 2/1996 Gueguen et al.
5,507,343 A 4/1996 Carlton et al.
5,511,620 A 4/1996 Baugh et al.
5,524,937 A 6/1996 Sides et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,576,485 A 11/1996 Serata
5,611,399 A 3/1997 Richard et al.
5,613,557 A 3/1997 Blount et al.
5,606,792 A 4/1997 Schafer
5,617,918 A 4/1997 Cooksey et al.
5,642,560 A 7/1997 Tabuchi et al.
5,642,781 A 7/1997 Richard
3,665,591 A 9/1997 Sonenshein et al.
5,664,327 A 9/1997 Swars
5,667,011 A 9/1997 Gill et al.
5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,718,288 A 2/1998 Bertet et al.
5,738,146 A * 4/1998 Abe ..... 138/97
5,743,335 A 4/1998 Bussear
5,749,419 A 5/1998 Coronado et al.
5,749,585 A 5/1998 Lembcke
5,775,422 A 7/1998 Wong et al.
5,785,120 A 7/1998 Smalley et al.
5,787,933 A 8/1998 Russ et al.
5,791,419 A 8/1998 Valisalo
5,794,702 A 8/1998 Nobileau
5,797,454 A 8/1998 Hipp
5,829,520 A 11/1998 Johnson
5,829,524 A 11/1998 Flanders et al.
5,833,001 A 11/1998 Song et al.
5,845,945 A 12/1998 Carstensen
5,849,188 A 12/1998 Voll et al.
5,857,524 A 1/1999 Harris et al.
5,875,851 A 3/1999 Vick, Jr. et al.
5,885,941 A 3/1999 Sateva et al.
5,901,789 A 5/1999 Donnelly et al.
5,918,677 A 7/1999 Head
5,924,745 A 7/1999 Campbell
5,931,511 A 8/1999 DeLange et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,979,560 A 11/1999 Nobileau
5,984,369 A 11/1999 Crook et al.
5,984,568 A 11/1999 Lohbeck
6,012,521 A 1/2000 Zunkel et al.
6,012,522 A 1/2000 Donnelly et al.
6,012,523 A 1/2000 Campbell et al.
6,012,874 A 1/2000 Groneck et al.
6,015,012 A 1/2000 Reddick
6,017,168 A 1/2000 Fraser et al.
6,021,850 A 2/2000 Woo et al.
6,029,748 A 2/2000 Forsyth et al.
6,035,954 A 3/2000 Hipp
6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,062,324 A 5/2000 Hipp
6,065,500 A 5/2000 Metcalfe
6,070,671 A 6/2000 Cumming et al.
6,073,692 A 6/2000 Wood et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.
6,138,761 A 10/2000 Freeman et al.
6,142,230 A 11/2000 Smalley et al.
6,182,775 B1 2/2001 Hipp
6,196,336 B1 3/2001 Fincher et al.
6,226,855 B1 5/2001 Maine
6,250,385 B1 6/2001 Montaron
6,263,966 B1 7/2001 Haut et al.
6,263,968 B1 7/2001 Freeman et al.
6,263,972 B1 7/2001 Richard et al.
6,267,181 B1 7/2001 Rhein-Knudsen et al.
6,283,211 B1 9/2001 Vloedman
6,315,043 B1 11/2001 Farrant et al.
6,318,457 B1 11/2001 Den Boer et al.
6,318,465 B1 11/2001 Coon et al.
6,322,109 B1 11/2001 Campbell et al.
6,328,113 B1 12/2001 Cook
6,345,431 B1 2/2002 Greig
6,354,373 B1 3/2002 Vercaemer et al.
6,390,720 B1 5/2002 LeBegue et al.
6,409,175 B1 6/2002 Evans et al.
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox et al.
6,446,724 B1 9/2002 Baugh et al.
6,450,261 B1 9/2002 Baugh
6,454,013 B1 9/2002 Metcalfe
6,457,532 B1 10/2002 Simpson
6,457,533 B1 10/2002 Metcalfe
6,457,749 B1 10/2002 Heijnen
6,460,615 B1 10/2002 Heijnen
6,464,008 B1 10/2002 Roddy et al.
6,470,966 B1 10/2002 Cook et al.
6,470,996 B1 10/2002 Kyle et al.
6,478,092 B1 11/2002 Voll et al.
6,497,289 B1 12/2002 Cook et al.
6,516,887 B1 2/2003 Nguyen et al.
6,517,126 B1 2/2003 Peterson et al.
6,527,049 B1 3/2003 Metcalfe et al.
6,543,545 B1 4/2003 Chatterji et al.
6,543,552 B1 4/2003 Metcalfe et al.
6,550,821 B1 4/2003 DeLange et al.
6,557,640 B1 5/2003 Cook et al.
6,561,227 B1 5/2003 Cook et al.
6,561,279 B1 5/2003 MacKenzie et al.
6,564,875 B1 5/2003 Bullock
6,568,471 B1 5/2003 Cook et al.
6,568,488 B1 5/2003 Wentworth et al.
6,575,240 B1 6/2003 Cook et al.
6,578,630 B1 6/2003 Simpson et al.
6,585,053 B1 7/2003 Coon
6,591,905 B1 7/2003 Coon
6,598,677 B1 7/2003 Baugh et al.
6,622,797 B1 9/2003 Sivley, IV
6,629,567 B1 10/2003 Lauritzen et al.

| | | | |
|---|---|---|---|
| 6,640,895 | B1 | 11/2003 | Murray |
| 6,648,075 | B1 | 11/2003 | Badrak et al. |
| 6,679,328 | B1 | 1/2004 | Davis et al. |
| 6,688,397 | B1 | 2/2004 | McClurkin et al. |
| 6,698,517 | B1 | 3/2004 | Simpson et al. |
| 6,712,401 | B1 | 3/2004 | Coulon et al. |
| 6,719,064 | B1 | 4/2004 | Price-Smith et al. |
| 6,722,427 | B1 | 4/2004 | Gano et al. |
| 6,722,437 | B1 | 4/2004 | Vercaemer et al. |
| 6,725,934 | B1 | 4/2004 | Coronado et al. |
| 6,725,939 | B1 | 4/2004 | Richard |
| 6,732,806 | B1 | 5/2004 | Mauldin et al. |
| 6,739,392 | B1 | 5/2004 | Cook et al. |
| 6,758,278 | B1 | 7/2004 | Cook et al. |
| 6,796,380 | B1 | 9/2004 | Xu |
| 6,814,147 | B1 | 11/2004 | Baugh |
| 6,820,690 | B1 | 11/2004 | Vercaemer et al. |
| 6,823,937 | B1 | 11/2004 | Cook et al. |
| 6,832,649 | B1 | 12/2004 | Bode et al. |
| 6,834,725 | B1 | 12/2004 | Whanger et al. |
| 6,857,473 | B1 | 2/2005 | Cook et al. |
| 6,892,819 | B1 | 5/2005 | Cook et al. |
| 2001/0002626 | A1 | 6/2001 | Frank et al. |
| 2001/0020532 | A1 | 9/2001 | Baugh et al. |
| 2001/0045284 | A1 | 11/2001 | Simpson et al. |
| 2001/0047870 | A1 | 12/2001 | Cook et al. |
| 2002/0011339 | A1 | 1/2002 | Murray |
| 2002/0014339 | A1 | 2/2002 | Ross |
| 2002/0020531 | A1 | 2/2002 | Ohmer |
| 2002/0062956 | A1 | 5/2002 | Murray et al. |
| 2002/0066576 | A1 | 6/2002 | Cook et al. |
| 2002/0066578 | A1 | 6/2002 | Broome |
| 2002/0070023 | A1 | 6/2002 | Turner et al. |
| 2002/0070031 | A1 | 6/2002 | Voll et al. |
| 2002/0079101 | A1 | 6/2002 | Baugh et al. |
| 2002/0084070 | A1 | 7/2002 | Voll et al. |
| 2002/0092654 | A1 | 7/2002 | Coronado et al. |
| 2002/0108756 | A1 | 8/2002 | Harrall et al. |
| 2002/0139540 | A1 | 10/2002 | Lauritzen |
| 2002/0144822 | A1 | 10/2002 | Hackworth et al. |
| 2002/0148612 | A1 | 10/2002 | Cook et al. |
| 2002/0185274 | A1 | 12/2002 | Simpson et al. |
| 2002/0189816 | A1 | 12/2002 | Cook et al. |
| 2002/0195252 | A1 | 12/2002 | Maguire et al. |
| 2002/0195256 | A1 | 12/2002 | Metcalfe et al. |
| 2003/0024708 | A1 | 2/2003 | Ring et al. |
| 2003/0024711 | A1 | 2/2003 | Simpson et al. |
| 2003/0034177 | A1 | 2/2003 | Chitwood et al. |
| 2003/0047323 | A1 | 3/2003 | Jackson et al. |
| 2003/0056991 | A1 | 3/2003 | Hahn et al. |
| 2003/0066655 | A1 | 4/2003 | Cook et al. |
| 2003/0075338 | A1 | 4/2003 | Sivley et al. |
| 2003/0094277 | A1 | 5/2003 | Cook et al. |
| 2003/0094278 | A1 | 5/2003 | Cook et al. |
| 2003/0094279 | A1 | 5/2003 | Ring et al. |
| 2003/0098154 | A1 | 5/2003 | Cook et al. |
| 2003/0098162 | A1 | 5/2003 | Cook |
| 2003/0107217 | A1 | 6/2003 | Daigle et al. |
| 2003/0116325 | A1 | 6/2003 | Cook et al. |
| 2003/0121558 | A1 | 7/2003 | Cook et al. |
| 2003/0121669 | A1 | 7/2003 | Cook et al. |
| 2004/0011534 | A1 | 1/2004 | Simonds et al. |
| 2004/0060706 | A1 | 4/2004 | Stephenson |
| 2004/0065446 | A1 | 4/2004 | Tran et al. |
| 2004/0112589 | A1 | 6/2004 | Cook et al. |
| 2004/0112606 | A1 | 6/2004 | Lewis et al. |
| 2004/0118574 | A1 | 6/2004 | Cook et al. |
| 2004/0123983 | A1 | 7/2004 | Cook et al. |
| 2004/0123988 | A1 | 7/2004 | Cook et al. |
| 2004/0188099 | A1 | 9/2004 | Cook et al. |
| 2004/0216873 | A1 | 11/2004 | Frost, Jr. et al. |
| 2004/0231855 | A1 | 11/2004 | Cook et al. |
| 2004/0238181 | A1 | 12/2004 | Cook et al. |
| 2004/0244968 | A1 | 12/2004 | Cook et al. |
| 2004/0262014 | A1 | 12/2004 | Cook et al. |
| 2005/0011641 | A1 | 1/2005 | Cook et al. |
| 2005/0015963 | A1 | 1/2005 | Costa et al. |
| 2005/0028988 | A1 | 2/2005 | Cook et al. |
| 2005/0039928 | A1 | 2/2005 | Cook et al. |
| 2005/0045324 | A1 | 3/2005 | Cook et al. |
| 2005/0045341 | A1 | 3/2005 | Cook et al. |
| 2005/0056433 | A1 | 3/2005 | Watson et al. |
| 2005/0056434 | A1 | 3/2005 | Ring et al. |
| 2005/0077051 | A1 | 4/2005 | Cook et al. |
| 2005/0081358 | A1 | 4/2005 | Cook et al. |
| 2005/0087337 | A1 | 4/2005 | Brisco et al. |
| 2005/0098323 | A1 | 5/2005 | Cook et al. |
| 2005/0103502 | A1 | 5/2005 | Watson et al. |
| 2005/0123639 | A1 | 6/2005 | Ring et al. |

FOREIGN PATENT DOCUMENTS

| | | | |
|---|---|---|---|
| AU | 770008 | | 7/2004 |
| AU | 770359 | | 7/2004 |
| AU | 771884 | | 8/2004 |
| CA | 736288 | | 6/1966 |
| CA | 771462 | | 11/1967 |
| CA | 1171310 | | 7/1984 |
| CA | 2292171 | | 6/2000 |
| CA | 2298139 | | 8/2000 |
| CA | 2234386 | | 3/2003 |
| DE | 174521 | | 4/1953 |
| DE | 2458188 | | 6/1975 |
| DE | 203767 | | 11/1983 |
| DE | 233607 | A1 | 3/1986 |
| DE | 278517 | A1 | 5/1990 |
| EP | 0084940 | A1 | 6/1983 |
| EP | 0272511 | | 12/1987 |
| EP | 0294264 | | 5/1988 |
| EP | 0553566 | A1 | 12/1992 |
| EP | 0633391 | A2 | 1/1995 |
| EP | 0713953 | B1 | 11/1995 |
| EP | 0823534 | | 2/1998 |
| EP | 0881354 | | 12/1998 |
| EP | 0881359 | | 12/1998 |
| EP | 0899420 | | 3/1999 |
| EP | 0937861 | | 8/1999 |
| EP | 0952305 | | 10/1999 |
| EP | 0952306 | | 10/1999 |
| EP | 1141515 | A | 10/2001 |
| EP | 1152120 | A2 | 11/2001 |
| EP | 1152120 | A3 | 11/2001 |
| EP | 1235972 | A | 9/2002 |
| FR | 1325596 | | 6/1962 |
| FR | 2717855 | A1 | 9/1995 |
| FR | 2741907 | A1 | 6/1997 |
| FR | 2771133 | A | 5/1999 |
| FR | 2780751 | | 1/2000 |
| FR | 2841626 | A1 | 1/2004 |
| GB | 557823 | | 12/1943 |
| GB | 788150 | | 12/1957 |
| GB | 851096 | | 10/1960 |
| GB | 961750 | | 6/1964 |
| GB | 1000383 | | 10/1965 |
| GB | 1062610 | | 3/1967 |
| GB | 1111536 | | 5/1968 |
| GB | 1448304 | | 9/1976 |
| GB | 1460864 | | 1/1977 |
| GB | 1542847 | | 3/1979 |
| GB | 1563740 | | 3/1980 |
| GB | 2058877 | A | 4/1981 |
| GB | 2108228 | A | 5/1983 |
| GB | 2115860 | A | 9/1983 |
| GB | 2211573 | A | 7/1989 |
| GB | 2216926 | A | 10/1989 |
| GB | 2243191 | A | 10/1991 |

| | | | |
|---|---|---|---|
| GB | 2256910 | A | 12/1992 |
| GB | 2257184 | | 6/1993 |
| GB | 2305682 | A | 4/1997 |
| GB | 2325949 | A | 5/1998 |
| GB | 2322655 | A | 9/1998 |
| GB | 2326896 | A | 1/1999 |
| GB | 2329916 | A | 4/1999 |
| GB | 2329918 | A | 4/1999 |
| GB | 2336383 | A | 10/1999 |
| GB | 2355738 | A | 4/2000 |
| GB | 2343691 | A | 5/2000 |
| GB | 2344606 | A | 6/2000 |
| GB | 2368865 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2357099 | A | 12/2000 |
| GB | 2356651 | A | 5/2001 |
| GB | 2350137 | B | 8/2001 |
| GB | 2359837 | B | 4/2002 |
| GB | 2370301 | A | 6/2002 |
| GB | 2371064 | A | 7/2002 |
| GB | 2371574 | A | 7/2002 |
| GB | 2373524 | | 9/2002 |
| GB | 2367842 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382828 | A | 6/2003 |
| GB | 2387405 | A | 10/2003 |
| GB | 2388134 | A | 11/2003 |
| GB | 2374622 | B | 12/2003 |
| GB | 2392686 | A | 3/2004 |
| GB | 2392685 | B | 4/2004 |
| GB | 2392691 | B | 4/2004 |
| GB | 2394979 | A | 5/2004 |
| GB | 2395506 | A | 5/2004 |
| GB | 2392932 | B | 6/2004 |
| GB | 2396635 | A | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2373468 | B | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2382367 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2400624 | B | 2/2005 |
| GB | 2404676 | A | 2/2005 |
| GB | 2384807 | C | 3/2005 |
| GB | 2388134 | B | 3/2005 |
| GB | 2398320 | B | 3/2005 |
| GB | 2398323 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406126 | A | 3/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2408278 | A | 5/2005 |
| GB | 2408277 | A | 5/2006 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| NL | 9001081 | | 12/1991 |
| RO | 113267 | B1 | 5/1998 |
| RU | 2016345 | C1 | 7/1994 |

| | | | |
|---|---|---|---|
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 1066116 | A | 4/1964 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 969038 | | 1/1983 |
| SU | 1002514 | | 3/1983 |
| SU | 1041671 | A | 9/1983 |
| SU | 1051222 | A | 10/1983 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | | 7/1988 |
| SU | 1430496 | A1 | 10/1988 |
| SU | 1432190 | A1 | 10/1988 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| SU | 1786241 | A1 | 1/1993 |
| SU | 1804543 | A3 | 3/1993 |
| SU | 1810482 | A1 | 4/1993 |
| SU | 1818459 | A1 | 5/1993 |
| SU | 1295799 | A1 | 2/1995 |
| WO | WO81/00132 | | 1/1981 |
| WO | WO90/05598 | | 3/1990 |
| WO | WO92/01859 | | 2/1992 |
| WO | WO92/08875 | | 5/1992 |
| WO | WO93/25799 | | 12/1993 |
| WO | WO93/25800 | | 12/1993 |
| WO | WO94/21887 | | 9/1994 |
| WO | WO94/25655 | | 11/1994 |
| WO | WO95/03476 | | 2/1995 |
| WO | WO96/01937 | | 1/1996 |
| WO | WO96/21083 | | 7/1996 |
| WO | WO96/26350 | | 8/1996 |
| WO | WO96/37681 | | 11/1996 |
| WO | WO97/06346 | | 2/1997 |
| WO | WO97/11306 | | 3/1997 |
| WO | WO97/17524 | | 5/1997 |
| WO | WO97/17526 | | 5/1997 |
| WO | WO97/17527 | | 5/1997 |
| WO | WO97/20130 | | 6/1997 |
| WO | WO97/21901 | | 6/1997 |
| WO | WO97/35084 | | 9/1997 |
| WO | WO98/00626 | | 1/1998 |
| WO | WO98/07957 | | 2/1998 |
| WO | WO98/09053 | | 3/1998 |
| WO | WO98/22690 | | 5/1998 |
| WO | WO98/26152 | | 6/1998 |
| WO | WO98/42947 | | 10/1998 |
| WO | WO98/49423 | | 11/1998 |
| WO | WO99/02818 | | 1/1999 |
| WO | WO99/04135 | | 1/1999 |
| WO | WO99/06670 | | 2/1999 |
| WO | WO99/08827 | | 2/1999 |
| WO | WO99/08828 | | 2/1999 |
| WO | WO99/18328 | | 4/1999 |
| WO | WO99/23354 | | 5/1999 |
| WO | WO99/25524 | | 5/1999 |
| WO | WO99/25951 | | 5/1999 |
| WO | WO99/35368 | | 7/1999 |
| WO | WO99/43923 | | 9/1999 |
| WO | WO00/01926 | | 1/2000 |
| WO | WO00/04271 | | 1/2000 |
| WO | WO00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37766 | | 6/2000 |
| WO | WO00/37767 | | 6/2000 |
| WO | WO00/37768 | | 6/2000 |
| WO | WO00/37771 | | 6/2000 |
| WO | WO00/37772 | | 6/2000 |
| WO | WO00/39432 | | 7/2000 |
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04520 | A1 | 1/2001 |
| WO | WO01/04535 | A1 | 1/2001 |
| WO | WO01/18354 | A1 | 3/2001 |
| WO | WO01/21929 | A1 | 3/2001 |
| WO | WO01/33037 | A1 | 5/2001 |
| WO | WO01/38693 | A1 | 5/2001 |
| WO | WO01/60545 | A1 | 8/2001 |
| WO | WO01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO 02/20941 | A1 | 3/2002 |
| WO | WO02/29199 | A1 | 4/2002 |
| WO | WO02/40625 | A | 5/2002 |
| WO | WO02/059456 | A1 | 8/2002 |
| WO | WO02/066783 | A1 | 8/2002 |
| WO | WO02/068792 | A1 | 9/2002 |
| WO | WO03/006756 | A1 | 1/2003 |
| WO | WO03/016669 | A2 | 2/2003 |
| WO | WO03/016669 | A3 | 2/2003 |
| WO | WO03/023178 | A3 | 3/2003 |
| WO | WO03/058022 | A3 | 7/2003 |
| WO | WO03/071086 | A3 | 8/2003 |
| WO | WO03/078785 | A3 | 9/2003 |
| WO | WO03/086675 | A3 | 10/2003 |
| WO | WO03/093623 | A3 | 11/2003 |

| | | | |
|---|---|---|---|
| WO | WO03/104601 | A3 | 12/2003 |
| WO | WO03/106130 | A3 | 12/2003 |
| WO | WO04/010039 | A3 | 1/2004 |
| WO | WO04/011776 | A3 | 2/2004 |
| WO | WO04/018823 | A3 | 3/2004 |
| WO | WO04/018824 | A3 | 3/2004 |
| WO | WO04/023014 | A3 | 3/2004 |
| WO | WO04/026017 | A3 | 4/2004 |
| WO | WO04/026073 | A3 | 4/2004 |
| WO | WO04/026500 | A3 | 4/2004 |
| WO | WO04/027200 | A3 | 4/2004 |
| WO | WO04/027204 | A3 | 4/2004 |
| WO | WO04/027205 | A3 | 4/2004 |
| WO | WO04/027786 | A3 | 4/2004 |
| WO | WO04/053434 | A2 | 6/2004 |
| WO | WO04/053434 | A3 | 6/2004 |
| WO | WO04/057715 | A2 | 7/2004 |
| WO | WO04/057715 | A3 | 7/2004 |
| WO | WO04/067961 | A2 | 8/2004 |
| WO | WO04/067961 | A3 | 8/2004 |
| WO | WO04/072436 | A1 | 8/2004 |
| WO | WO04/074622 | A2 | 9/2004 |
| WO | WO04/074622 | A3 | 9/2004 |
| WO | WO04/076798 | A2 | 9/2004 |
| WO | WO04/076798 | A3 | 9/2004 |
| WO | WO04/081346 | A2 | 9/2004 |
| WO | WO04/083591 | A2 | 9/2004 |
| WO | WO04/083591 | A3 | 9/2004 |
| WO | WO04/083592 | A2 | 9/2004 |
| WO | WO04/083592 | A3 | 9/2004 |
| WO | WO04/083593 | A2 | 9/2004 |
| WO | WO04/083594 | A2 | 9/2004 |
| WO | WO04/083594 | A3 | 9/2004 |
| WO | WO04/085790 | A2 | 10/2004 |
| WO | WO04/089608 | A2 | 10/2004 |
| WO | WO04/092527 | A2 | 10/2004 |
| WO | WO04/092528 | A2 | 10/2004 |
| WO | WO04/092530 | A2 | 10/2004 |
| WO | WO04/092530 | A3 | 10/2004 |
| WO | WO04/094766 | A2 | 11/2004 |
| WO | WO05/017303 | A2 | 2/2005 |
| WO | WO05/021921 | A2 | 3/2005 |
| WO | WO05/021922 | A2 | 3/2005 |
| WO | WO05/021922 | A3 | 3/2005 |
| WO | WO05/024170 | A2 | 3/2005 |
| WO | WO05/024171 | A2 | 3/2005 |
| WO | WO05/028803 | A2 | 3/2005 |

OTHER PUBLICATIONS

Offshore, "Agbada Well Solid Tubulars Expanded Bottom Up, Screens Expanded Top Down" William Furlow, Jan. 2002.(copy not available).
Drilling Contractor, "Solid Expandable Tubulars are Enabling Technology" Mar./Apr. 2001 .(copy not available).
Hart's E & P, "SEP Technology: Setting the Standard" Mar. 2002.
Hart's E & P, "An Expanded Horizon" Jim Brock, Lev Ring, Scott Costa, Andrei Filippov . Feb. 2000.
Hart's E & P, "Technology Strategy Breeds Value" Ali Daneshy. May 2004.
Hart's E & P, "Solid Expandable Tubulars Slimwell: Stepping Stone to MonoDiameter" Jun. 2003.
Innovators Chart the Course, Shell Exploration & Production.
"Case Study: Value in Drilling Derived From Application-Specific Technology" Langley, Diane., Oct. 2004.
L'Usine Nouvelle, "Les Tubes Expansibles Changent La Face Du Forage Petrolier" Demoulin, Laurence, No. 2878 . pp. 50-52, Jul. 3, 2003.
Offshore, "Monodiameter Technology Keeps Hole Diameter to TD", Hull, Jennifer., Oct. 2002.
News Release, "Shell and Halliburton Agree to Form Company to Develop and Market Expandable Casing Technology", 1998.
Offshore, "Expandable Tubulars Eable Multilaterals Without Compromise on Hole Size," DeMong, Karl, et al., Jun. 2003.
Offshore Engineer, "From Exotic to Routine- the offshore quickstep" Apr. 2004, pp. 77-83.
Offshore, "Expandable Solid Casing Reduces Telescope Effect," Furlow, William, Aug. 1998, pp. 102 & 140.
Offshore, "Casing Expansion, Test Process Fine Tuned on Ultra-deepwater Well," Furlow, William, Dec. 2000.
Offshore Engineer, "Oilfield Service Trio Target Jules Verne Territory," Von Flater, Rick., Aug. 2001.
Offshore, "Expandable Casing Program Helpas Operator Hit TD With Larger Tubulars" Furlow, William, Jan. 2000.
Offshore, "Same Internal Casing Diameter From Surface to TD", Cook, Lance., Jul. 2002.
Oil and Gas Investor, "Straightening the Drilling Curve," Williams, Peggy. Jan. 2003.
Petroleum Engineer International, "Expandable Casing Accesses Remote Reservoirs" Apr. 1999.
New Technology Magazine, "Pipe Dream Reality," Smith, Maurice, Dec. 2003.
Roustabout, "First ever SET Workshop Held in Aberdeen," Oct. 2004.
Roustabout, "Enventure Ready to Rejuvenate the North Sea" Sep. 2004.
EP Journal of Technology, "Solid Expandable Tubulars (SET) Provide Value to Operators Worldwide in a Variety of Applications," Fonlova, Rick, Apr. 2005.
The American Oil & Gas Reporter, "Advances Grow Expandable Applications," Bullock, Michael D., Sep. 2004.
Upstream, "Expandable Tubulars Close in on the Holy Grail of drilling", Cottrill, Adrian, Jul. 26, 2002.
Oil and Gas, "Shell Drills World's Monodiameter Well in South Texas" Sumrow, Mike., Oct. 21, 2002.
World Oil, "Expandables and the Dream Monodiameter Well: A Status Report", Fischer, Perry, Jul. 2004.
World Oil, "Well Remediation Using Expandable Case-Hole Liners", Merritt, Randy et al., Jul. 2002.
World Oil, "How in Situ Expansion Affects Casing and Tubing Properties", Mack, R.D., et al., Jul. 1999. pp. 69-71.
Enventure Global Technology "Expandable Tubular Technology—Drill Deeper, Farther, More Economically" Mark Rivenbark.
Society of Petroleum Engineers, "Addressing Common Drilling Challenges Using Solid Expandable Tubular Technology" Perez-Roca, Eduardo, et al., 2003.
Society of Petroleum Engineers, "Monodiameter Drilling Liner—From Concept to Reality" Dean, Bill, et al. 2003.
Offshore Technology Conference, "Expandable Liner Hangers: Case Histories" Moore, Melvin, J., et al., 2002.
Offshore Technology Conference, "Deepwater Expandable Openhole Liner Case Histories: Learnings Throuh Field Applications" Grant, Thomas P., et al., 2002.
Offshore Technology Conference, "Realization of the MonoDiameter Well: Evolution of a Game-Changing Technology" Dupal, Kenneth, et al., 2002.
Offshore Technology Conference, "Water Production Reduced Using Solid Expandable Tubular Technology to "Clad" in Fractured Carbonate Formation" van Noort, Roger, et al., 2003.
Offshore Technology Conference, "Overcoming Well Control Challenges with Solid Expandable Tubular Technology" Patin, Michael, et al., 2003.
Offshore Technology Conference, "Expandable Case-hole Liner Remediates Prolific Gas Well and Minimizes Loss of Production" Buckler Bill, et al., 2002.
Offshore Technology Conference, "Development and Field Testing of Solid Expandable Corrosion Resistant Case-hole Liners to Boost Gas Production in Corrosive Environments" Siemers Gertjan, et al., 2003.
"Practices for Providing Zonal Isolation in Conjunction with Expandable Casing Jobs—Case Histories" Sanders, T, et al. 2003.
Society of Petroleum Engineers, "Increasing Solid Expandable Tubular Technology Reliability in a Myriad of Downhole Environments", Escobar, C. et al., 2003.

Society of Petroleum Engineers, "Water Production Management—PDO's Successful Application of Expandable Technology", Braas, JCM., et al., 2002.
Society of Petroleum Engineers, "Expandable Tubular Solutions", Filippov, Andrei, et al., 1999.
Society of Petroleum Engineers, "Expandable Liner Hanger Provides Cost-Effective Alternative Solution" Lohoefe, C. Lee, et al., 2000.
Society of Petroleum Engineers, "Solid Expandable Tubular Technology—A Year of Case Histories in Drilling Environment" Dupal, Kenneth, et al., 2001.
"In-Situ Expansion of Casing and Tubing" Mack, Robert et al.
Society of Petroleum Engineers, "Expandable Tubulars: Field Examples of Application in Well Construction and Remediation" Diagle, Chan, et al., 2000.
AADE Houston Chapter, "Subsidence Remediation—Extending Well Life Through the /use of Solid Expandable Casing Systems"Shepherd, David, et al., Mar. 2001 Conference.
Society of Petroleum Engineers, "Planning the Well Construction Process for the Use of Solid Expandable Casing" DeMong, Karl, et al., 2003.
Enventure Global Technology, "The Development and Applications of Solid Expandable Tubular Technology" Cales, GL., 2003.
Society of Petroleum Engineers, "Installation of Solid Expandable Tubular Systems Through Milled Casing Windows" Waddell, Kevin, et al., 2004.
Society of Petroleum Engineers, "Solid Expandable Tubular Technology in Mature Basins" Blasingame, Kate, et al., 2003.
"Casing Design in Complex Wells: The Use of Expandables and Multilateral Technology to Attack the size Reduction Issue" DeMong, Karl. et al.
"Well Remediation Using Expandable Case-Hole Liners- Summary of Case Histories" Merritt, Randy, et al.
Offshore Technology Conference, "Transforming Conventional Wells to Blgbore Completions Using Solid Expandable Tubular Technology" Mohd Nor, Norlizah, et al., 2002.
Society of Petroleum Engineers, "Using Solid Expandable Tubulars for Openhole Water Shutoff" van Noort, Roger, et al., 2002.
Society of Petroleum Engineers, "Case Histories- Drilling and Recompletion Applications Using Solid Expandable Tubular Technology" Campo. Don, et al., 2002.
Society of Petroleum Engineers, "Reaching Deep Reservoir Targets Using Solid Expandable Tubulars" Gusevik Rune, et al., 2002.
Society of Petroleum Engineers, "Breakthroughs Using Solid Expandable Tubulars to Construct Extended Reach Wells" Demong, Karl, et al., 2004.
Deep Offshore Technology Conference "Meeting Economic Challenges of Deepwater Drilling with Expandable-Tubular Technology" Haut, Richard, et al., 1999.
Offshore Technology Conference, "Field Trial Proves Upgrades to Solid Expandable Tubulars" Moore, Melvin et al., 2002.
"Well Design with Expandable Tubulars Reduces Cost and Increases Success in Deepwater Applications" Dupal, Ken, et al., Deep Shore Technology 2000.
Offshore Technology Conference, "Reducing Non-Productive Time Through the Use of Solid Expandable Tubulars: How to Beat the Curve Through Pre-Planning" Cales, Gerry, et al., 2004.
Offshore Technology Conference, "Three Diverse Applications on Three Continents for a Single Major Operator" Sanders, Tom, et al., 2004.
Offshore Technology Conference,, "Expanding Oil Field Tubulars Through a Window Demonstrates Value and Provides New Well Construction Option", sParling, Steven, et al., 2004.
Society of Petroleum Engineers, "Advances in Single-diameter Well Technology: The Next Step to Cost-Effective Optimization" Waddell, Kevin, et al., 2004.
Society of Petroleum Engineers, "New Technologies Combine to Reduce Drilling Cost in Ultradeepwater Applications" Touboul, Nicolas, et al., 2004.
Society of Petroleum Engineers, "Solid Expandable Tubular Technology: The Value of Planned Installation vs. Contingency" Rivenbark, Mark, et al., 2004.
Society of Petroleum Engineers, "Changing Safety Paradigms in the Oil and Gas Industry" Ratliff, Matt, et al., 2004.
"Casing Remediation- Extending Well Life Through The Use of Solid Expandable Casing Systems" Merritt, Randy, et al.
Society of Petroleum Engineers, "Window Exit Sidetrack Enhancements Through the Use of Solid Expandable Casing", Rivenbark, Mark, et al., 2004.
"Solid Expandable Tubular Technology: The Value of Planned Installations vs. Contingency", Carstens, Chris, et al.,
Data Sheet, "Enventure Cased-Hole Liner (CHL) System" Enventure Global Technology, Dec. 2002.
Case History, "Graham Ranch No. 1 Newark East Barnett Field" Enventure Global Technology, Feb. 2002.
Case History, "K.K. Camel No. 1 Ridge Field Lafayette Parish, Louisiana" Enventure Global Technology, Feb. 2002.
Case History, "Eemskanaal -2 Groningen" Enventure Global Technology, Feb. 2002.
Case History, "Yibal 381 Oman" Enventure Global Technology, Feb. 2002.
Case History, "Mississippi Canyon 809 URSA TLP, OSC-G 5868, No. A-12" Enventure Global Technology, Mar. 2004.
Case History, "Unocal Sequoia Mississippi Canyon 941 Well No. 2" Enventure Global Technology, 2005.
"SET Technology: The Facts" Enventure Global Technology, 2004.
Data Sheet, "Enventure Openhole Liner (OHL) System" Enventure Global Technology, Dec. 2002.
Data Sheet, "Window Exit Applications OHL Window Exit Expansion" Enventure Global Technology, Jun. 2003.
"Expand Your Opportunities." *Enventure*. CD-ROM. Jun. 1999.
"Expand Your Opportunities." *Enventure*. CD-ROM. May 2001.
International Examination Report, Application PCT/US02/25608; Jun. 1, 2005.
International Examination Report, Application PCT/US02/36267, Jan. 4, 2004.
International Examination Report, Application PCT/US02/39418, Feb. 18, 2005.
International Examination Report, Application PCT/US03/04837, Dec. 9, 2004.
International Examination Report, Application PCT/US03/06544, May 10, 2005.
International Examination Report, Application PCT/US03/11765; Dec. 10, 2004.
International Examination Report, Application PCT/US03/11765;; Jan. 25, 2005.
International Examination Report, Application PCT/US03/13787; Apr. 7, 2005.
International Examination Report, Application PCT/US03/13787; Mar. 2, 2005.
International Examination Report, Application PCT/US03/14153; May 12, 2005.
International Examination Report, Application PCT/US03/15020, May 9, 2005.
International Examination Report, Application PCT/US03/25667, May 25, 2005.
International Search Report, Application PCT/US03/25716; Jan. 13, 2005.
International Search Report, Application PCT/US03/25742; Dec. 20, 2004.
International Search Report, Application PCT/US03/29460; May 25, 2004.
International Examination Report, Application PCT/US03/29460; Dec. 8, 2004.
International Examination Rpeort, Application PCT/US03/29858; May 23, 2005.
International Search Report, Application PCT/US03/38550; May 23, 2005.
International Preliminary Report on Patentablility, Application PCT/US04/02122; May 13, 2005.
International Preliminary Report on Patentability, Application PCT/US04/04740; Apr. 27, 2005.
International Preliminary Report on Patentability, Application PCT/US04/06246; May 5, 2005.

International Preliminary Report on Patentability, Application PCT/US04/08030; Apr. 7, 2005.
International Preliminary Report on Patentability, Application PCT/US04/08030; Jun. 10, 2005.
International Preliminary Report on Patentability, Application PCT/US04/08073; May 9, 2005.
International Preliminary Report on Patentability, Application PCT/US04/11177; Jun. 9, 2005.
Examination Report to Application No. AU 2001278196 ,Apr. 21, 2005.
Examination Report to Application No. AU 2002237757 ,Apr. 28, 2005.
Examination Report to Application No. AU 2002240366 ,Apr. 13, 2005.
Search Report to Application No. EP 02806451.7; Feb. 9, 2005.
Examination Report to Application No. GB 0225505.7 Feb. 15, 2005.
Examination Report to Application No. GB 0314846.7 , Jul. 15, 2004.
Search and Examination Report to Application No. GB 0400018.8; May 17, 2005.
Examination Report to Application No. GB 0400019.6; May 19, 2005.
Examination Report to Application No. GB 0403891.5, Feb. 14, 2005.
Examination Report to Application No. GB 0403893.1, Feb. 14, 2005.
Examination Report to Application No. GB 0403894.9, Feb. 15, 2005.
Examination Report to Application No. GB 0403920.2, Feb. 15, 2005.
Examination Report to Application No. GB 0403921.1, Feb. 15, 2005.
Examination Report to Application No. GB 0404796.5; Apr. 14, 2005.
Examination Report to Application No. GB 0406257.6, Jan. 25, 2005.
Examination Report to Application No. GB 0406258.4; Jan. 12, 2005.
Examination Report to Application No. GB 0408672.4, Mar. 21, 2005.
Examination Report to Application No. GB 0411698.4, Jan. 24, 2005.
Examination Report to Application No. GB 0411892.3, Feb. 21, 2005.
Examination Report to Application No. GB 0412533.2, May 20, 2005.
Search Report to Application No. GB 0415835.8, Dec. 2, 2004.
Search Report to Application No. GB 0415835.8; Mar. 10, 2005.
Examination Report to Application No. 0416625.2 Jan. 20, 2005.
Search and Examination Report to Application No. GB 0416834.0, Nov. 16, 2004.
Examination Report to Application No. GB 0422419.2 Dec. 8, 2004.
Search and Examination Report to Application No. GB 0422893.8 Nov. 24, 2004.
Search and Examination Report to Application No. GB 0425948.7 Apr. 13, 2005.
Search and Examination Report to Application No. GB 0425951.1 Apr. 14, 2005.
Search and Examination Report to Application No. GB 0425956.0 Apr. 14, 2005.
Search and Examination Report to Application No. GB 0426155.8 Jan. 12, 2005.
Search and Examination Report to Application No. GB 0426156.6 Jan. 12, 2005.
Search and Examination Report to Application No. GB 0426157.4 Jan. 12, 2005.
Examination Report to Application No. GB 0428141.6 Feb. 9, 2005.
Examination Report to Application No. GB 0500184.7 Feb. 9, 2005.
Search and Examination Report to Application No. GB 0500600.2 Feb. 15, 2005.
Examination Report to Application No. GB 0501667.0 May 27, 2005.
Search and Examination Report to Application No. GB 0503470.7 Mar. 21, 2005.
Search and Examination Report to Application No. GB 0506697.2 May 20, 2005.
Written Opinion to Application No. PCT/US02/25608 Feb. 2, 2005.
Written Opinion to Application No. PCT/US02/39425; Apr. 11, 2005.
Written Opinion to Application No. PCT/US03/06544; Feb. 18, 2005.
Written Opinion to Application No. PCT/US03/25675 May 9, 2005.
Written Opinion to Application No. PCT/US03/29858 Jan. 21, 2004.
Written Opinion to Application No. PCT/US03/38550 Dec. 10, 2004.
Written Opinion to Application No. PCT/US04/08171 May 5, 2005.
Combined Search Report and Written Opinion to Application No. PCT/US04/00631; Mar. 28, 2005.
Combined Search Report and Written Opinion to Application No. PCT/US04/02122 Feb. 24 2005.
Combined Search Report and Written Opinion to Application No. PCT/US04/04740 Jan. 19, 2005.
Combined Search Report and Written Opinion to Application No. PCT/US04/06246 Jan. 26, 2005.
Combined Search Report and Written Opinion to Application No. PCT/US04/08030 Jan. 6, 2005.
Combined Search Report and Written Opinion to Application No. PCT/US04/08073 Mar. 4, 2005.
Combined Search Report and Written Opinion to Application No. PCT/US04/08170 Jan. 13, 2005.
Combined Search Report and Written Opinion to Application No. PCT/US04/08171 Feb. 16, 2005.
Combined Search Report and Written Opinion to Application No. PCT/US04/11172 Feb. 14, 2005.
Combined Search Report and Written Opinion to Application No. PCT/US04/28438 Mar. 14, 2005.
International Examination Report, Application PCT/US02/24399, Aug. 6, 2004.
Examination Report, Application PCT/US02/25727; Jul. 7, 2004.
Examination Report, Application PCT/US03/10144; Jul. 7, 2004.
International Search Report, Application PCT/US03/20870; Sep. 30, 2004.
International Examination Report, Application PCT/US03/25676, Aug. 17, 2004.
International Examination Report, Application PCT/US03/25677, Aug. 17, 2004.
Examination Report to Application GB 0220872.6, Oct. 29, 2004.
Examination Report to Application No. GB 0225505.7, Oct. 27, 2004.
Examination Report to Application No. GB 0306046.4, Sep. 10, 2004.
Examination Report to Application No. GB 0400018.8; Oct. 29, 2004.
Examination Report to Application No. GB 0400019.6; Oct. 29, 2004.
Search and Examination Report to Application No. GB 0404833.6, Aug. 19, 2004.
Examination Report to Application No. GB 0404837.7, Jul. 12, 2004.
Examination Report to Application No. GB 0408672.4, Jul. 12, 2004.
Examination Report to Application No. GB 0404830.2, Aug. 17, 2004.
Search and Examination Report to Application No. GB 0411698.4, Jun. 30, 2004.
Search and Examination Report to Application No. GB 0411892.3, Jul. 14, 2004.
Search and Examination Report to Application No. GB 0411893.3, Jul. 14, 2004.
Search and Examination Report to Application No. GB 0411894.9, Jun. 30, 2004.

Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Search and Examination Report to Application No. GB 0416834.0, Aug. 11, 2004.
Search and Examination Report to Application No. GB 0417810.9, Aug. 25, 2004.
Search and Examination Report to Application No. GB 0417811.7, Aug. 25, 2004.
Search and Examination Report to Application No. GB 0418005.5, Aug. 25, 2004.
Search and Examination Report to Application No. GB 0418425.5, Sep. 10, 2004.
Search and Examination Report to Application No. GB 0418426.3 Sep. 10, 2004.
Search and Examination Report to Application No. GB 0418427.1 Sep. 10, 2004.
Search and Examination Report to Application No. GB 0418429.7 Sep. 10, 2004.
Search and Examination Report to Application No. GB 0418430.5 Sep. 10, 2004.
Search and Examination Report to Application No. GB 0418431.3 Sep. 10, 2004.
Search and Examination Report to Application No. GB 0418432.1 Sep. 10, 2004.
Search and Examination Report to Application No. GB 0418433.9 Sep. 10, 2004.
Search and Examination Report to Application No. GB 0418439.6 Sep. 10, 2004.
Search and Examination Report to Application No. GB 0418442.0 Sep. 10, 2004.
Search and Examination Report to Application No. GB 0423416.7 Nov. 12, 2004.
Search and Examination Report to Application No. GB 0423417.5 Nov. 12, 2004.
Search and Examination Report to Application No. GB 0423418.3 Nov. 12, 2004.
Written Opinion to Application No. PCT/US02/24399; Apr. 28, 2004.
Written Opinion to Application No. PCT/US02/25608 Sep. 13, 2004.
Written Opinion to Application No. PCT/US02/25675 Nov. 24, 2004.
Written Opinion to Application No. PCT/US02/25727; May 17, 2004.
Written Opinion to Application No. PCT/US02/39425; Nov. 22, 2004.
Written Opinion to Application No. PCT/US03/13787 Nov. 9, 2004.
Written Opinion to Application No. PCT/US03/14153 Sep. 9, 2004.
Written Opinion to Application No. PCT/US03/14153 Nov. 9, 2004.
Written Opinion to Application No. PCT/US03/18530 Sep. 13, 2004.
Written Opinion to Application No. PCT/US03/19993 Oct. 15, 2004.

* cited by examiner

ISOLATION OF SUBTERRANEAN ZONES

CROSS REFERENCE TO RELATED APPLICATIONS

This application is a continuation-in-part of U.S. patent application Ser. No. 09/969,922 filed on Oct. 3, 2001, now U.S. Pat. No. 6,634,431 which issued Dec. 11, 2001, which was a continuation-in-part of U.S. patent application Ser. No. 09/440,338, filed on Nov. 15, 1999, which issued as U.S. Pat. No. 6,328,113, which claimed the benefit of the filing date of U.S. provisional patent application Ser. No. 60/108,558, filed on Nov. 16, 1998, the disclosures of which are incorporated herein by reference.

This application is related to the following applications: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/332,947, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May. 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026 , filed on May. 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May. 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Mar. 10, 2000, which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, which claims priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, which claims priority from provisional application 60/124,042, filed on Mar. 11, 1999, (44) PCT application US 02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39425, filed on Dec. 10, 2002, which claims priority from U.S. provisional patent application Ser. No. 60/343,674 , filed on Dec. 27, 2001, (46) U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application U.S. Pat. No. 03/00609, filed on Jan. 9, 2003, which claims priority from U.S. provisional patent application Ser. No. 60/357,372 , filed on Feb. 15, 2002, (49) U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May. 29, 2002, (65) PCT application US 03/15020, filed on May. 12, 2003, which claims priority from U.S. provisional patent application Ser. No. 60/391,703, filed on Jun. 26, 2002, (66) PCT application U.S. Pat. No. 02/39418, filed on Dec. 10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application U.S. Pat No. 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application U.S. Pat No. 03/14153, filed on May. 6, 2003, which claims priority from U.S. provisional patent application Ser. No. 60/380,147, filed on May. 6, 2002, (77) PCT application US 03/19993, filed on Jun. 24, 2003, which claims priority from U.S. provisional patent application Ser. No. 60/397,284, filed on Jul. 19, 2002, (78) PCT application US 03/1 3787, filed on May. 5, 2003, which claims priority from U.S. provisional patent application Ser. No. 60/387,486 , filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2003, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May. 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional Pat. application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (Nov. 0) U.S. patent application Ser. No. 10/421,682, filed on Apr. 23, 2003, which is a continuation of U.S. patent application Ser. No. 09/523,468, filed on Mar. 10, 2000, which claims priority from provisional application 60/124,042, filed on Mar. 11, 1999, (Nov. 1) U.S. provisional patent application Ser. No. 60/457,965, filed on Mar. 27, 2003, (Nov. 2) U.S. provisional patent application Ser. No. 60/455,718, filed on Mar. 18, 2003, (Nov. 3) U.S. Pat. No. 6,550,821, which was filed as patent application Ser. No. 09/811,734, filed on Mar. 19, 2001, (Nov. 4) U.S. patent application Ser. No. 10/436,467, filed on May. 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (Nov. 5) U.S. provisional patent application Ser. No. 60/459,776, filed on Apr. 2, 2003, (Nov. 6) U.S. provisional patent application Ser. No. 60/461,094, filed on Apr. 8, 2003, (Nov. 7) U.S. provisional patent application Ser. No. 60/461,038, filed on Apr. 7, 2003, (Nov. 8) U.S. provisional patent application Ser. No. 60/463,586, filed on Apr. 17, 2003, (Nov. 9) U.S. provisional patent application Ser. No. 60/472,240, filed on May. 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, which was filed on Apr. 18, 2003, as a division of U.S. utility patent application Ser. No. 09/523,468, filed on Mar. 10, 2000, which claims priority from provisional application 60/124,042, filed on Mar. 11, 1999, (122) PCT patent application Ser. No. PCT/US2004/06246, filed on Feb. 26, 2004, (123) PCT patent application Ser. No. PCT/US2004/08170, filed on Mar. 15, 2004, (124) PCT patent application Ser. No. PCT/US2004/08171, filed on Mar. 15, 2004, (125) PCT patent application Ser. No. PCT/US2004/08073, filed on Mar. 18, 2004, (126) PCT patent application Ser. No. PCT/US2004/07711, filed on Mar. 11, 2004, (127) PCT patent application Ser. No. PCT/US2004/029025, filed on Mar. 26, 2004, (128) PCT patent application Ser. No. PCT/US2004/010317, filed on Apr. 2, 2004, (129) PCT patent application Ser. No. PCT/US2004/010712, filed on Apr. 6, 2004, (130) PCT patent application Ser. No. PCT/US2004/010762, filed on Apr. 6, 2004, (131) PCT patent application Ser. No. PCT/US2004/011973, filed on Apr. 15, 2004, (132) U.S. provisional patent application Ser. No. 60/495056, filed on Aug. 14, 2003, (133) U.S. provisional patent application Ser. No. 60/600679, filed on Aug. 11, 2004, (134) PCT patent application Ser. No. PCT/US2005/27318, filed on Jul. 29, 2005, the disclosures of which are incorporated herein by reference.

BACKGROUND OF THE INVENTION

This invention relates generally to oil and gas exploration, and in particular to isolating certain subterranean zones to facilitate oil and gas exploration.

During oil exploration, a wellbore typically traverses a number of zones within a subterranean formation. Some of these subterranean zones will produce oil and gas, while others will not. Further, it is often necessary to isolate subterranean zones from one another in order to facilitate the exploration for and production of oil and gas. Existing methods for isolating subterranean production zones in order to facilitate the exploration for and production of oil and gas are complex and expensive.

The present invention is directed to overcoming one or more of the limitations of the existing processes for isolating subterranean zones during oil and gas exploration.

SUMMARY OF THE INVENTION

According to one aspect of the present invention, an apparatus is provided that includes a zonal isolation assembly including: one or more solid tubular members, each solid tubular member including one or more external seals; and one or more perforated tubular members coupled to the solid tubular members; and a shoe coupled to the zonal isolation assembly. One or more of the perforated tubular members include an elastic sealing member coupled to the perforated tubular member and covering one or more of the perforations of the perforated tubular member.

According to another aspect of the present invention, an apparatus is provided that includes a zonal isolation assembly including one or more primary solid tubulars, each primary solid tubular including one or more external seals; n perforated tubulars coupled to the primary solid tubulars; and n−1 intermediate solid tubulars coupled to and interleaved among the perforated tubulars, each intermediate solid tubular including one or more external seals; and a shoe coupled to the zonal isolation assembly. One or more of the perforated tubular members include an elastic sealing member coupled to the perforated tubular member and covering one or more of the perforations of the perforated tubular member.

According to another aspect of the present invention, a method of isolating a first subterranean zone from a second subterranean zone in a wellbore is provided that includes positioning one or more primary solid tubulars within the wellbore, the primary solid tubulars traversing the first subterranean zone, positioning one or more perforated tubulars within the wellbore, the perforated tubulars traversing the second subterranean zone, fluidicly coupling the perforated tubulars and the primary solid tubulars, preventing the passage of fluids from the first subterranean zone to the second subterranean zone within the wellbore external to the solid and perforated tubulars, and covering one or more of the perforations of one or more of the perforated tubular members using an elastic sealing member.

According to another aspect of the present invention, a method of extracting materials from a producing subterranean zone in a wellbore, at least a portion of the wellbore including a casing is provided that includes positioning one or more primary solid tubulars within the wellbore, fluidicly coupling the primary solid tubulars with the casing, positioning one or more perforated tubulars within the wellbore, the perforated tubulars traversing the producing subterranean zone, fluidicly coupling the perforated tubulars with the primary solid tubulars, fluidicly isolating the producing subterranean zone from at least one other subterranean zone within the wellbore, fluidicly coupling at least one of the perforated tubulars with the producing subterranean zone, and covering one or more of the perforations of one or more of the perforated tubular members using an elastic sealing member.

According to another aspect of the present invention, an apparatus is provided that includes a subterranean formation including a wellbore, a zonal isolation assembly at least partially positioned within the wellbore including: one or more solid tubular members, each solid tubular member including one or more external seals, and one or more perforated tubular members coupled to the solid tubular members, and a shoe positioned within the wellbore coupled to the zonal isolation assembly. At least one of the solid tubular members and the perforated tubular members are formed by a radial expansion process performed within the wellbore, and one or more of the perforated tubular members include an elastic sealing member coupled to the perforated tubular member and covering one or more of the perforations of the perforated tubular member.

According to another aspect of the present invention, an apparatus is provided that includes a subterranean formation including a wellbore, a zonal isolation assembly positioned within the wellbore including: one or more primary solid tubulars, each primary solid tubular including one or more external seals, n perforated tubulars positioned coupled to the primary solid tubulars, and n−1 intermediate solid tubulars coupled to and interleaved among the perforated tubulars, each intermediate solid tubular including one or more external seals, and a shoe coupled to the zonal isolation assembly. At least one of the primary solid tubulars, the perforated tubulars, and the intermediate solid tubulars are formed by a radial expansion process performed within the wellbore, and one or more of the perforated tubular members include an elastic sealing member coupled to the perforated tubular member and covering one or more of the perforations of the perforated tubular member.

According to another aspect of the present invention, a method of isolating a first subterranean zone from a second subterranean zone in a wellbore is provided that includes positioning one or more primary solid tubulars within the wellbore, the primary solid tubulars traversing the first subterranean zone, positioning one or more perforated tubulars within the wellbore, the perforated tubulars traversing the second subterranean zone, radially expanding at least one of the primary solid tubulars and perforated tubulars within the wellbore, fluidicly coupling the perforated tubulars and the primary solid tubulars, preventing the passage of fluids from the first subterranean zone to the second subterranean zone within the wellbore external to the primary solid tubulars and perforated tubulars, and covering one or more of the perforations of one or more of the perforated tubular members using an elastic sealing member.

According to another aspect of the present invention, a method of extracting materials from a producing subterranean zone in a wellbore, at least a portion of the wellbore including a casing, is provided that includes positioning one or more primary solid tubulars within the wellbore, positioning one or more perforated tubulars within the wellbore, the perforated tubulars traversing the producing subterranean zone, radially expanding at least one of the primary solid tubulars and the perforated tubulars within the wellbore, fluidicly coupling the primary solid tubulars with the casing, fluidicly coupling the perforated tubulars with the primary solid tubulars, fluidicly isolating the producing subterranean zone from at least one other subterranean zone within the wellbore, fluidicly coupling at least one of the perforated tubulars with the producing subterranean zone, and covering one or more of the perforations of one or more of the perforated tubular members using an elastic sealing member.

According to another aspect of the present invention, an apparatus is provided that includes a subterranean formation including a wellbore, a zonal isolation assembly positioned within the wellbore including: n solid tubular members positioned within the wellbore, each solid tubular member including one or more external seals, and n−1 perforated tubular members positioned within the wellbore coupled to and interleaved among the solid tubular members, and a shoe positioned within the wellbore coupled to the zonal isolation assembly. One or more of the perforated tubular members include a tubular elastic sealing member coupled to the perforated tubular member and covering one or more of the perforations of the perforated tubular member.

According to another aspect of the present invention, a system for isolating a first subterranean zone from a second subterranean zone in a wellbore is provided that includes means for positioning one or more primary solid tubulars within the wellbore, the primary solid tubulars traversing the first subterranean zone, means for positioning one or more perforated tubulars within the wellbore, the perforated tubulars traversing the second subterranean zone, means for fluidicly coupling the perforated tubulars and the primary solid tubulars, means for preventing the passage of fluids from the first subterranean zone to the second subterranean zone within the wellbore external to the primary solid tubulars and the perforated tubulars, and means for sealing one or more of the perforations of one or more of the perforated tubular members.

According to another aspect of the present invention, a system for extracting materials from a producing subterranean zone in a wellbore, at least a portion of the wellbore including a casing, is provided that includes means for positioning one or more primary solid tubulars within the wellbore, means for fluidicly coupling the primary solid tubulars with the casing, means for positioning one or more perforated tubulars within the wellbore, the perforated tubulars traversing the producing subterranean zone, means for fluidicly coupling the perforated tubulars with the primary solid tubulars, means for fluidicly isolating the producing subterranean zone from at least one other subterranean zone within the wellbore, means for fluidicly coupling at least one of the perforated tubulars with the producing subterranean zone, and means for sealing one or more of the perforations of one or more of the perforated tubular members using an elastic sealing member.

According to another aspect of the present invention, a system for isolating a first subterranean zone from a second subterranean zone in a wellbore is provided that includes means for positioning one or more primary solid tubulars within the wellbore, the primary solid tubulars traversing the first subterranean zone, means for positioning one or more perforated tubulars within the wellbore, the perforated tubulars traversing the second subterranean zone, means for radially expanding at least one of the primary solid tubulars and perforated tubulars within the wellbore, means for fluidicly coupling the perforated tubulars and the primary solid tubulars, means for preventing the passage of fluids from the first subterranean zone to the second subterranean zone within the wellbore external to the primary solid tubulars and perforated tubulars, and means for sealing one or more of the perforations of one or more of the perforated tubular members using an elastic sealing member.

According to another aspect of the present invention, a system for extracting materials from a producing subterranean zone in a wellbore, at least a portion of the wellbore including a casing, is provided that includes means for positioning one or more primary solid tubulars within the wellbore, means for positioning one or more perforated tubulars within the wellbore, the perforated tubulars traversing the producing subterranean zone, means for radially expanding at least one of the primary solid tubulars and the perforated tubulars within the wellbore, means for fluidicly coupling the primary solid tubulars with the casing, means for fluidicly coupling the perforated tubulars with the solid tubulars, means for fluidicly isolating the producing subterranean zone from at least one other subterranean zone within the wellbore, means for fluidicly coupling at least one of the perforated tubulars with the producing subterranean zone, and means for sealing one or more of the perforations of one or more of the perforated tubular members using an elastic sealing member.

According to another aspect of the present invention, a system for isolating subterranean zones traversed by a wellbore is provided that includes a tubular support member defining a first passage, a tubular expansion cone defining a second passage fluidicly coupled to the first passage coupled to an end of the tubular support member and comprising a tapered end, a tubular liner coupled to and supported by the tapered end of the tubular expansion cone, and a shoe defining a valveable passage coupled to an end of the tubular liner. The tubular liner includes one or more expandable tubular members that each include: a tubular body comprising an intermediate portion and first and second expanded end portions coupled to opposing ends of the intermediate portion, and a sealing member coupled to the exterior surface of the intermediate portion, and one or more perforated tubular members coupled to the expandable tubular members. The inside diameters of the perforated tubular members are greater than or equal to the outside diameter of the tubular expansion cone.

According to another aspect of the present invention, a method of isolating subterranean zones traversed by a wellbore is provided that includes positioning a tubular liner within the wellbore, and radially expanding one or more discrete portions of the tubular liner into engagement with the wellbore. The tubular liner includes a plurality of tubular members, and one or more of the tubular members are radially expanded into engagement with the wellbore and one or more of the tubular members are not radially expanded into engagement with the wellbore. The tubular liner includes one or more expandable tubular members that each include: a tubular body comprising an intermediate portion and first and second expanded end portions coupled to opposing ends of the intermediate portion, and a sealing member coupled to the exterior surface of the intermediate portion, and one or more perforated tubular members coupled to the expandable tubular members. The inside diameters of the perforated tubular members are greater than or equal to the maximum inside diameters of the expandable tubular members.

According to another aspect of the present invention, an apparatus for isolating subterranean zones is provided that includes a subterranean formation defining a borehole, and a tubular liner positioned in and coupled to the borehole at one or more discrete locations. The tubular liner includes a plurality of tubular members, and one or more of the tubular members are radially expanded into engagement with the borehole and one or more of the tubular members are not radially expanded into engagement with the borehole. The tubular liner is coupled to the borehole by a process that includes positioning the tubular liner within the borehole, and radially expanding one or more discrete portions of the tubular liner into engagement with the borehole.

According to another aspect of the present invention, a method of sealing an annulus between a wellbore and a tubular member positioned within the wellbore is provided that includes coupling a swellable elastomeric material to the exterior of the tubular member that swells in the presence of fluidic materials to sealingly engage the wellbore.

DETAILED DESCRIPTION OF THE ILLUSTRATIVE EMBODIMENTS

An apparatus and method for isolating one or more subterranean zones from one or more other subterranean zones is provided. The apparatus and method permits a producing zone to be isolated from a nonproducing zone using a combination of solid and slotted tubulars. In the production mode, the teachings of the present disclosure may be used in combination with conventional, well known, production completion equipment and methods using a series of packers, solid tubing, perforated tubing, and sliding sleeves, which will be inserted into the disclosed apparatus to permit the commingling and/or isolation of the subterranean zones from each other.

Figure 1:
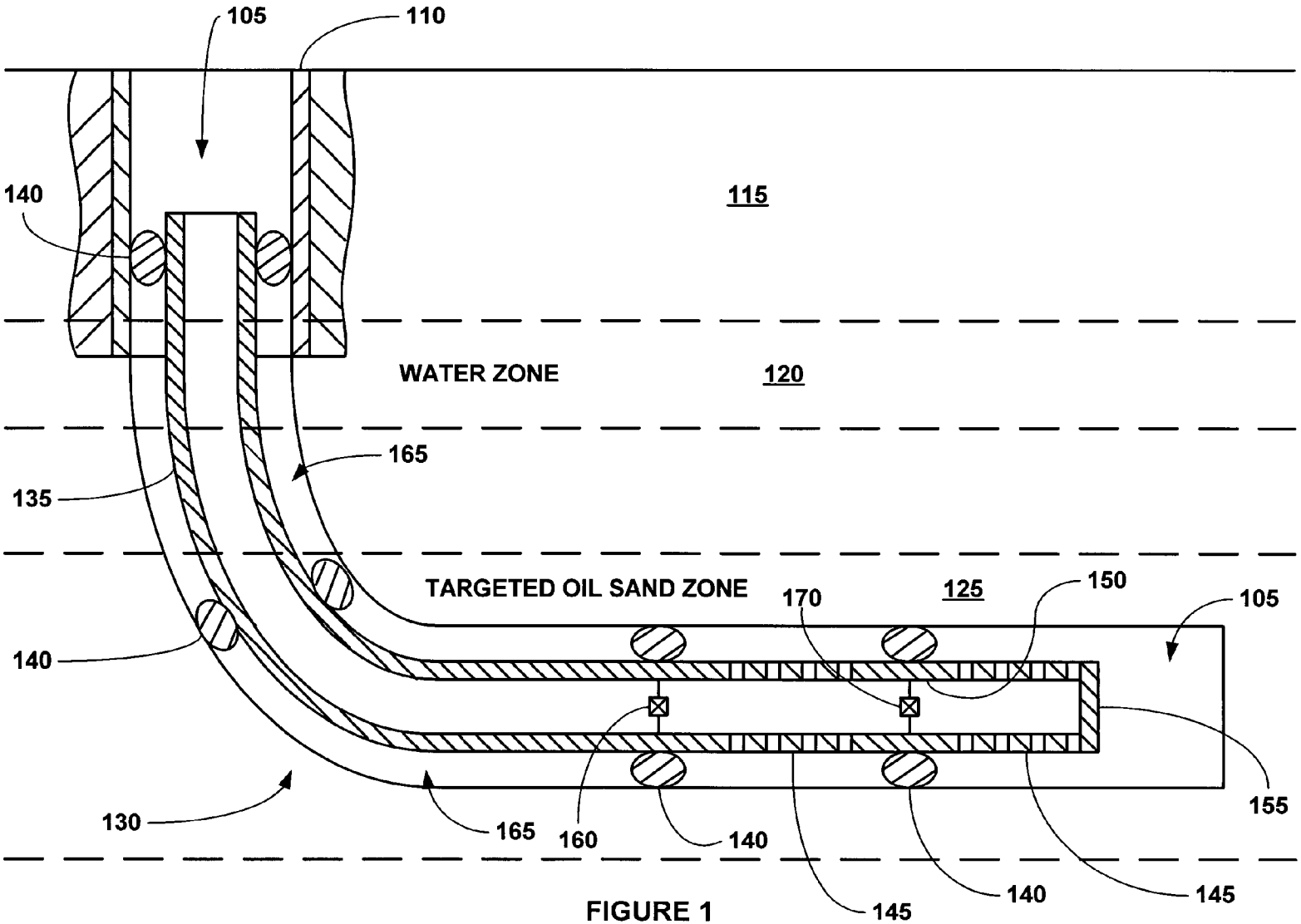
FIG. 1 is a fragmentary cross-sectional view illustrating the isolation of subterranean zones.

Referring to FIG. 1, a wellbore 105 including a casing 110 are positioned in a subterranean formation 115. The subterranean formation 115 includes a number of productive and non-productive zones, including a water zone 120 and a targeted oil sand zone 125. During exploration of the subterranean formation 115, the wellbore 105 may be extended in a well known manner to traverse the various productive and non-productive zones, including the water zone 120 and the targeted oil sand zone 125.

In a preferred embodiment, in order to fluidicly isolate the water zone 120 from the targeted oil sand zone 125, an apparatus 130 is provided that includes one or more sections of solid casing 135, one or more external seals 140, one or more sections of slotted casing 145, one or more intermediate sections of solid casing 150, and a solid shoe 155.

The solid casing 135 may provide a fluid conduit that transmits fluids and other materials from one end of the solid casing 135 to the other end of the solid casing 135. The solid casing 135 may comprise any number of conventional commercially available sections of solid tubular casing such as, for example, oilfield tubulars fabricated from chromium steel or fiberglass. In a preferred embodiment, the solid casing 135 comprises oilfield tubulars available from various foreign and domestic steel mills.

The solid casing 135 is preferably coupled to the casing 110. The solid casing 135 may be coupled to the casing 110 using any number of conventional commercially available processes such as, for example, welding, slotted and expandable connectors, or expandable solid connectors. In a preferred embodiment, the solid casing 135 is coupled to the casing 110 by using expandable solid connectors. The solid casing 135 may comprise a plurality of such solid casing 135.

The solid casing 135 is preferably coupled to one more of the slotted casings 145. The solid casing 135 may be coupled to the slotted casing 145 using any number of conventional commercially available processes such as, for example, welding, or slotted and expandable connectors. In a preferred embodiment, the solid casing 135 is coupled to the slotted casing 145 by expandable solid connectors.

In a preferred embodiment, the casing 135 includes one more valve members 160 for controlling the flow of fluids and other materials within the interior region of the casing 135. In an alternative embodiment, during the production mode of operation, an internal tubular string with various arrangements of packers, perforated tubing, sliding sleeves, and valves may be employed within the apparatus to provide various options for commingling and isolating subterranean zones from each other while providing a fluid path to the surface.

In a particularly preferred embodiment, the casing 135 is placed into the wellbore 105 by expanding the casing 135 in the radial direction into intimate contact with the interior walls of the wellbore 105. The casing 135 may be expanded in the radial direction using any number of conventional commercially available methods.

The seals 140 prevent the passage of fluids and other materials within the annular region 165 between the solid casings 135 and 150 and the wellbore 105. The seals 140 may comprise any number of conventional commercially available sealing materials suitable for sealing a casing in a wellbore such as, for example, lead, rubber or epoxy. In a preferred embodiment, the seals 140 comprise Stratalok epoxy material available from Halliburton Energy Services. The slotted casing 145 permits fluids and other materials to pass into and out of the interior of the slotted casing 145 from and to the annular region 165. In this manner, oil and gas may be produced from a producing subterranean zone within a subterranean formation. The slotted casing 145 may comprise any number of conventional commercially available sections of slotted tubular casing. In a preferred embodiment, the slotted casing 145 comprises expandable slotted tubular casing available from Petroline in Abeerdeen, Scotland. In a particularly preferred embodiment, the slotted casing 145 comprises expandable slotted sandscreen tubular casing available from Petroline in Abeerdeen, Scotland.

The slotted casing 145 is preferably coupled to one or more solid casing 135. The slotted casing 145 may be coupled to the solid casing 135 using any number of conventional commercially available processes such as, for example, welding, or slotted or solid expandable connectors. In a preferred embodiment, the slotted casing 145 is coupled to the solid casing 135 by expandable solid connectors.

The slotted casing 145 is preferably coupled to one or more intermediate solid casings 150. The slotted casing 145 may be coupled to the intermediate solid casing 150 using any number of conventional commercially available processes such as, for example, welding or expandable solid or slotted connectors. In a preferred embodiment, the slotted casing 145 is coupled to the intermediate solid casing 150 by expandable solid connectors.

The last slotted casing 145 is preferably coupled to the shoe 155. The last slotted casing 145 may be coupled to the shoe 155 using any number of conventional commercially available processes such as, for example, welding or expandable solid or slotted connectors. In a preferred embodiment, the last slotted casing 145 is coupled to the shoe 155 by an expandable solid connector.

In an alternative embodiment, the shoe 155 is coupled directly to the last one of the intermediate solid casings 150.

In a preferred embodiment, the slotted casings 145 are positioned within the wellbore 105 by expanding the slotted casings 145 in a radial direction into intimate contact with the interior walls of the wellbore 105. The slotted casings 145 may be expanded in a radial direction using any number of conventional commercially available processes.

The intermediate solid casing 150 permits fluids and other materials to pass between adjacent slotted casings 145. The intermediate solid casing 150 may comprise any number of conventional commercially available sections of solid tubular casing such as, for example, oilfield tubulars fabricated from chromium steel or fiberglass. In a preferred embodiment, the intermediate solid casing 150 comprises oilfield tubulars available from foreign and domestic steel mills.

The intermediate solid casing 150 is preferably coupled to one or more sections of the slotted casing 145. The intermediate solid casing 150 may be coupled to the slotted casing 145 using any number of conventional commercially available processes such as, for example, welding, or solid or slotted expandable connectors. In a preferred embodiment, the intermediate solid casing 150 is coupled to the slotted casing 145 by expandable solid connectors. The intermediate solid casing 150 may comprise a plurality of such intermediate solid casing 150.

In a preferred embodiment, the each intermediate solid casing 150 includes one more valve members 170 for controlling the flow of fluids and other materials within the interior region of the intermediate casing 150. In an alternative embodiment, as will be recognized by persons having ordinary skill in the art and the benefit of the present disclosure, during the production mode of operation, an internal tubular string with various arrangements of packers, perforated tubing, sliding sleeves, and valves may be employed within the apparatus to provide various options for commingling and isolating subterranean zones from each other while providing a fluid path to the surface.

In a particularly preferred embodiment, the intermediate casing 150 is placed into the wellbore 105 by expanding the intermediate casing 150 in the radial direction into intimate contact with the interior walls of the wellbore 105. The intermediate casing 150 may be expanded in the radial direction using any number of conventional commercially available methods.

In an alternative embodiment, one or more of the intermediate solid casings 150 may be omitted. In an alternative preferred embodiment, one or more of the slotted casings 145 are provided with one or more seals 140.

The shoe 155 provides a support member for the apparatus 130. In this manner, various production and exploration tools may be supported by the show 150. The shoe 150 may comprise any number of conventional commercially available shoes suitable for use in a wellbore such as, for example, cement filled shoe, or an aluminum or composite shoe. In a preferred embodiment, the shoe 150 comprises an aluminum shoe available from Halliburton. In a preferred embodiment, the shoe 155 is selected to provide sufficient strength in compression and tension to permit the use of high capacity production and exploration tools.

In a particularly preferred embodiment, the apparatus 130 includes a plurality of solid casings 135, a plurality of seals 140, a plurality of slotted casings 145, a plurality of intermediate solid casings 150, and a shoe 155. More generally, the apparatus 130 may comprise one or more solid casings 135, each with one or more valve members 160, n slotted casings 145, n−1 intermediate solid casings 150, each with one or more valve members 170, and a shoe 155.

During operation of the apparatus 130, oil and gas may be controllably produced from the targeted oil sand zone 125 using the slotted casings 145. The oil and gas may then be transported to a surface location using the solid casing 135. The use of intermediate solid casings 150 with valve members 170 permits isolated sections of the zone 125 to be selectively isolated for production. The seals 140 permit the zone 125 to be fluidicly isolated from the zone 120. The seals 140 further permits isolated sections of the zone 125 to be fluidicly isolated from each other. In this manner, the apparatus 130 permits unwanted and/or non-productive subterranean zones to be fluidicly isolated.

In an alternative embodiment, as will be recognized by persons having ordinary skill in the art and also having the benefit of the present disclosure, during the production mode of operation, an internal tubular string with various arrangements of packers, perforated tubing, sliding sleeves, and valves may be employed within the apparatus to provide various options for commingling and isolating subterranean zones from each other while providing a fluid path to the surface.

Referring to FIGS. 2*a*–2*d*, an illustrative embodiment of a system 200 for isolating subterranean formations includes a tubular support member 202 that defines a passage 202*a*. A tubular expansion cone 204 that defines a passage 204*a* is coupled to an end of the tubular support member 202. In an exemplary embodiment, the tubular expansion cone 204 includes a tapered outer surface 204*b* for reasons to be described.

A pre-expanded end 206*a* of a first expandable tubular member 206 that defines a passage 206*b* is adapted to mate with and be supported by the tapered outer surface 204*b* of the tubular expansion cone 204. The first expandable tubular member 206 further includes an unexpanded intermediate portion 206*c*, another pre-expanded end 206*d*, and a sealing member 206*e* coupled to the exterior surface of the unexpanded intermediate portion. In an exemplary embodiment, the inside and outside diameters of the pre-expanded ends, 206*a* and 206*d*, of the first expandable tubular member 206 are greater than the inside and outside diameters of the unexpanded intermediate portion 206*c*. An end 208*a* of a shoe 208 is coupled to the pre-expanded end 206*a* of the first expandable tubular member 206 by a conventional threaded connection.

An end 210*a* of a slotted tubular member 210 that defines a passage 210*b* is coupled to the other pre-expanded end 206*d* of the first expandable tubular member 206 by a conventional threaded connection. Another end 210*c* of the slotted tubular member 210 is coupled to an end 212*a* of a slotted tubular member 212 that defines a passage 212*b* by a conventional threaded connection. A pre-expanded end 214*a* of a second expandable tubular member 214 that defines a passage 214*b* is coupled to the other end 212*c* of the tubular member 212. The second expandable tubular member 214 further includes an unexpanded intermediate portion 214*c*, another pre-expanded end 214*d*, and a sealing member 214*e* coupled to the exterior surface of the unexpanded intermediate portion. In an exemplary embodiment, the inside and outside diameters of the pre-expanded ends, 214*a* and 214*d*, of the second expandable tubular member 214 are greater than the inside and outside diameters of the unexpanded intermediate portion 214*c*.

An end 216*a* of a slotted tubular member 216 that defines a passage 216*b* is coupled to the other pre-expanded end 214*d* of the second expandable tubular member 214 by a conventional threaded connection. Another end 216*c* of the slotted tubular member 216 is coupled to an end 218*a* of a slotted tubular member 218 that defines a passage 218*b* by a conventional threaded connection. A pre-expanded end 220*a* of a third expandable tubular member 220 that defines a passage 220*b* is coupled to the other end 218*c* of the slotted tubular member 218. The third expandable tubular member 220 further includes an unexpanded intermediate portion 220*c*, another pre-expanded end 220*d*, and a sealing member 220*e* coupled to the exterior surface of the unexpanded intermediate portion. In an exemplary embodiment, the inside and outside diameters of the pre-expanded ends, 220*a* and 220*d*, of the third expandable tubular member 220 are greater than the inside and outside diameters of the unexpanded intermediate portion 220*c*.

An end 222*a* of a tubular member 222 is threadably coupled to the end 30*d* of the third expandable tubular member 220.

In an exemplary embodiment, the inside and outside diameters of the pre-expanded ends, 206*a*, 206*d*, 214*a*, 214*d*, 220*a* and 220*d*, of the expandable tubular members, 206, 214, and 220, and the slotted tubular members 210, 212, 216, and 218, are substantially equal. In several exemplary embodiments, the sealing members, 206*e*, 214*e*, and 220*e*, of the expandable tubular members, 206, 214, and 220, respectively, further include anchoring elements for engaging the wellbore casing 104. In several exemplary embodiments, the slotted tubular members, 210, 212, 216, and 218, are conventional slotted tubular members having threaded end connections suitable for use in an oil or gas well, an underground pipeline, or as a structural support. In several alternative embodiments, the slotted tubular members, 210, 212, 216, and 218 are conventional slotted tubular members for recovering or introducing fluidic materials such as, for example, oil, gas and/or water from or into a subterranean formation.

Figure 2A:
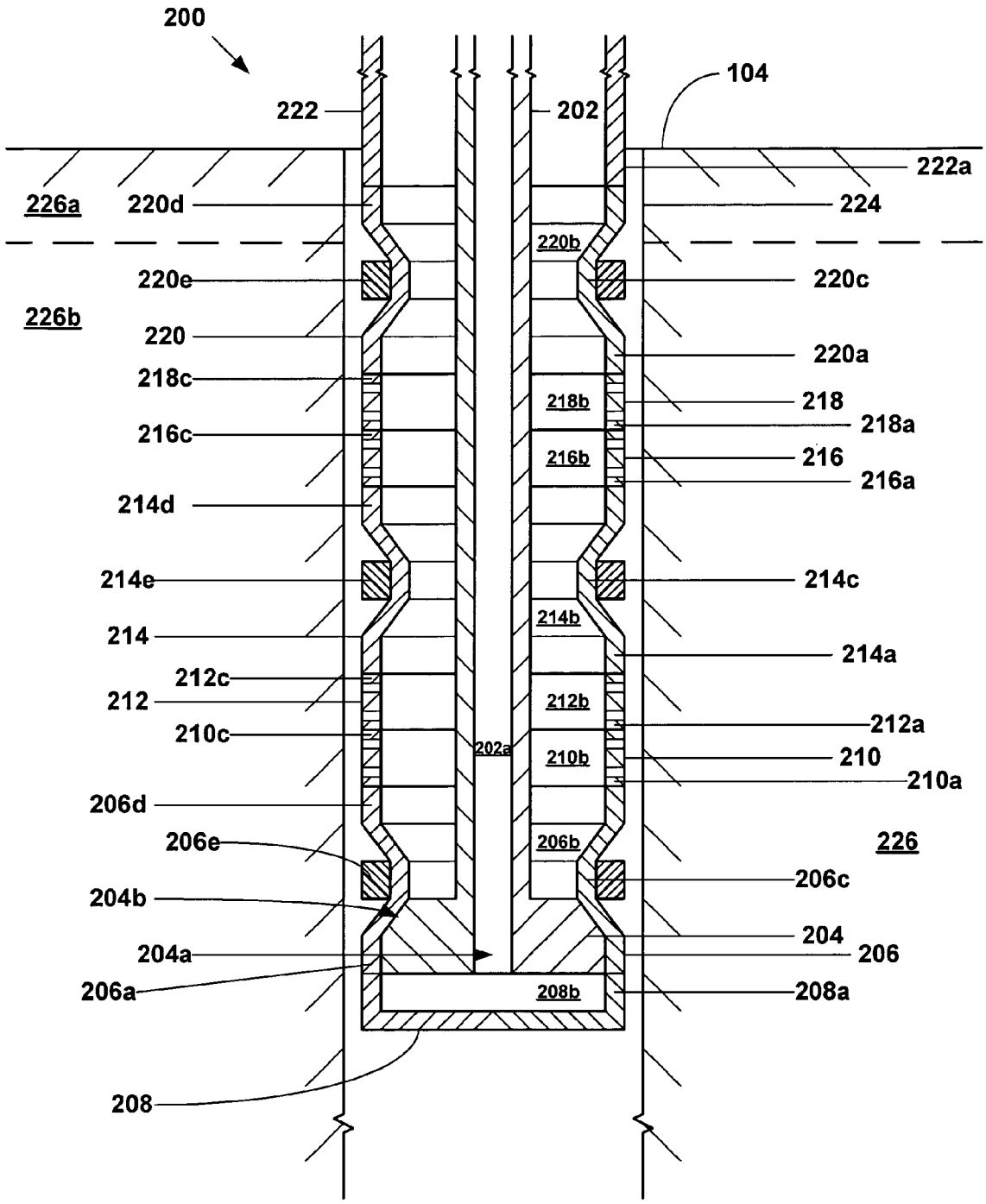
FIG. 2*a* is a cross sectional illustration of the placement of an illustrative embodiment of a system for isolating subterranean zones within a borehole.

In an exemplary embodiment, as illustrated in FIG. 2*a*, the system 200 is initially positioned in a borehole 224 formed in a subterranean formation 226 that includes a water zone 226*a* and a targeted oil sand zone 226*b*. The borehole 224 may be positioned in any orientation from vertical to horizontal. In an exemplary embodiment, the upper end of the tubular support member 202 may be supported in a conventional manner using, for example, a slip joint, or equivalent device in order to permit upward movement of the tubular support member and tubular expansion cone 204 relative to one or more of the expandable tubular members, 206, 214, and 220, and tubular members, 210, 212, 216, and 218.

Figure 2B:
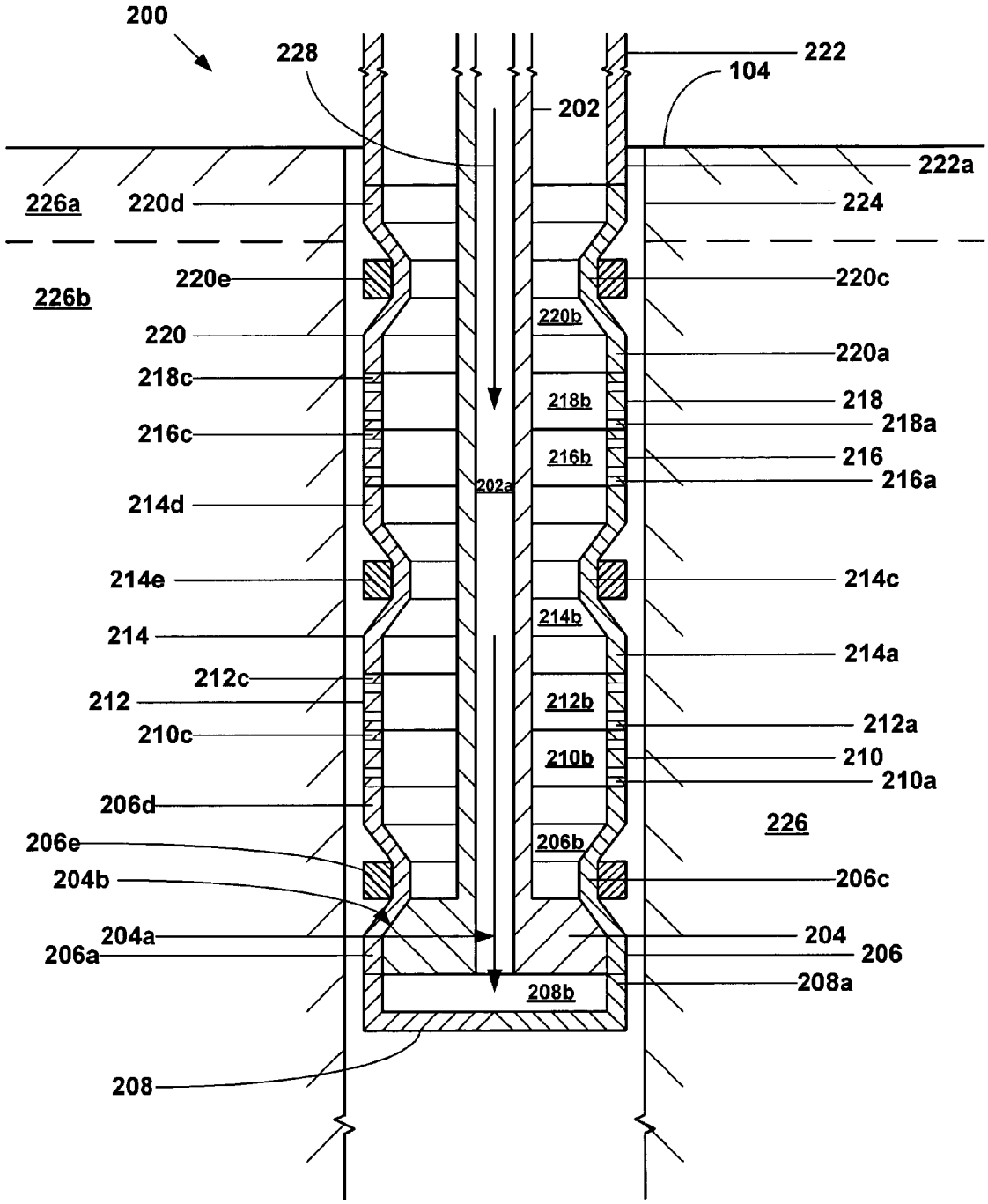
FIG. 2*b* is a cross sectional illustration of the system of FIG. 2*a* during the injection of a fluidic material into the tubular support member.

In an exemplary embodiment, as illustrated in FIG. 2*b*, a fluidic material 228 is then injected into the system 200, through the passages, 202*a* and 204*a*, of the tubular support member 202 and tubular expansion cone 204, respectively.

Figure 2C:
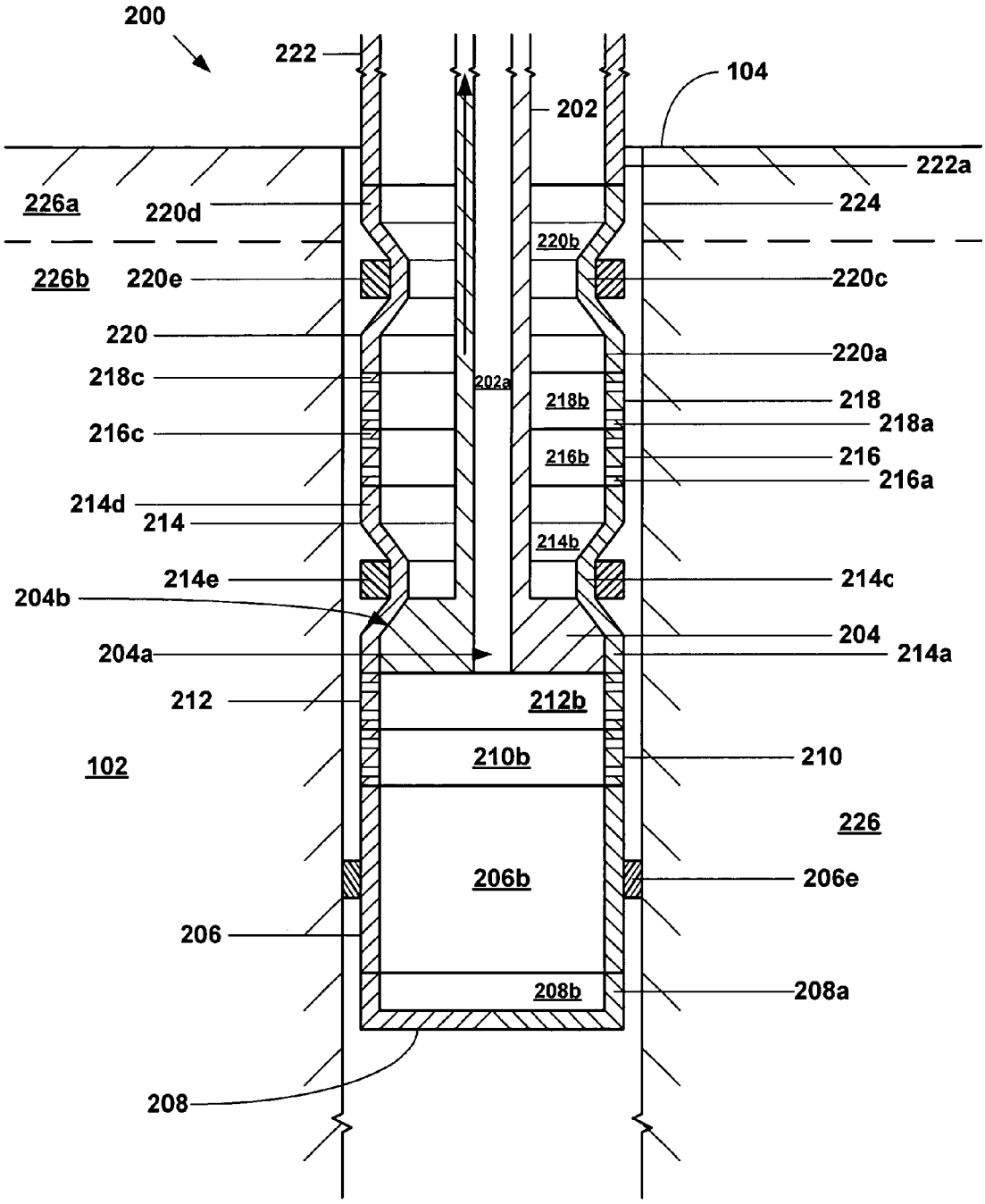
FIG. 2*c* is a cross sectional illustration of the system of FIG. 2*b* while pulling the tubular expansion cone out of the wellbore.

In an exemplary embodiment, as illustrated in FIG. 2*c*, the continued injection of the fluidic material 228 through the passages, 202*a* and 204*a*, of the tubular support member 202 and the tubular expansion cone 204, respectively, pressurizes the passage 18*b* of the shoe 18 below the tubular expansion cone thereby radially expanding and plastically deforming the expandable tubular member 206 off of the tapered external surface 204*b* of the tubular expansion cone 204. In particular, the intermediate non pre-expanded portion 206*c* of the expandable tubular member 206 is radially expanded and plastically deformed off of the tapered external surface 204*b* of the tubular expansion cone 204. As a result, the sealing member 206*e* engages the interior surface of the wellbore casing 104. Consequently, the radially expanded intermediate portion 206*c* of the expandable tubular member 206 is thereby coupled to the wellbore casing 104. In an exemplary embodiment, the radially expanded intermediate portion 206*c* of the expandable tubular member 206 is also thereby anchored to the wellbore casing 104.

Figure 2D:
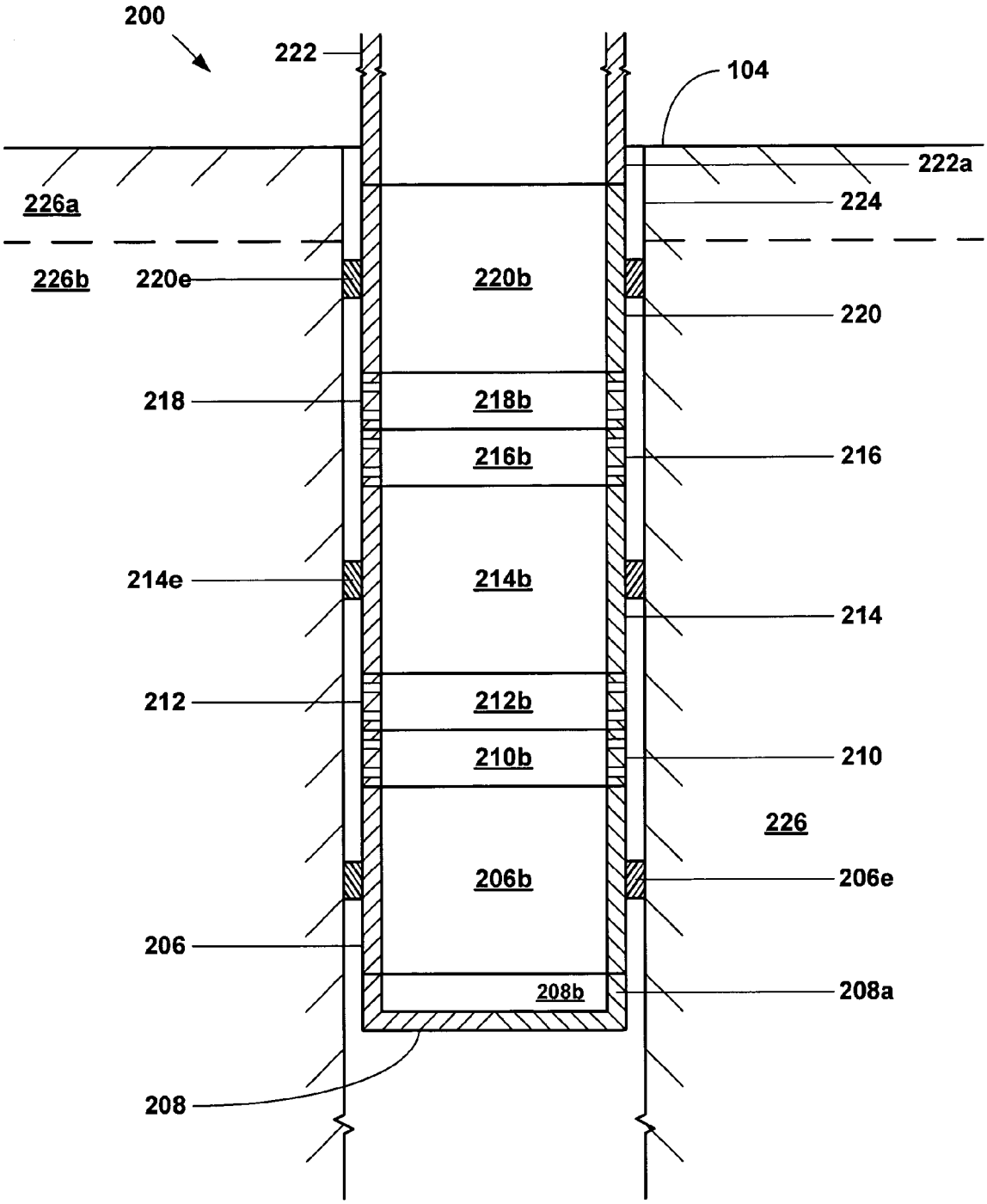
FIG. 2*d* is a cross sectional illustration of the system of FIG. 2*c* after the tubular expansion cone has been completely pulled out of the wellbore.

In an exemplary embodiment, as illustrated in FIG. 2*d*, after the expandable tubular member 206 has been plastically deformed and radially expanded off of the tapered external surface 204*b* of the tubular expansion cone 204, the tubular expansion cone is pulled out of the borehole 224 by applying an upward force to the tubular support member 202. As a result, the second and third expandable tubular members, 214 and 220, are radially expanded and plastically deformed off of the tapered external surface 204*b* of the tubular expansion cone 204. In particular, the intermediate non pre-expanded portion 214*c* of the second expandable tubular member 214 is radially expanded and plastically deformed off of the tapered external surface 204*b* of the tubular expansion cone 204. As a result, the sealing member 214*e* engages the interior surface of the wellbore 224. Consequently, the radially expanded intermediate portion 214*c* of the second expandable tubular member 214 is thereby coupled to the wellbore 224. In an exemplary embodiment, the radially expanded intermediate portion 214*c* of the second expandable tubular member 214 is also thereby anchored to the wellbore 104. Furthermore, the continued application of the upward force to the tubular member 202 will then displace the tubular expansion cone 204 upwardly into engagement with the pre-expanded end 220*a* of the third expandable tubular member 220. Finally, the continued application of the upward force to the tubular member 202 will then radially expand and plastically deform the third expandable tubular member 220 off of the tapered external surface 204*b* of the tubular expansion cone 204. In particular, the intermediate non pre-expanded portion 220*c* of the third expandable tubular member 220 is radially expanded and plastically deformed off of the tapered external surface 204*b* of the tubular expansion cone 204. As a result, the sealing member 220*e* engages the interior surface of the wellbore 224. Consequently, the radially expanded intermediate portion 220*c* of the third expandable tubular member 220 is thereby coupled to the wellbore 224. In an exemplary embodiment, the radially expanded intermediate portion 220*c* of the third expandable tubular member 220 is also thereby anchored to the wellbore 224. As a result, the water zone 226*a* and fluidicly isolated from the targeted oil sand zone 226*b*.

After completing the radial expansion and plastic deformation of the third expandable tubular member 220, the tubular support member 202 and the tubular expansion cone 204 are removed from the wellbore 224.

Thus, during the operation of the system 10, the intermediate non pre-expanded portions, 206*c*, 214*c*, and 220*c*, of the expandable tubular members, 206, 214, and 220, respectively, are radially expanded and plastically deformed by the upward displacement of the tubular expansion cone 204. As a result, the sealing members, 206*e*, 214*e*, and 220*e*, are displaced in the radial direction into engagement with the wellbore 224 thereby coupling the shoe 208, the expandable tubular member 206, the slotted tubular members, 210 and 212, the expandable tubular member 214, the slotted tubular members, 216 and 218, and the expandable tubular member 220 to the wellbore. Furthermore, as a result, the connections between the expandable tubular members, 206, 214, and 220, the shoe 208, and the slotted tubular members, 210, 212, 216, and 218, do not have to be expandable connections thereby providing significant cost savings. In addition, the inside diameters of the expandable tubular members, 206, 214, and 220, and the slotted tubular members, 210, 212, 216, and 218, after the radial expansion process, are substantially equal. In this manner, additional conventional tools and other conventional equipment may be easily positioned within, and moved through, the expandable and slotted tubular members. In several alternative embodiments, the conventional tools and equipment include conventional valving and other conventional flow control devices for controlling the flow of fluidic materials within and between the expandable tubular members, 206, 214, and 220, and the slotted tubular members, 210, 212, 216, and 218.

Furthermore, in the system 200, the slotted tubular members 210, 212, 216, and 218 are interleaved among the expandable tubular members, 206, 214, and 220. As a result, because only the intermediate non pre-expanded portions, 206*c*, 214*c*, and 220*c*, of the expandable tubular members, 206, 214, and 220, respectively, are radially expanded and plastically deformed, the slotted tubular members, 210, 212, 216, and 218 can be conventional slotted tubular members thereby significantly reducing the cost and complexity of the system 10. Moreover, because only the intermediate non pre-expanded portions, 206*c*, 214*c*, and 220*c*, of the expandable tubular members, 206, 214, and 220, respectively, are radially expanded and plastically deformed, the number and length of the interleaved slotted tubular members, 210, 212, 216, and 218 can be much greater than the number and length of the expandable tubular members. In an exemplary embodiment, the total length of the intermediate non pre-expanded portions, 206*c*, 214*c*, and 220*c*, of the expandable tubular members, 206, 214, and 220, is approximately 200 feet, and the total length of the slotted tubular members, 210, 212, 216, and 218, is approximately 3800 feet. Consequently, in an exemplary embodiment, a system 200 having a total length of approximately 4000 feet is coupled to the wellbore 224 by radially expanding and plastically deforming a total length of only approximately 200 feet.

Furthermore, the sealing members 206*e*, 214*e*, and 220*e*, of the expandable tubular members, 206, 214, and 220, respectively, are used to couple the expandable tubular members and the slotted tubular members, 210, 212, 216, and 218 to the wellbore 224, the radial gap between the slotted tubular members, the expandable tubular members, and the wellbore 224 may be large enough to effectively eliminate the possibility of damage to the expandable tubular members and slotted tubular members during the placement of the system 200 within the wellbore.

In an exemplary embodiment, the pre-expanded ends, 206*a*, 206*d*, 214*a*, 214*d*, 220*a*, and 220*d*, of the expandable tubular members, 206, 214, and 220, respectively, and the slotted tubular members, 210, 212, 216, and 218, have outside diameters and wall thicknesses of 8.375 inches and 0.350 inches, respectively; prior to the radial expansion, the intermediate non pre-expanded portions, 206*c*, 214*c*, and 220*c*, of the expandable tubular members, 206, 214, and 220, respectively, have outside diameters of 7.625 inches; the slotted tubular members, 210, 212, 216, and 218, have inside diameters of 7.675 inches; after the radial expansion, the inside diameters of the intermediate portions, 206*c*, 214*c*, and 220*c*, of the expandable tubular members, 206, 214, and 220, are equal to 7.675 inches; and the wellbore 224 has an inside diameter of 8.755 inches.

In an exemplary embodiment, the pre-expanded ends, 206*a*, 206*d*, 214*a*, 214*d*, 220*a*, and 220*d*, of the expandable tubular members, 206, 214, and 220, respectively, and the slotted tubular members, 210, 212, 216, and 218, have outside diameters and wall thicknesses of 4.500 inches and 0.250 inches, respectively; prior to the radial expansion, the intermediate non pre-expanded portions, 206*c*, 214*c*, and 220*c*, of the expandable tubular members, 206, 214, and 220, respectively, have outside diameters of 4.000 inches; the slotted tubular members, 210, 212, 216, and 218, have inside diameters of 4.000 inches; after the radial expansion, the inside diameters of the intermediate portions, 206*c*, 214*c*, and 220*c*, of the expandable tubular members, 206, 214, and 220, are equal to 4.000 inches; and the wellbore 224 has an inside diameter of 4.892 inches.

In an exemplary embodiment, the system 200 is used to inject or extract fluidic materials such as, for example, oil, gas, and/or water into or from the subterranean formation 226*b*.

Figure 3:
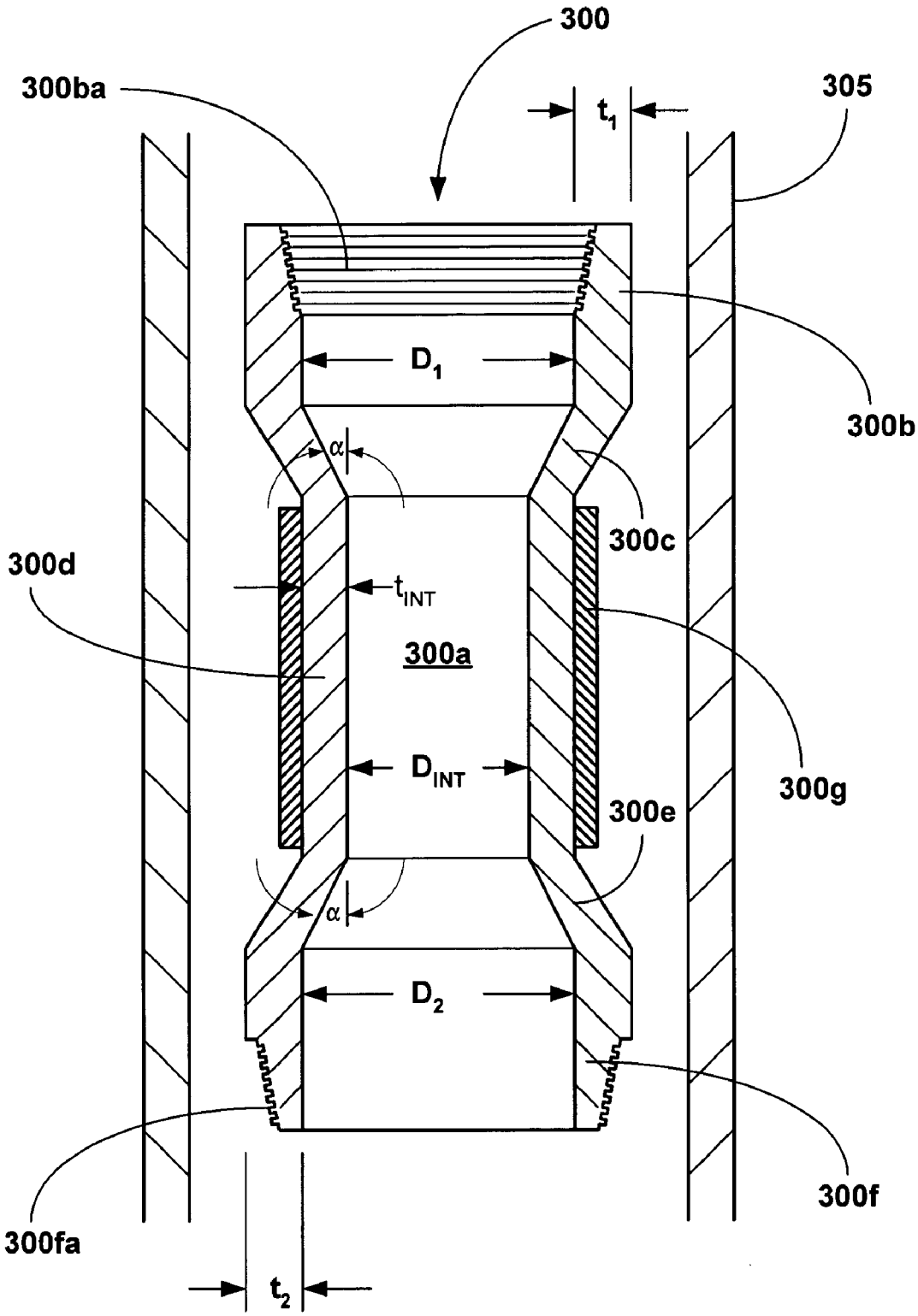
FIG. 3 is a cross sectional illustration of an illustrative embodiment of the expandable tubular members of the system of FIG. 2*a*.
Figure 4:
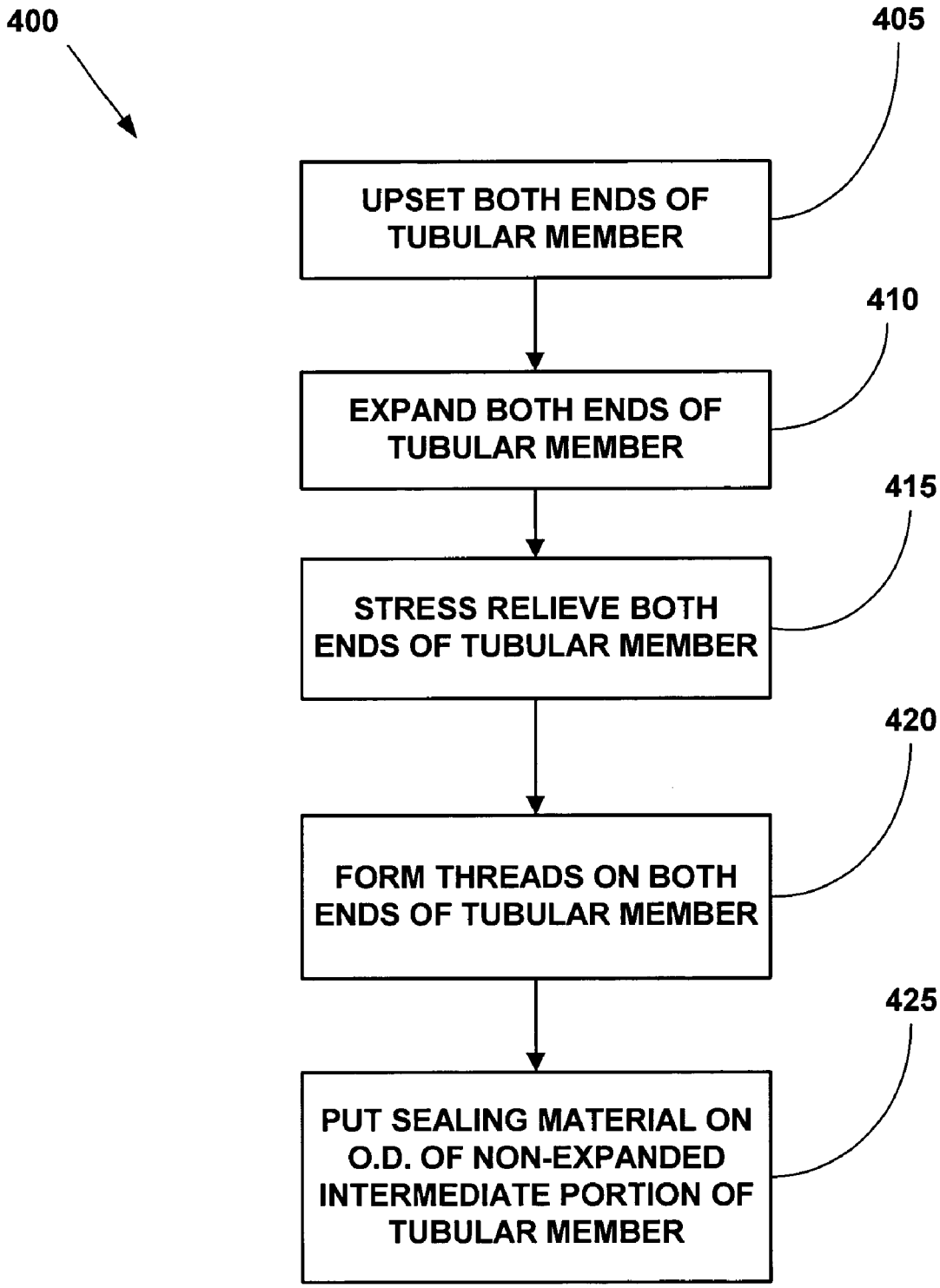
FIG. 4 is a flow chart illustration of an illustrative embodiment of a method for manufacturing the expandable tubular member of FIG. 3.

Referring now to FIG. 3, an exemplary embodiment of an expandable tubular member 300 will now be described. The tubular member 300 defines an interior region 300*a* and includes a first end 300*b* including a first threaded connection 300*ba*, a first tapered portion 300*c*, an intermediate portion 300*d*, a second tapered portion 300*e*, and a second end 300*f* including a second threaded connection 300*fa*. The tubular member 300 further preferably includes an intermediate sealing member 300*g* that is coupled to the exterior surface of the intermediate portion 300*d*.

In an exemplary embodiment, the tubular member 300 has a substantially annular cross section. The tubular member 300 may be fabricated from any number of conventional commercially available materials such as, for example, Oilfield Country Tubular Goods (OCTG), 13 chromium steel tubing/casing, or L83, J55, or P110 API casing.

In an exemplary embodiment, the interior 300*a* of the tubular member 300 has a substantially circular cross section. Furthermore, in an exemplary embodiment, the interior region 300*a* of the tubular member includes a first inside diameter $D_1$, an intermediate inside diameter $D_{INT}$, and a second inside diameter $D_2$. In an exemplary embodiment, the first and second inside diameters, $D_1$ and $D_2$, are substantially equal. In an exemplary embodiment, the first and second inside diameters, $D_1$ and $D_2$, are greater than the intermediate inside diameter $D_{INT}$.

The first end 300*b* of the tubular member 300 is coupled to the intermediate portion 300*d* by the first tapered portion 300*c*, and the second end 300*f* of the tubular member is coupled to the intermediate portion by the second tapered portion 300*e*. In an exemplary embodiment, the outside diameters of the first and second ends, 300*b* and 300*f*, of the tubular member 300 is greater than the outside diameter of the intermediate portion 300*d* of the tubular member. The first and second ends, 300*b* and 300*f*, of the tubular member 300 include wall thicknesses, $t_1$ and $t_2$, respectively. In an exemplary embodiment, the outside diameter of the intermediate portion 300*d* of the tubular member 300 ranges from about 75% to 98% of the outside diameters of the first and second ends, 300*a* and 300*f*. The intermediate portion 300*d* of the tubular member 300 includes a wall thickness $t_{INT}$.

In an exemplary embodiment, the wall thicknesses $t_1$ and $t_2$ are substantially equal in order to provide substantially equal burst strength for the first and second ends, 300*a* and 300*f*, of the tubular member 300. In an exemplary embodiment, the wall thicknesses, $t_1$ and $t_2$, are both greater than the wall thickness $t_{INT}$ in order to optimally match the burst strength of the first and second ends, 300*a* and 300*f*, of the tubular member 300 with the intermediate portion 300*d* of the tubular member 300.

In an exemplary embodiment, the first and second tapered portions, 300*c* and 300*e*, are inclined at an angle, α, relative to the longitudinal direction ranging from about 0 to 30 degrees in order to optimally facilitate the radial expansion of the tubular member 300. In an exemplary embodiment, the first and second tapered portions, 300*c* and 300*e*, provide a smooth transition between the first and second ends, 300*a* and 300*f*, and the intermediate portion 300*d*, of the tubular member 300 in order to minimize stress concentrations.

The intermediate sealing member 300*g* is coupled to the outer surface of the intermediate portion 300*d* of the tubular member 300. In an exemplary embodiment, the intermediate sealing member 300*g* seals the interface between the intermediate portion 300*d* of the tubular member 300 and the interior surface of a wellbore casing 305, or other preexisting structure, after the radial expansion and plastic deformation of the intermediate portion 300*d* of the tubular member 300. In an exemplary embodiment, the intermediate sealing member 300*g* has a substantially annular cross section. In an exemplary embodiment, the outside diameter of the intermediate sealing member 300*g* is selected to be less than the outside diameters of the first and second ends, 300*a* and 300*f*, of the tubular member 300 in order to optimally protect the intermediate sealing member 300*g* during placement of the tubular member 300 within the wellbore casings 305. The intermediate sealing member 300*g* may be fabricated from any number of conventional commercially available materials such as, for example, thermoset or thermoplastic polymers. In an exemplary embodiment, the intermediate sealing member 300*g* is fabricated from thermoset polymers in order to optimally seal the radially expanded intermediate portion 300*d* of the tubular member 300 with the wellbore casing 305. In several alternative embodiments, the sealing member 300*g* includes one or more rigid anchors for engaging the wellbore casing 305 to thereby anchor the radially expanded and plastically deformed intermediate portion 300*d* of the tubular member 300 to the wellbore casing.

In an exemplary embodiment, the intermediate portion 300*d* of the tubular member 300 includes one or more radial passages, slots, or perforations that are covered by the sealing member 300*g*. In an exemplary embodiment, the intermediate portion 300*d* of the tubular member 300 includes one or more radial passages, slots, or perforations that are not covered by the sealing member 300*g*.

Referring to FIGS. 4, and 5*a* to 5*d*, in an exemplary embodiment, the tubular member 300 is formed by a process 400 that includes the steps of: (1) upsetting both ends of a tubular member in step 405; (2) expanding both upset ends of the tubular member in step 410; (3) stress relieving both expanded upset ends of the tubular member in step 415; (4) forming threaded connections in both expanded upset ends of the tubular member in step 420; and (5) putting a sealing material on the outside diameter of the non-expanded intermediate portion of the tubular member in step 425.

Figure 5A:
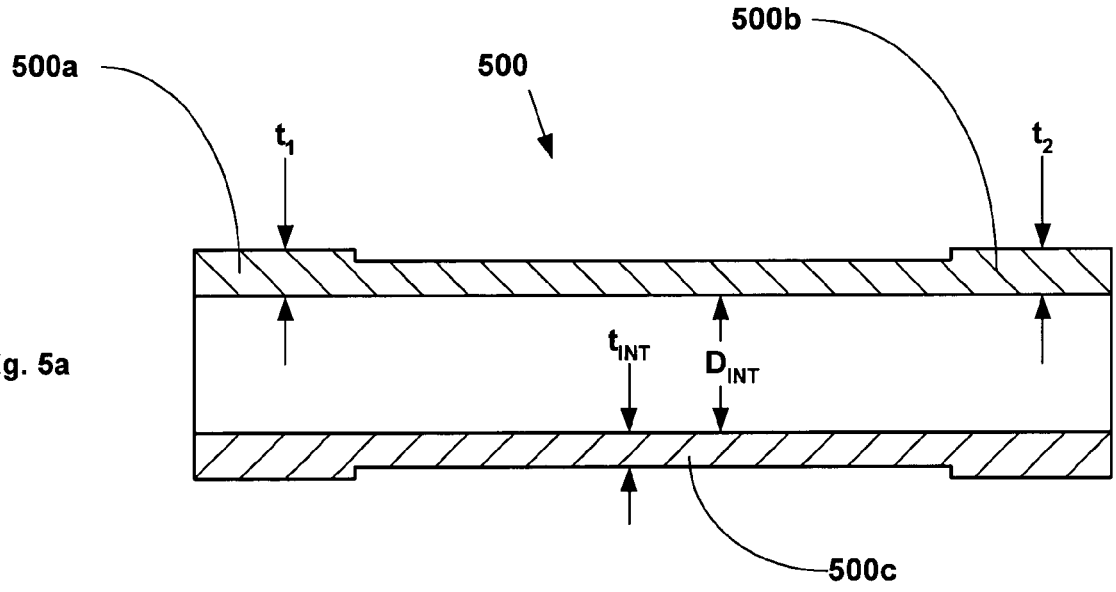
FIG. 5*a* is a cross sectional illustration of an illustrative embodiment of the upsetting of the ends of a tubular member.

As illustrated in FIG. 5*a*, in step 405, both ends, 500*a* and 500*b*, of a tubular member 500 are upset using conventional upsetting methods. The upset ends, 500*a* and 500*b*, of the tubular member 500 include the wall thicknesses $t_1$ and $t_2$. The intermediate portion 500*c* of the tubular member 500 includes the wall thickness $t_{INT}$ and the interior diameter $D_{INT}$. In an exemplary embodiment, the wall thicknesses $t_1$ and $t_2$ are substantially equal in order to provide burst strength that is substantially equal along the entire length of the tubular member 500. In an exemplary embodiment, the wall thicknesses $t_1$ and $t_2$ are both greater than the wall thickness $t_{INT}$ in order to provide burst strength that is substantially equal along the entire length of the tubular member 500, and also to optimally facilitate the formation of threaded connections in the first and second ends, 500*a* and 500*b*.

Figure 5B:
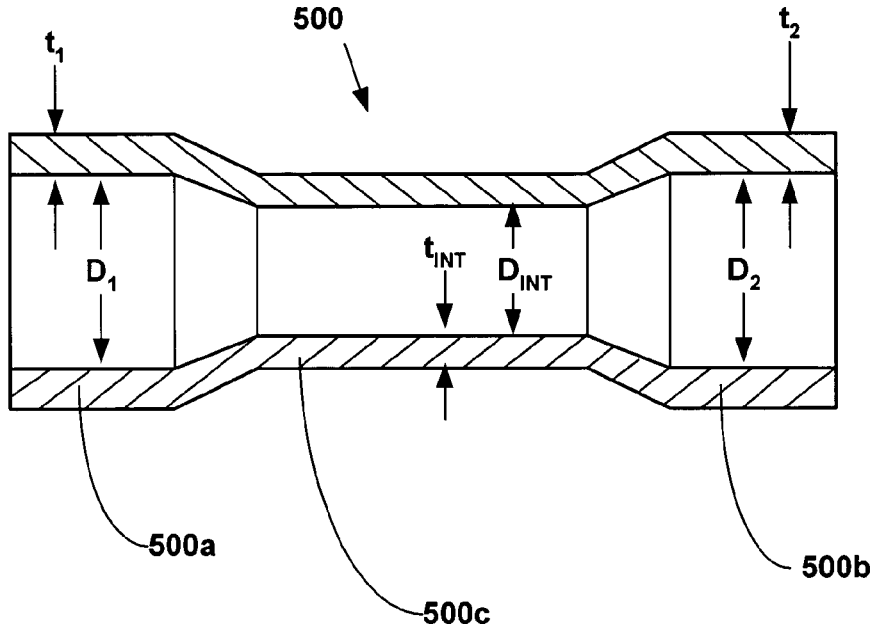
FIG. 5*b* is a cross sectional illustration of the expandable tubular member of FIG. 5*a* after radially expanding and plastically deforming the ends of the expandable tubular member.

As illustrated in FIG. 5*b*, in steps 410 and 415, both ends, 500*a* and 500*b*, of the tubular member 500 are radially expanded using conventional radial expansion methods, and then both ends, 500*a* and 500*b*, of the tubular member are stress relieved. The radially expanded ends, 500*a* and 500*b*, of the tubular member 500 include the interior diameters $D_1$ and $D_2$. In an exemplary embodiment, the interior diameters $D_1$ and $D_2$ are substantially equal in order to provide a burst strength that is substantially equal. In an exemplary embodiment, the ratio of the interior diameters $D_1$ and $D_2$ to the interior diameter $D_{INT}$ ranges from about 100% to 120% in order to facilitate the subsequent radial expansion of the tubular member 500.

In a preferred embodiment, the relationship between the wall thicknesses $t_1$, $t_2$, and $t_{INT}$ of the tubular member 500; the inside diameters $D_1$, $D_2$ and $D_{INT}$ of the tubular member 500; the inside diameter $D_{wellbore}$ of the wellbore casing, or other structure, that the tubular member 500 will be inserted into; and the outside diameter $D_{cone}$ of the expansion cone that will be used to radially expand the tubular member 500 within the wellbore casing is given by the following expression:

$$Dwellbore - 2 * t_1 \geq D_1 \geq \frac{1}{t_1}[(t_1 - t_{INT}) * D_{cone} + t_{INT} * D_{INT}] \quad (1)$$

where $t_1 = t_2$; and $D_1 = D_2$.

By satisfying the relationship given in equation (1), the expansion forces placed upon the tubular member 500 during the subsequent radial expansion process are substantially equalized. More generally, the relationship given in equation (1) may be used to calculate the optimal geometry for the tubular member 500 for subsequent radial expansion and plastic deformation of the tubular member 500 for fabricating and/or repairing a wellbore casing, a pipeline, or a structural support.

Figure 5C:
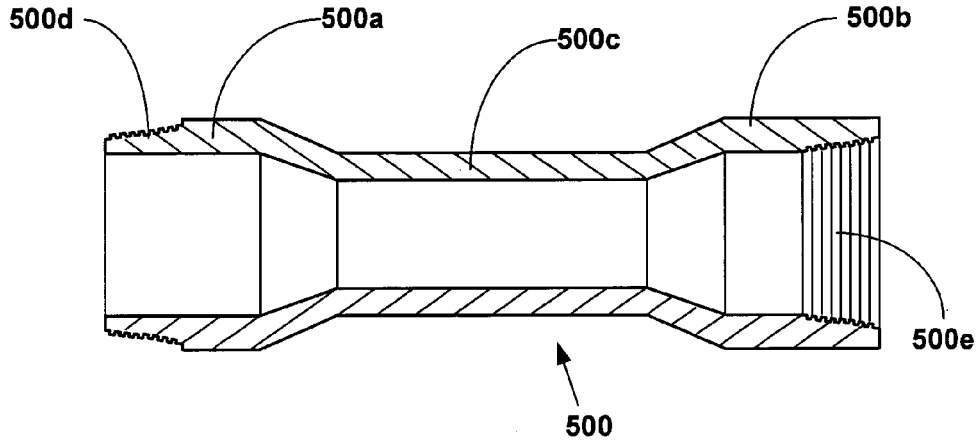
FIG. 5*c* is a cross sectional illustration of the expandable tubular member of FIG. 5*b* after forming threaded connections on the ends of the expandable tubular member.

As illustrated in FIG. 5*c*, in step 420, conventional threaded connections, 500*d* and 500*e*, are formed in both expanded ends, 500*a* and 500*b*, of the tubular member 500. In an exemplary embodiment, the threaded connections, 500*d* and 500*e*, are provided using conventional processes for forming pin and box type threaded connections available from Atlas-Bradford.

Figure 5D:
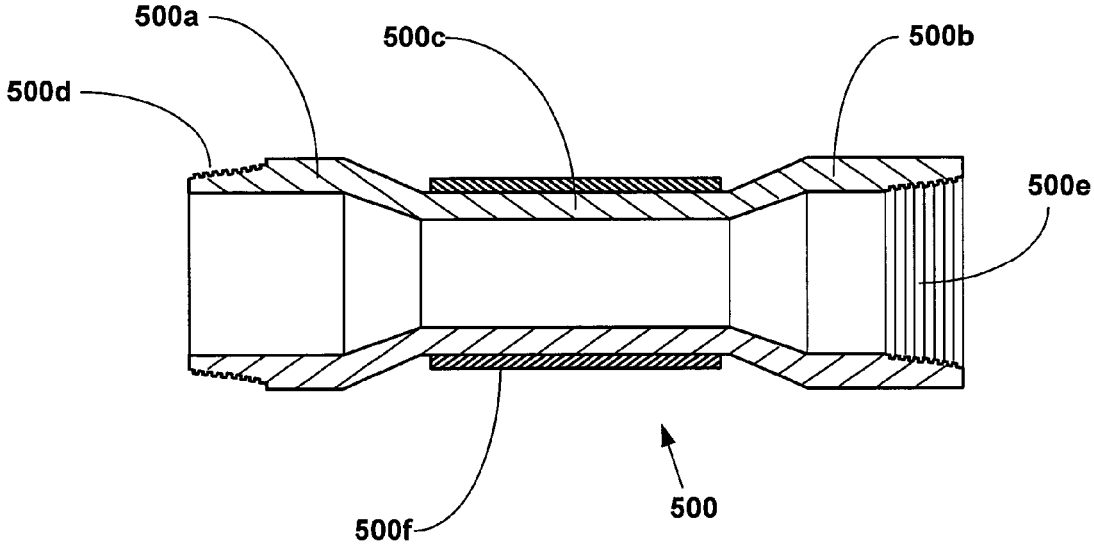
FIG. 5*d* is a cross sectional illustration of the expandable tubular member of FIG. 5*c* after coupling sealing members to the exterior surface of the intermediate unexpanded portion of the expandable tubular member.

As illustrated in FIG. 5*d*, in step 425, a sealing member 500*f* is then applied onto the outside diameter of the non-expanded intermediate portion 500*c* of the tubular member 500. The sealing member 500*f* may be applied to the outside diameter of the non-expanded intermediate portion 500*c* of the tubular member 500 using any number of conventional commercially available methods. In a preferred embodiment, the sealing member 500*f* is applied to the outside diameter of the intermediate portion 500*c* of the tubular member 500 using commercially available chemical and temperature resistant adhesive bonding.

In an exemplary embodiment, the expandable tubular members, 206, 214, and 220, of the system 200 are substantially identical to, and/or incorporate one or more of the teachings of, the tubular members 300 and 500.

Figure 6:
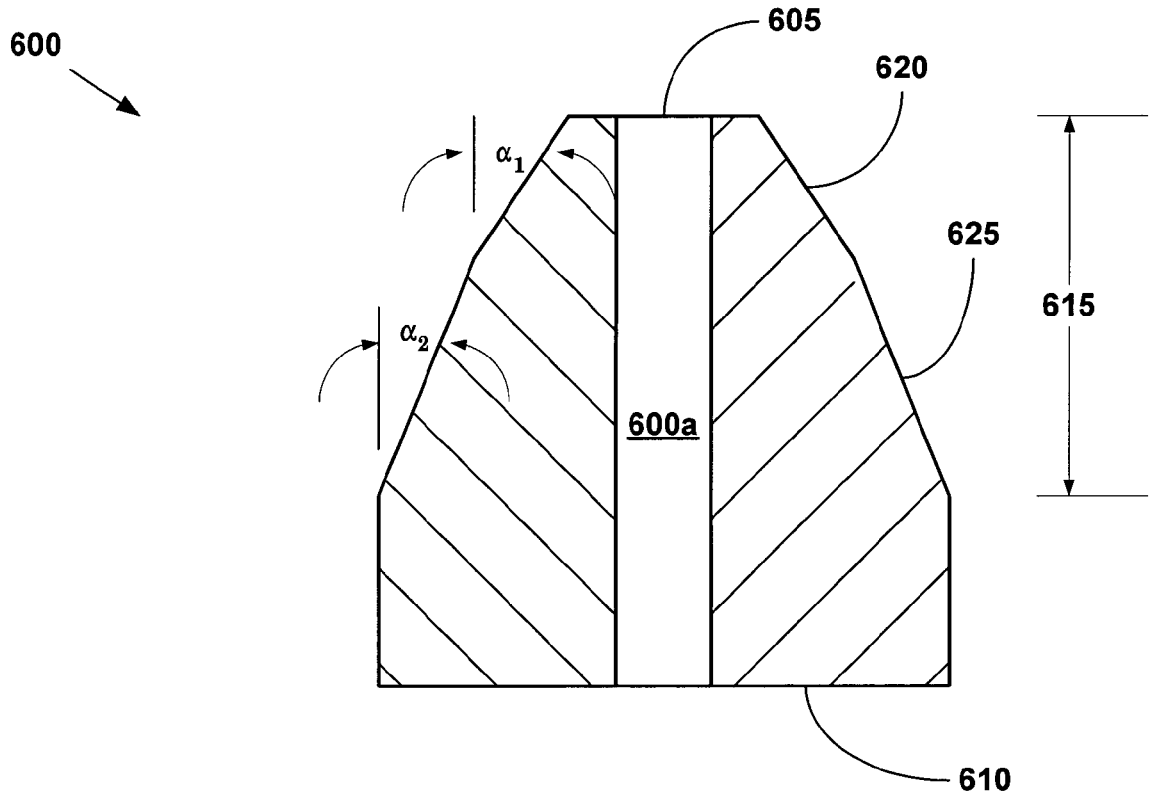
FIG. 6 is a cross-sectional illustration of an exemplary embodiment of a tubular expansion cone.

Referring to FIG. 6, an exemplary embodiment of tubular expansion cone 600 for radially expanding the tubular members 206, 214, 220, 300 and 500 will now be described. The expansion cone 600 defines a passage 600*a* and includes a front end 605, a rear end 610, and a radial expansion section 615.

In an exemplary embodiment, the radial expansion section 615 includes a first conical outer surface 620 and a second conical outer surface 625. The first conical outer surface 620 includes an angle of attack $\alpha_1$ and the second conical outer surface 625 includes an angle of attack $\alpha_2$. In an exemplary embodiment, the angle of attack $\alpha_1$ is greater than the angle of attack $\alpha_2$. In this manner, the first conical outer surface 620 optimally radially expands the intermediate portions, 206*c*, 214*c*, 220*c*, 300*d*, and 500*c*, of the tubular members, 206, 214, 220, 300, and 500, and the second conical outer surface 525 optimally radially expands the pre-expanded first and second ends, 206*a* and 206*d*, 214*a* and 214*d*, 220*a* and 220*d*, 300*b* and 300*f*, and 500*a* and 500*b*, of the tubular members, 206, 214, 220, 300 and 500. In an exemplary embodiment, the first conical outer surface 620 includes an angle of attack $\alpha_1$ ranging from about 8 to 20 degrees, and the second conical outer surface 625 includes an angle of attack $\alpha_2$ ranging from about 4 to 15 degrees in order to optimally radially expand and plastically deform the tubular members, 206, 214, 220, 300 and 500. More generally, the expansion cone 600 may include 3 or more adjacent conical outer surfaces having angles of attack that decrease from the front end 605 of the expansion cone 600 to the rear end 610 of the expansion cone 600.

Figure 7:
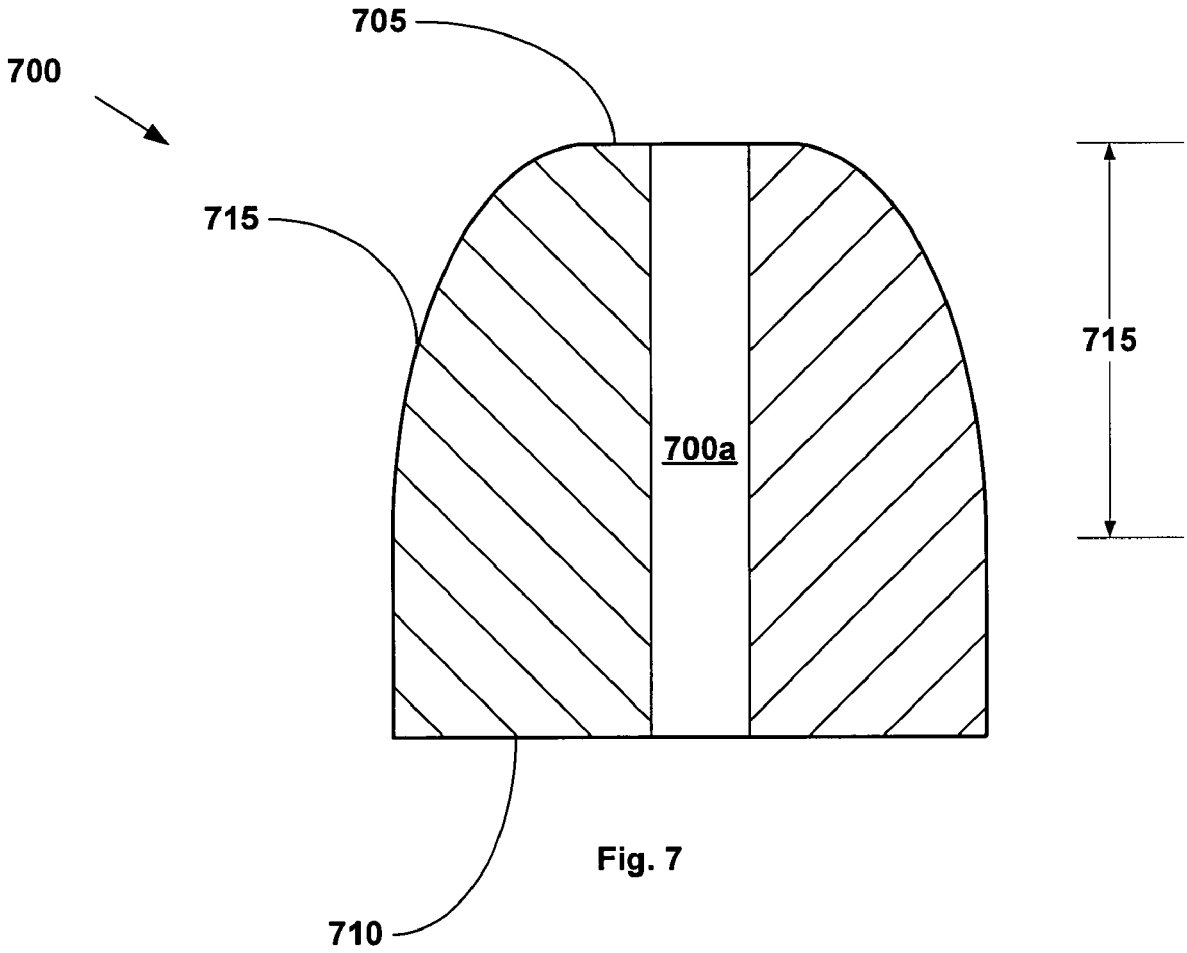
FIG. 7 is a cross-sectional illustration of an exemplary embodiment of a tubular expansion cone.

Referring to FIG. 7, another exemplary embodiment of a tubular expansion cone 700 defines a passage 700*a* and includes a front end 705, a rear end 710, and a radial expansion section 715. In an exemplary embodiment, the radial expansion section 715 includes an outer surface having a substantially parabolic outer profile thereby providing a paraboloid shape. In this manner, the outer surface of the radial expansion section 715 provides an angle of attack that constantly decreases from a maximum at the front end 705 of the expansion cone 700 to a minimum at the rear end 710 of the expansion cone. The parabolic outer profile of the outer surface of the radial expansion section 715 may be formed using a plurality of adjacent discrete conical sections and/or using a continuous curved surface. In this manner, the region of the outer surface of the radial expansion section 715 adjacent to the front end 705 of the expansion cone 700 may optimally radially expand the intermediate portions, 206*c*, 214*c*, 220*c*, 300*d*, and 500*c*, of the tubular members, 206, 214, 220, 300, and 500, while the region of the outer surface of the radial expansion section 715 adjacent to the rear end 710 of the expansion cone 700 may optimally radially expand the pre-expanded first and second ends, 206*a* and 206*d*, 214*a* and 214*d*, 220*a* and 220*d*, 300*b* and 300*f*, and 500*a* and 500*b*, of the tubular members, 206, 214, 220, 300 and 500. In an exemplary embodiment, the parabolic profile of the outer surface of the radial expansion section 715 is selected to provide an angle of attack that ranges from about 8 to 20 degrees in the vicinity of the front end 705 of the expansion cone 700 and an angle of attack in the vicinity of the rear end 710 of the expansion cone 700 from about 4 to 15 degrees.

In an exemplary embodiment, the tubular expansion cone 204 of the system 200 is substantially identical to the expansion cones 600 or 700, and/or incorporates one or more of the teachings of the expansion cones 600 and/or 700.

Figure 8A:
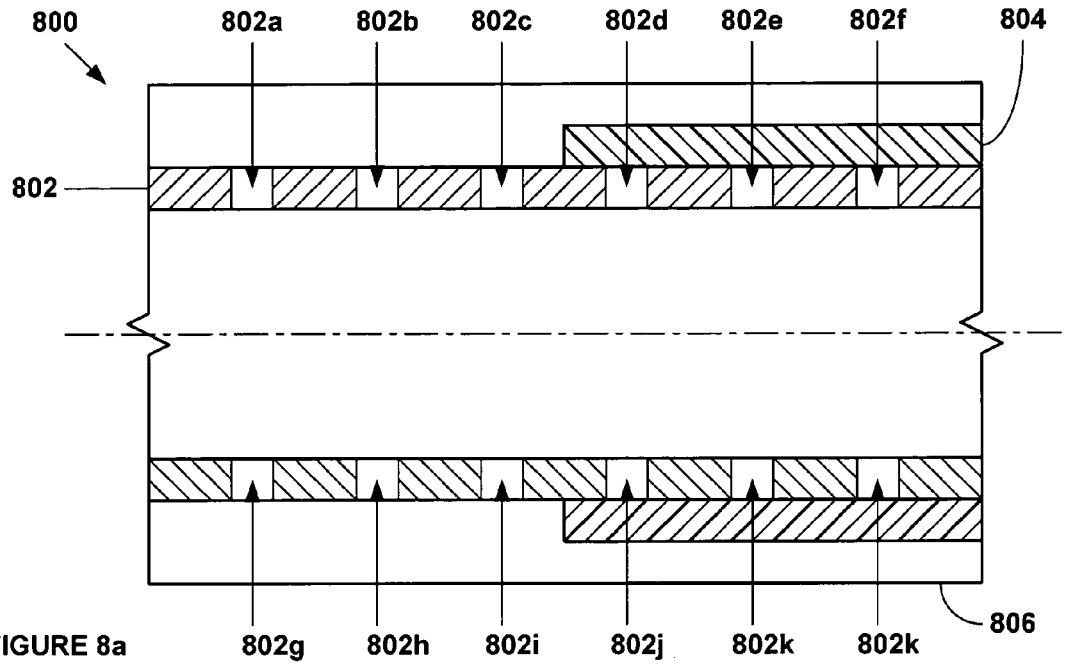
FIG. 8*a* is a fragmentary cross-sectional illustration of an exemplary embodiment of a perforated tubular member that includes an elastic tubular sealing member coupled to the perforated tubular member.
Figure 8B:
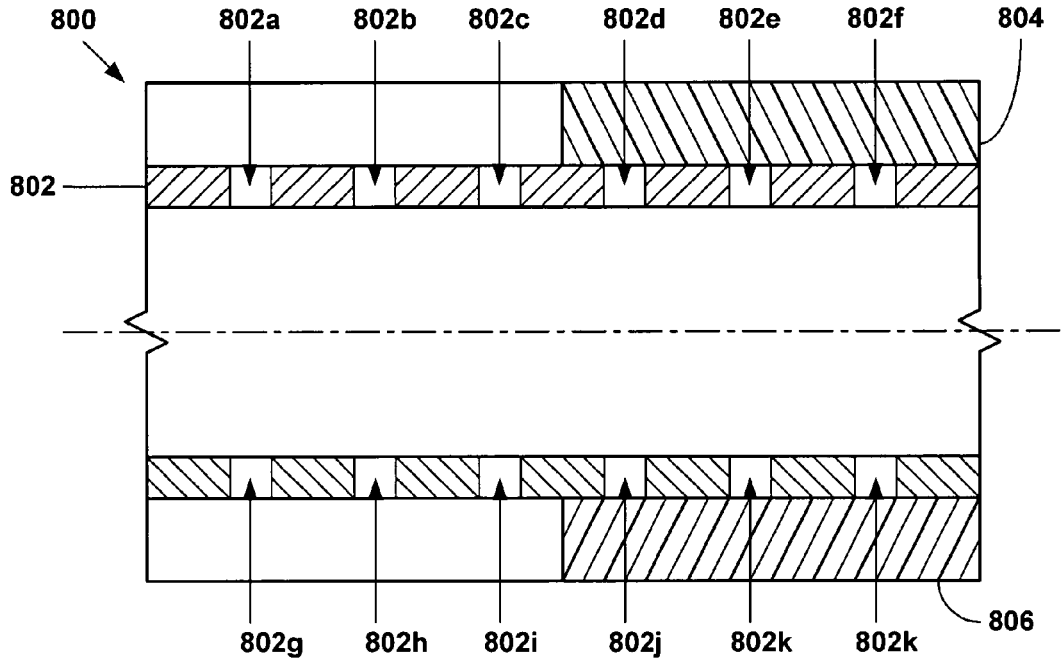
FIG. 8*b* is a fragmentary cross-sectional illustration of the perforated tubular member of FIG. 8*a* after the swelling of the sealing member.

In several alternative embodiments, the teachings of the apparatus 130, the system 200, the expandable tubular member 300, the method 400, and/or the expandable tubular member 500 are at least partially combined. Referring to FIGS. 8*a* and 8*b*, in an exemplary embodiment, one or more of the slotted tubular members 145, 210, 212, 216, 218, and 300*d* include slotted tubular assemblies 800 that include a slotted tubular 802 that defines one or more radial passages 802*a*–802*l* and an elastic tubular sealing member 804 that is coupled to the slotted tubular 802. In an exemplary embodiment, the elastic tubular sealing member 804 is coupled to the exterior surface of the slotted tubular 802 and covers one or more of the radial passages 802*a*–802*l*. In this manner, the flow of fluidic materials through the covered radial passages of the slotted tubular 802 may be prevented by the elastic tubular sealing member 804 prior to and/or after the radial expansion and plastic deformation of the slotted tubular 802 within a wellbore 806. Alternatively, the elastic tubular sealing member 804 may be coupled to the interior surface of the slotted tubular member 802.

In an exemplary embodiment, the elastic tubular sealing member 804 comprises a swellable elastomeric material that swells in the presence of a fluidic materials such as, for example, water. In this manner, as illustrated in FIG. 8*b*, the elastic tubular sealing member 804, either before or after radial expansion of the slotted tubular 802, will swell and expand radially into sealing contact with the interior surface of the wellbore 806. In this manner, the annulus between the slotted tubular 802 and the wellbore 806 may be fluidically sealed off. In several exemplary embodiments, the elastic tubular sealing member 804 is fabricated from conventional commercially available swellable elastomeric materials such as, for example, the swellable elastomeric materials commercially available from Ruma Rubber B. V. in the Netherlands and/or the Aquaprene™ swellable elastomeric products available from Sanyo Chemical Industries, Ltd. in Japan. In several exemplary embodiments, the composition of the swellable elastomeric material is provided substantially as disclosed in U.S. Pat. No. 4,590,227, the disclosure of which is incorporated herein by reference.

In several alternative embodiments, the slotted tubular members 145, 210, 212, 216, 218, 300*d*, and 802 include radial passages that permit fluidic materials to pass therethrough of any number of geometric shapes including, for example, circular holes and/or slotted holes and/or serpentine openings and/or irregularly shaped holes.

In several alternative embodiments, one or more of the sealing members 140, 206*e*, 214*e*, 220*e*, and 300*g* are fabricated from swellable elastomeric materials in order to provide sealing engagement with the wellbores 105 and/or 224.

An apparatus has been described that includes a zonal isolation assembly including one or more solid tubular members, each solid tubular member including one or more external seals, and one or more perforated tubular members coupled to the solid tubular members, and a shoe coupled to the zonal isolation assembly. In an exemplary embodiment, the zonal isolation assembly further includes one or more intermediate solid tubular members coupled to and interleaved among the perforated tubular members, each intermediate solid tubular member including one or more external seals. In an exemplary embodiment, the zonal isolation assembly further includes one or more valve members for controlling the flow of fluidic materials between the tubular members. In an exemplary embodiment, one or more of the intermediate solid tubular members include one or more valve members.

An apparatus has also been described that includes a zonal isolation assembly that includes one or more primary solid tubulars, each primary solid tubular including one or more external annular seals, n perforated tubulars coupled to the primary solid tubulars, and n−1 intermediate solid tubulars coupled to and interleaved among the perforated tubulars, each intermediate solid tubular including one or more external annular seals, and a shoe coupled to the zonal isolation assembly.

A method of isolating a first subterranean zone from a second subterranean zone in a wellbore has also been described that includes positioning one or more primary solid tubulars within the wellbore, the primary solid tubulars traversing the first subterranean zone, positioning one or more perforated tubulars within the wellbore, the perforated tubulars traversing the second subterranean zone, fluidicly coupling the perforated tubulars and the primary solid tubulars, and preventing the passage of fluids from the first subterranean zone to the second subterranean zone within the wellbore external to the solid and perforated tubulars.

A method of extracting materials from a producing subterranean zone in a wellbore, at least a portion of the wellbore including a casing, has also been described that includes positioning one or more primary solid tubulars within the wellbore, fluidicly coupling the primary solid tubulars with the casing, positioning one or more perforated tubulars within the wellbore, the perforated tubulars traversing the producing subterranean zone, fluidicly coupling the perforated tubulars with the primary solid tubulars, fluidicly isolating the producing subterranean zone from at least one other subterranean zone within the wellbore, and fluidicly coupling at least one of the perforated tubulars with the producing subterranean zone. In an exemplary embodiment, the method further includes controllably fluidicly decoupling at least one of the perforated tubulars from at least one other of the perforated tubulars.

An apparatus has also been described that includes a subterranean formation including a wellbore, a zonal isolation assembly at least partially positioned within the wellbore that includes one or more solid tubular members, each solid tubular member including one or more external seals, and one or more perforated tubular members coupled to the solid tubular members, and a shoe positioned within the wellbore coupled to the zonal isolation assembly, wherein at least one of the solid tubular members and the perforated tubular members are formed by a radial expansion process performed within the wellbore. In an exemplary embodiment, the zonal isolation assembly further includes one or more intermediate solid tubular members coupled to and interleaved among the perforated tubular members, each intermediate solid tubular member including one or more external seals, wherein at least one of the solid tubular members, the perforated tubular members, and the intermediate solid tubular members are formed by a radial expansion process performed within the wellbore. In an exemplary embodiment, the zonal isolation assembly further comprises one or more valve members for controlling the flow of fluids between the solid tubular members and the perforated tubular members. In an exemplary embodiment, one or more of the intermediate solid tubular members include one or more valve members for controlling the flow of fluids between the solid tubular members and the perforated tubular members.

An apparatus has also been described that includes a subterranean formation including a wellbore, a zonal isolation assembly positioned within the wellbore that includes one or more primary solid tubulars, each primary solid tubular including one or more external annular seals, n perforated tubulars positioned coupled to the primary solid tubulars, and n−1 intermediate solid tubulars coupled to and interleaved among the perforated tubulars, each intermediate solid tubular including one or more external annular seals, and a shoe coupled to the zonal isolation assembly, wherein at least one of the primary solid tubulars, the perforated tubulars, and the intermediate solid tubulars are formed by a radial expansion process performed within the wellbore.

A method of isolating a first subterranean zone from a second subterranean zone in a wellbore has also been described that includes positioning one or more primary solid tubulars within the wellbore, the primary solid tubulars traversing the first subterranean zone, positioning one or more perforated tubulars within the wellbore, the perforated tubulars traversing the second subterranean zone, radially expanding at least one of the primary solid tubulars and perforated tubulars within the wellbore, fluidicly coupling the perforated tubulars and the primary solid tubulars, and preventing the passage of fluids from the first subterranean zone to the second subterranean zone within the wellbore external to the primary solid tubulars and perforated tubulars.

A method of extracting materials from a producing subterranean zone in a wellbore, at least a portion of the wellbore including a casing, has also been described that includes positioning one or more primary solid tubulars within the wellbore, positioning one or more perforated tubulars within the wellbore, the perforated tubulars traversing the producing subterranean zone, radially expanding at least one of the primary solid tubulars and the perforated tubulars within the wellbore, fluidicly coupling the primary solid tubulars with the casing, fluidicly coupling the perforated tubulars with the primary solid tubulars, fluidicly isolating the producing subterranean zone from at least one other subterranean zone within the wellbore, and fluidicly coupling at least one of the perforated tubulars with the producing subterranean zone. In an exemplary embodiment, the method further includes controllably fluidicly decoupling at least one of the perforated tubulars from at least one other of the perforated tubulars.

An apparatus has also been described that includes a subterranean formation including a wellbore, a zonal isolation assembly positioned within the wellbore that includes n solid tubular members positioned within the wellbore, each solid tubular member including one or more external seals, and n−1 perforated tubular members positioned within the wellbore coupled to and interleaved among the solid tubular members, and a shoe positioned within the wellbore coupled to the zonal isolation assembly. In an exemplary embodiment, the zonal isolation assembly further comprises one or more valve members for controlling the flow of fluids between the solid tubular members and the perforated tubular members. In an exemplary embodiment, one or more of the solid tubular members include one or more valve members for controlling the flow of fluids between the solid tubular members and the perforated tubular members.

A system for isolating a first subterranean zone from a second subterranean zone in a wellbore has also been described that includes means for positioning one or more primary solid tubulars within the wellbore, the primary solid tubulars traversing the first subterranean zone, means for positioning one or more perforated tubulars within the wellbore, the perforated tubulars traversing the second subterranean zone, means for fluidicly coupling the perforated tubulars and the primary solid tubulars, and means for preventing the passage of fluids from the first subterranean zone to the second subterranean zone within the wellbore external to the primary solid tubulars and the perforated tubulars.

A system for extracting materials from a producing subterranean zone in a wellbore, at least a portion of the wellbore including a casing, has also been described that includes means for positioning one or more primary solid tubulars within the wellbore, means for fluidicly coupling the primary solid tubulars with the casing, means for positioning one or more perforated tubulars within the wellbore, the perforated tubulars traversing the producing subterranean zone, means for fluidicly coupling the perforated tubulars with the primary solid tubulars, means for fluidicly isolating the producing subterranean zone from at least one other subterranean zone within the wellbore, and means for fluidicly coupling at least one of the perforated tubulars with the producing subterranean zone. In an exemplary embodiment, the system further includes means for controllably fluidicly decoupling at least one of the perforated tubulars from at least one other of the perforated tubulars.

A system for isolating a first subterranean zone from a second subterranean zone in a wellbore has also been described that includes means for positioning one or more primary solid tubulars within the wellbore, the primary solid tubulars traversing the first subterranean zone, means for positioning one or more perforated tubulars within the wellbore, the perforated tubulars traversing the second subterranean zone, means for radially expanding at least one of the primary solid tubulars and perforated tubulars within the wellbore, means for fluidicly coupling the perforated tubulars and the primary solid tubulars, and means for preventing the passage of fluids from the first subterranean zone to the second subterranean zone within the wellbore external to the primary solid tubulars and perforated tubulars.

A system for extracting materials from a producing subterranean zone in a wellbore, at least a portion of the wellbore including a casing, has also been described that includes means for positioning one or more primary solid tubulars within the wellbore, means for positioning one or more perforated tubulars within the wellbore, the perforated tubulars traversing the producing subterranean zone, means for radially expanding at least one of the primary solid tubulars and the perforated tubulars within the wellbore, means for fluidicly coupling the primary solid tubulars with the casing, means for fluidicly coupling the perforated tubulars with the solid tubulars, means for fluidicly isolating the producing subterranean zone from at least one other subterranean zone within the wellbore, and means for fluidicly coupling at least one of the perforated tubulars with the producing subterranean zone. In an exemplary embodiment, the system further includes means for controllably fluidicly decoupling at least one of the perforated tubulars from at least one other of the perforated tubulars.

A system for isolating subterranean zones traversed by a wellbore has also been described that includes a tubular support member defining a first passage, a tubular expansion cone defining a second passage fluidicly coupled to the first passage coupled to an end of the tubular support member and comprising a tapered end, a tubular liner coupled to and supported by the tapered end of the tubular expansion cone, and a shoe defining a valveable passage coupled to an end of the tubular liner, wherein the tubular liner includes one or more expandable tubular members that each include a tubular body comprising an intermediate portion and first and second expanded end portions coupled to opposing ends of the intermediate portion, and a sealing member coupled to the exterior surface of the intermediate portion, and one or more slotted tubular members coupled to the expandable tubular members, wherein the inside diameters of the other tubular members are greater than or equal to the outside diameter of the tubular expansion cone. In an exemplary embodiment, the wall thicknesses of the first and second expanded end portions are greater than the wall thickness of the intermediate portion. In an exemplary embodiment, each expandable tubular member further includes a first tubular transitionary member coupled between the first expanded end portion and the intermediate portion, and a second tubular transitionary member coupled between the second expanded end portion and the intermediate portion, wherein the angles of inclination of the first and second tubular transitionary members relative to the intermediate portion ranges from about 0 to 30 degrees. In an exemplary embodiment, the outside diameter of the intermediate portion ranges from about 75 percent to about 98 percent of the outside diameters of the first and second expanded end portions. In an exemplary embodiment, the burst strength of the first and second expanded end portions is substantially equal to the burst strength of the intermediate tubular section. In an exemplary embodiment, the ratio of the inside diameters of the first and second expanded end portions to the interior diameter of the intermediate portion ranges from about 100 to 120 percent. In an exemplary embodiment, the relationship between the wall thicknesses $t_1$, $t_2$, and $t_{INT}$ of the first expanded end portion, the second expanded end portion, and the intermediate portion, respectively, of the expandable tubular members, the inside diameters $D_1$, $D_2$ and $D_{INT}$ of the first expanded end portion, the second expanded end portion, and the intermediate portion, respectively, of the expandable tubular members, and the inside diameter $D_{wellbore}$ of the wellbore casing that the expandable tubular member will be inserted into, and the outside diameter $D_{cone}$ of the expansion cone that will be used to radially expand the expandable tubular member within the wellbore is given by the following expression:

$$Dwellbore - 2 * t_1 \geq D_1 \geq \frac{1}{t_1}[(t_1 - t_{INT}) * D_{cone} + t_{INT} * D_{INT}];$$

wherein $t_1=t_2$; and wherein $D_1=D_2$.

In an exemplary embodiment, the tapered end of the tubular expansion cone includes a plurality of adjacent discrete tapered sections. In an exemplary embodiment, the angle of attack of the adjacent discrete tapered sections increases in a continuous manner from one end of the tubular expansion cone to the opposite end of the tubular expansion cone. In an exemplary embodiment, the tapered end of the tubular expansion cone includes an paraboloid body. In an exemplary embodiment, the angle of attack of the outer surface of the paraboloid body increases in a continuous manner from one end of the paraboloid body to the opposite end of the paraboloid body. In an exemplary embodiment, the tubular liner comprises a plurality of expandable tubular members; and wherein the other tubular members are interleaved among the expandable tubular members.

A method of isolating subterranean zones traversed by a wellbore has also been described that includes positioning a tubular liner within the wellbore, and radially expanding one or more discrete portions of the tubular liner into engagement with the wellbore. In an exemplary embodiment, a plurality of discrete portions of the tubular liner are radially expanded into engagement with the wellbore. In an exemplary embodiment, the remaining portions of the tubular liner are not radially expanded. In an exemplary embodiment, one of the discrete portions of the tubular liner is radially expanded by injecting a fluidic material into the tubular liner; and wherein the remaining ones of the discrete portions of the tubular liner are radially expanded by pulling an expansion cone through the remaining ones of the discrete portions of the tubular liner. In an exemplary embodiment, the tubular liner comprises a plurality of tubular members; and wherein one or more of the tubular members are radially expanded into engagement with the wellbore and one or more of the tubular members are not radially expanded into engagement with the wellbore. In an exemplary embodiment, the tubular members that are radially expanded into engagement with the wellbore comprise a portion that is radially expanded into engagement with the wellbore and a portion that is not radially expanded into engagement with the wellbore. In an exemplary embodiment, the tubular liner includes one or more expandable tubular members that each include a tubular body comprising an intermediate portion and first and second expanded end portions coupled to opposing ends of the intermediate portion, and a sealing member coupled to the exterior surface of the intermediate portion, and one or more slotted tubular members coupled to the expandable tubular members, wherein the inside diameters of the slotted tubular members are greater than or equal to the maximum inside diameters of the expandable tubular members. In an exemplary embodiment, the tubular liner includes a plurality of expandable tubular members; and wherein the slotted tubular members are interleaved among the expandable tubular members.

A system for isolating subterranean zones traversed by a wellbore has also been described that includes means for positioning a tubular liner within the wellbore, and means for radially expanding one or more discrete portions of the tubular liner into engagement with the wellbore. In an exemplary embodiment, a plurality of discrete portions of the tubular liner are radially expanded into engagement with the wellbore. In an exemplary embodiment, the remaining portions of the tubular liner are not radially expanded. In an exemplary embodiment, one discrete portion of the tubular liner is radially expanded by injecting a fluidic material into the tubular liner; and wherein the other discrete portions of the tubular liner are radially expanded by pulling an expansion cone through the other discrete portions of the tubular liner. In an exemplary embodiment, the tubular liner includes a plurality of tubular members; and wherein one or more of the tubular members are radially expanded into engagement with the wellbore and one or more of the tubular members are not radially expanded into engagement with the wellbore. In an exemplary embodiment, the tubular members that are radially expanded into engagement with the wellbore include a portion that is radially expanded into engagement with the wellbore and a portion that is not radially expanded into engagement with the wellbore.

An apparatus for isolating subterranean zones has also been described that includes a subterranean formation defining a borehole, and a tubular liner positioned in and coupled to the borehole at one or more discrete locations. In an exemplary embodiment, the tubular liner is coupled to the borehole at a plurality of discrete locations. In an exemplary embodiment, the tubular liner is coupled to the borehole by a process that includes positioning the tubular liner within the borehole, and radially expanding one or more discrete portions of the tubular liner into engagement with the borehole. In an exemplary embodiment, a plurality of discrete portions of the tubular liner are radially expanded into engagement with the borehole. In an exemplary embodiment, the remaining portions of the tubular liner are not radially expanded. In an exemplary embodiment, one of the discrete portions of the tubular liner is radially expanded by injecting a fluidic material into the tubular liner; and wherein the other discrete portions of the tubular liner are radially expanded by pulling an expansion cone through the other discrete portions of the tubular liner. In an exemplary embodiment, the tubular liner comprises a plurality of tubular members; and wherein one or more of the tubular members are radially expanded into engagement with the borehole and one or more of the tubular members are not radially expanded into engagement with the borehole. In an exemplary embodiment, the tubular members that are radially expanded into engagement with the borehole include a portion that is radially expanded into engagement with the borehole and a portion that is not radially expanded into engagement with the borehole. In an exemplary embodiment, prior to the radial expansion the tubular liner includes one or more expandable tubular members that each include a tubular body comprising an intermediate portion and first and second expanded end portions coupled to opposing ends of the intermediate portion, and a sealing member coupled to the exterior surface of the intermediate portion, and one or more slotted tubular members coupled to the expandable tubular members, wherein the inside diameters of the slotted tubular members are greater than or equal to the maximum inside diameters of the expandable tubular members. In an exemplary embodiment, the tubular liner includes a plurality of expandable tubular members; and wherein the slotted tubular members are interleaved among the expandable tubular members.

An apparatus has been described that includes a zonal isolation assembly including one or more solid tubular members, each solid tubular member including one or more external seals, and one or more perforated tubular members coupled to the solid tubular members, and a shoe coupled to the zonal isolation assembly. One or more of the perforated tubular members include an elastic sealing member coupled to the perforated tubular member and covering one or more of the perforations of the perforated tubular member. In an exemplary embodiment, the elastic sealing member comprises a tubular elastic sealing member. In an exemplary embodiment, the elastic sealing member comprises a swellable elastomeric sealing member that swells in the presence of fluidic materials. In an exemplary embodiment, one or more of the external seals comprise a swellable elastomeric sealing member that swells in the presence of fluidic materials. In an exemplary embodiment, the zonal isolation assembly further includes one or more intermediate solid tubular members coupled to and interleaved among the perforated tubular members, each intermediate solid tubular member including one or more external seals. In an exemplary embodiment, the zonal isolation assembly further includes one or more valve members for controlling the flow of fluidic materials between the tubular members. In an exemplary embodiment, one or more of the intermediate solid tubular members include one or more valve members.

An apparatus has been described that includes a zonal isolation assembly including one or more primary solid tubulars, each primary solid tubular including one or more external seals, n perforated tubulars coupled to the primary solid tubulars, and n−1 intermediate solid tubulars coupled to and interleaved among the perforated tubulars, each intermediate solid tubular including one or more external seals, and a shoe coupled to the zonal isolation assembly. One or more of the perforated tubular members include an elastic sealing member coupled to the perforated tubular member and covering one or more of the perforations of the perforated tubular member. In an exemplary embodiment, the elastic sealing member comprises a swellable elastomeric sealing member that swells in the presence of fluidic materials. In an exemplary embodiment, one or more of the external seals comprise a swellable elastomeric sealing member that swells in the presence of fluidic materials.

A method of isolating a first subterranean zone from a second subterranean zone in a wellbore has been described that includes positioning one or more primary solid tubulars within the wellbore, the primary solid tubulars traversing the first subterranean zone, positioning one or more perforated tubulars within the wellbore, the perforated tubulars traversing the second subterranean zone, fluidicly coupling the perforated tubulars and the primary solid tubulars, preventing the passage of fluids from the first subterranean zone to the second subterranean zone within the wellbore external to the solid and perforated tubulars, and covering one or more of the perforations of one or more of the perforated tubular members using an elastic sealing member. In an exemplary embodiment, the elastic sealing member comprises a swellable elastomeric sealing member that swells in the presence of fluidic materials.

A method of extracting materials from a producing subterranean zone in a wellbore, at least a portion of the wellbore including a casing, has been described that includes positioning one or more primary solid tubulars within the wellbore, fluidicly coupling the primary solid tubulars with the casing, positioning one or more perforated tubulars within the wellbore, the perforated tubulars traversing the producing subterranean zone, fluidicly coupling the perforated tubulars with the primary solid tubulars, fluidicly isolating the producing subterranean zone from at least one other subterranean zone within the wellbore, fluidicly coupling at least one of the perforated tubulars with the producing subterranean zone, and covering one or more of the perforations of one or more of the perforated tubular members using an elastic sealing member. In an exemplary embodiment, the elastic sealing member comprises a swellable elastomeric sealing member that swells in the presence of fluidic materials. In an exemplary embodiment, the method further includes controllably fluidicly decoupling at least one of the perforated tubulars from at least one other of the perforated tubulars.

An apparatus has been described that includes a subterranean formation including a wellbore, that includes a zonal isolation assembly at least partially positioned within the wellbore including one or more solid tubular members, each solid tubular member including one or more external seals, and one or more perforated tubular members coupled to the solid tubular members, and a shoe positioned within the wellbore coupled to the zonal isolation assembly. At least one of the solid tubular members and the perforated tubular members are formed by a radial expansion process performed within the wellbore, and one or more of the perforated tubular members include an elastic sealing member coupled to the perforated tubular member and covering one or more of the perforations of the perforated tubular member. In an exemplary embodiment, the elastic sealing member comprises a swellable elastomeric sealing member that swells in the presence of fluidic materials. In an exemplary embodiment, one or more of the external seals comprise a swellable elastomeric sealing member that swells in the presence of fluidic materials. In an exemplary embodiment, the zonal isolation assembly further includes one or more intermediate solid tubular members coupled to and interleaved among the perforated tubular members, each intermediate solid tubular member including one or more external seals, wherein at least one of the solid tubular members, the perforated tubular members, and the intermediate solid tubular members are formed by a radial expansion process performed within the wellbore. In an exemplary embodiment, the zonal isolation assembly further includes one or more valve members for controlling the flow of fluids between the solid tubular members and the perforated tubular members. In an exemplary embodiment, one or more of the intermediate solid tubular members include one or more valve members for controlling the flow of fluids between the solid tubular members and the perforated tubular members.

An apparatus has been described that includes a subterranean formation including a wellbore, a zonal isolation assembly positioned within the wellbore including one or more primary solid tubulars, each primary solid tubular including one or more external seals, n perforated tubulars positioned coupled to the primary solid tubulars, and n−1 intermediate solid tubulars coupled to and interleaved among the perforated tubulars, each intermediate solid tubular including one or more external seals, and a shoe coupled to the zonal isolation assembly. At least one of the primary solid tubulars, the perforated tubulars, and the intermediate solid tubulars are formed by a radial expansion process performed within the wellbore, and one or more of the perforated tubular members include an elastic sealing member coupled to the perforated tubular member and covering one or more of the perforations of the perforated tubular member. In an exemplary embodiment, the elastic sealing member comprises a swellable elastomeric sealing member that swells in the presence of fluidic materials. In an exemplary embodiment, one or more of the external seals comprise a swellable elastomeric sealing member that swells in the presence of fluidic materials.

A method of isolating a first subterranean zone from a second subterranean zone in a wellbore has been described that includes positioning one or more primary solid tubulars within the wellbore, the primary solid tubulars traversing the first subterranean zone, positioning one or more perforated tubulars within the wellbore, the perforated tubulars traversing the second subterranean zone, radially expanding at least one of the primary solid tubulars and perforated tubulars within the wellbore, fluidicly coupling the perforated tubulars and the primary solid tubulars, preventing the passage of fluids from the first subterranean zone to the second subterranean zone within the wellbore external to the primary solid tubulars and perforated tubulars, and covering one or more of the perforations of one or more of the perforated tubular members using an elastic sealing member. In an exemplary embodiment, the elastic sealing member comprises a swellable elastomeric sealing member that swells in the presence of fluidic materials.

A method of extracting materials from a producing subterranean zone in a wellbore, at least a portion of the wellbore including a casing, has been described that includes positioning one or more primary solid tubulars within the wellbore, positioning one or more perforated tubulars within the wellbore, the perforated tubulars traversing the producing subterranean zone, radially expanding at least one of the primary solid tubulars and the perforated tubulars within the wellbore, fluidicly coupling the primary solid tubulars with the casing, fluidicly coupling the perforated tubulars with the primary solid tubulars, fluidicly isolating the producing subterranean zone from at least one other subterranean zone within the wellbore, fluidicly coupling at least one of the perforated tubulars with the producing subterranean zone, and covering one or more of the perforations of one or more of the perforated tubular members using an elastic sealing member. In an exemplary embodiment, the elastic sealing member comprises a swellable elastomeric sealing member that swells in the presence of fluidic materials. In an exemplary embodiment, the method further includes controllably fluidicly decoupling at least one of the perforated tubulars from at least one other of the perforated tubulars.

An apparatus has been described that includes a subterranean formation including a wellbore, a zonal isolation assembly positioned within the wellbore including: n solid tubular members positioned within the wellbore, each solid tubular member including one or more external seals, and n−1 perforated tubular members positioned within the wellbore coupled to and interleaved among the solid tubular members, and a shoe positioned within the wellbore coupled to the zonal isolation assembly. One or more of the perforated tubular members include a tubular elastic sealing member coupled to the perforated tubular member and covering one or more of the perforations of the perforated tubular member. In an exemplary embodiment, the elastic sealing member comprises a swellable elastomeric sealing member that swells in the presence of fluidic materials. In an exemplary embodiment, one or more of the external seals comprise a swellable elastomeric sealing member that swells in the presence of fluidic materials. In an exemplary embodiment, the zonal isolation assembly further comprises one or more valve members for controlling the flow of fluids between the solid tubular members and the perforated tubular members. In an exemplary embodiment, one or more of the solid tubular members include one or more valve members for controlling the flow of fluids between the solid tubular members and the perforated tubular members.

A system for isolating a first subterranean zone from a second subterranean zone in a wellbore has been described that includes means for positioning one or more primary solid tubulars within the wellbore, the primary solid tubulars traversing the first subterranean zone, means for positioning one or more perforated tubulars within the wellbore, the perforated tubulars traversing the second subterranean zone, means for fluidicly coupling the perforated tubulars and the primary solid tubulars, means for preventing the passage of fluids from the first subterranean zone to the second subterranean zone within the wellbore external to the primary solid tubulars and the perforated tubulars, and means for sealing one or more of the perforations of one or more of the perforated tubular members.

A system for extracting materials from a producing subterranean zone in a wellbore, at least a portion of the wellbore including a casing, has been described that includes means for positioning one or more primary solid tubulars within the wellbore, means for fluidicly coupling the primary solid tubulars with the casing, means for positioning one or more perforated tubulars within the wellbore, the perforated tubulars traversing the producing subterranean zone, means for fluidicly coupling the perforated tubulars with the primary solid tubulars, means for fluidicly isolating the producing subterranean zone from at least one other subterranean zone within the wellbore, means for fluidicly coupling at least one of the perforated tubulars with the producing subterranean zone, and means for sealing one or more of the perforations of one or more of the perforated tubular members using an elastic sealing member. In an exemplary embodiment, the system further includes means for controllably fluidicly decoupling at least one of the perforated tubulars from at least one other of the perforated tubulars.

A system for isolating a first subterranean zone from a second subterranean zone in a wellbore has been described that includes means for positioning one or more primary solid tubulars within the wellbore, the primary solid tubulars traversing the first subterranean zone, means for positioning one or more perforated tubulars within the wellbore, the perforated tubulars traversing the second subterranean zone, means for radially expanding at least one of the primary solid tubulars and perforated tubulars within the wellbore, means for fluidicly coupling the perforated tubulars and the primary solid tubulars, means for preventing the passage of fluids from the first subterranean zone to the second subterranean zone within the wellbore external to the primary solid tubulars and perforated tubulars, and means for sealing one or more of the perforations of one or more of the perforated tubular members using an elastic sealing member.

A system for extracting materials from a producing subterranean zone in a wellbore, at least a portion of the wellbore including a casing, has been described that includes means for positioning one or more primary solid tubulars within the wellbore, means for positioning one or more perforated tubulars within the wellbore, the perforated tubulars traversing the producing subterranean zone, means for radially expanding at least one of the primary solid tubulars and the perforated tubulars within the wellbore, means for fluidicly coupling the primary solid tubulars with the casing, means for fluidicly coupling the perforated tubulars with the solid tubulars, means for fluidicly isolating the producing subterranean zone from at least one other subterranean zone within the wellbore, means for fluidicly coupling at least one of the perforated tubulars with the producing subterranean zone, and means for sealing one or more of the perforations of one or more of the perforated tubular members using an elastic sealing member. In an exemplary embodiment, the system further includes means for controllably fluidicly decoupling at least one of the perforated tubulars from at least one other of the perforated tubulars.

A system for isolating subterranean zones traversed by a wellbore has been described that includes a tubular support member defining a first passage, a tubular expansion cone defining a second passage fluidicly coupled to the first passage coupled to an end of the tubular support member and including a tapered end, a tubular liner coupled to and supported by the tapered end of the tubular expansion cone, and a shoe defining a valveable passage coupled to an end of the tubular liner. The tubular liner includes one or more expandable tubular members that each include: a tubular body comprising an intermediate portion and first and second expanded end portions coupled to opposing ends of the intermediate portion, and a sealing member coupled to the exterior surface of the intermediate portion, and one or more perforated tubular members coupled to the expandable tubular members. The inside diameters of the perforated tubular members are greater than or equal to the outside diameter of the tubular expansion cone. In an exemplary embodiment, the wall thicknesses of the first and second expanded end portions are greater than the wall thickness of the intermediate portion. In an exemplary embodiment, each expandable tubular member further includes: a first tubular transitionary member coupled between the first expanded end portion and the intermediate portion, and a second tubular transitionary member coupled between the second expanded end portion and the intermediate portion. The angles of inclination of the first and second tubular transitionary members relative to the intermediate portion ranges from about 0 to 30 degrees. In an exemplary embodiment, the outside diameter of the intermediate portion ranges from about 75 percent to about 98 percent of the outside diameters of the first and second expanded end portions. In an exemplary embodiment, the burst strength of the first and second expanded end portions is substantially equal to the burst strength of the intermediate tubular section. In an exemplary embodiment, the ratio of the inside diameters of the first and second expanded end portions to the interior diameter of the intermediate portion ranges from about 100 to 120 percent. In an exemplary embodiment, the relationship between the wall thicknesses $t_1$, $t_2$, and $t_{INT}$ of the first expanded end portion, the second expanded end portion, and the intermediate portion, respectively, of the expandable tubular members, the inside diameters $D_1$, $D_2$ and $D_{INT}$ of the first expanded end portion, the second expanded end portion, and the intermediate portion, respectively, of the expandable tubular members, and the inside diameter $D_{wellbore}$ of the wellbore casing that the expandable tubular member will be inserted into, and the outside diameter $D_{cone}$ of the expansion cone that will be used to radially expand the expandable tubular member within the wellbore is given by the following expression:

$$Dwellbore - 2 * t_1 \geq D_1 \geq \frac{1}{t_1}[(t_1 - t_{INT}) * D_{cone} + t_{INT} * D_{INT}]$$

wherein $t_1 = t_2$; and wherein $D_1 = D_2$.

In an exemplary embodiment, the tapered end of the tubular expansion cone includes a plurality of adjacent discrete tapered sections. In an exemplary embodiment, the angle of attack of the adjacent discrete tapered sections increases in a continuous manner from one end of the tubular expansion cone to the opposite end of the tubular expansion cone. In an exemplary embodiment, the tapered end of the tubular expansion cone includes an paraboloid body. In an exemplary embodiment, the angle of attack of the outer surface of the paraboloid body increases in a continuous manner from one end of the paraboloid body to the opposite end of the paraboloid body. In an exemplary embodiment, the tubular liner includes a plurality of expandable tubular members, and the other tubular members are interleaved among the expandable tubular members. In an exemplary embodiment, one or more of the perforated tubular members include an elastic sealing member coupled to an exterior surface of the perforated tubular member and covering one or more of the perforations of the perforated tubular member.

A method of isolating subterranean zones traversed by a wellbore has been described that includes positioning a tubular liner within the wellbore, and radially expanding one or more discrete portions of the tubular liner into engagement with the wellbore. The tubular liner includes a plurality of tubular members; and wherein one or more of the tubular members are radially expanded into engagement with the wellbore and one or more of the tubular members are not radially expanded into engagement with the wellbore, and tubular liner includes one or more expandable tubular members that each include: a tubular body comprising an intermediate portion and first and second expanded end portions coupled to opposing ends of the intermediate portion, and a sealing member coupled to the exterior surface of the intermediate portion, and one or more perforated tubular members coupled to the expandable tubular members. The inside diameters of the perforated tubular members are greater than or equal to the maximum inside diameters of the expandable tubular members. In an exemplary embodiment, the tubular liner includes a plurality of expandable tubular members; and wherein the perforated tubular members are interleaved among the expandable tubular members. In an exemplary embodiment, one or more of the perforated tubular members include an elastic sealing member coupled to an exterior surface of the perforated tubular member and covering one or more of the perforations of the perforated tubular member.

An apparatus for isolating subterranean zones has been described that includes a subterranean formation defining a borehole, and a tubular liner positioned in and coupled to the borehole at one or more discrete locations. The tubular liner includes a plurality of tubular members; and one or more of the tubular members are radially expanded into engagement with the borehole and one or more of the tubular members are not radially expanded into engagement with the borehole. The tubular liner is coupled to the borehole by a process that includes positioning the tubular liner within the borehole, and radially expanding one or more discrete portions of the tubular liner into engagement with the borehole. In an exemplary embodiment, prior to the radial expansion the tubular liner includes one or more expandable tubular members that each include a tubular body comprising an intermediate portion and first and second expanded end portions coupled to opposing ends of the intermediate portion, and a sealing member coupled to the exterior surface of the intermediate portion, and one or more perforated tubular members coupled to the expandable tubular members. The inside diameters of the perforated tubular members are greater than or equal to the maximum inside diameters of the expandable tubular members. In an exemplary embodiment, the tubular liner includes a plurality of expandable tubular members, and the perforated tubular members are interleaved among the expandable tubular members. In an exemplary embodiment, one or more of the perforated tubular members include a tubular elastic sealing member coupled to an exterior surface of the perforated tubular member and covering one or more of the perforations of the perforated tubular member.

A method of sealing an annulus between a wellbore and a tubular member positioned within the wellbore has been described that includes coupling a swellable elastomeric material to the exterior of the tubular member that swells in the presence of fluidic materials to sealingly engage the wellbore. In an exemplary embodiment, the method further includes radially expanding and plastically deforming the tubular member within the wellbore. In an exemplary embodiment, the tubular member defines one or more radial passages. In an exemplary embodiment, the swellable elastomeric materials covers and seals one or more of the radial passages of the tubular member.

In several alternative embodiments, the teachings of the present disclosure may be applied to, for example, oil and gas exploration and production and/or the extraction of geothermal energy from subterranean formations.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. An apparatus, comprising:

a zonal isolation assembly comprising:

one or more solid tubular members, each solid tubular member including one or more external seals; and one or more perforated tubular members coupled to the solid tubular members; and a shoe coupled to the zonal isolation assembly;

wherein one or more of the perforated tubular members include an elastic sealing member coupled to the perforated tubular member and covering one or more of the perforations of the perforated tubular member.

2. The apparatus of claim 1, wherein the elastic sealing member comprises a tubular elastic sealing member.

3. The apparatus of claim 1, wherein the elastic sealing member comprises a swellable elastomeric sealing member that swells in the presence of fluidic materials.

4. The apparatus of claim 1, wherein one or more of the external seals comprise a swellable elastomeric sealing member that swells in the presence of fluidic materials.

5. The apparatus of claim 1, wherein the zonal isolation assembly further comprises:

one or more intermediate solid tubular members coupled to and interleaved among the perforated tubular members, each intermediate solid tubular member including one or more external seals.

6. The apparatus of claim 1, wherein the zonal isolation assembly further comprises one or more valve members for controlling the flow of fluidic materials between the tubular members.

7. The apparatus of claim 5, wherein one or more of the intermediate solid tubular members include one or more valve members.

8. An apparatus, comprising:

a zonal isolation assembly comprising:

one or more primary solid tubulars, each primary solid tubular including one or more external seals;

n perforated tubulars coupled to the primary solid tubulars; and n−1 intermediate solid tubulars coupled to and interleaved among the perforated tubulars, each intermediate solid tubular including one or more external seals; and a shoe coupled to the zonal isolation assembly;

wherein one or more of the perforated tubular members include an elastic sealing member coupled to the perforated tubular member and covering one or more of the perforations of the perforated tubular member.

9. The apparatus of claim 8, wherein the elastic sealing member comprises a swellable elastomeric sealing member that swells in the presence of fluidic materials.

10. The apparatus of claim 8, wherein one or more of the external seals comprise a swellable elastomeric sealing member that swells in the presence of fluidic materials.

11. A method of isolating a first subterranean zone from a second subterranean zone in a wellbore, comprising:

positioning one or more primary solid tubulars within the wellbore, the primary solid tubulars traversing the first subterranean zone;

positioning one or more perforated tubulars within the wellbore, the perforated tubulars traversing the second subterranean zone;

fluidicly coupling the perforated tubulars and the primary solid tubulars;

preventing the passage of fluids from the first subterranean zone to the second subterranean zone within the wellbore external to the solid and perforated tubulars; and covering one or more of the perforations of one or more of the perforated tubular members using an elastic sealing member.

12. The method of claim 11, wherein the elastic sealing member comprises a swellable elastomeric sealing member that swells in the presence of fluidic materials.

13. A method of extracting materials from a producing subterranean zone in a wellbore, at least a portion of the wellbore including a casing, comprising:

positioning one or more primary solid tubulars within the wellbore;

fluidicly coupling the primary solid tubulars with the casing;

positioning one or more perforated tubulars within the wellbore, the perforated tubulars traversing the producing subterranean zone;

fluidicly coupling the perforated tubulars with the primary solid tubulars;

fluidicly isolating the producing subterranean zone from at least one other subterranean zone within the wellbore;

fluidicly coupling at least one of the perforated tubulars with the producing subterranean zone; and covering one or more of the perforations of one or more of the perforated tubular members using an elastic sealing member.

14. The method of claim 13, wherein the elastic sealing member comprises a swellable elastomeric sealing member that swells in the presence of fluidic materials.

15. The method of claim 13, further comprising:

controllably fluidicly decoupling at least one of the perforated tubulars from at least one other of the perforated tubulars.

16. An apparatus, comprising:

a subterranean formation including a wellbore;

a zonal isolation assembly at least partially positioned within the wellbore comprising:

one or more solid tubular members, each solid tubular member including one or more external seals; and one or more perforated tubular members coupled to the solid tubular members; and a shoe positioned within the wellbore coupled to the zonal isolation assembly;

wherein at least one of the solid tubular members and the perforated tubular members are formed by a radial expansion process performed within the wellbore; and wherein one or more of the perforated tubular members include an elastic sealing member coupled to the perforated tubular member and covering one or more of the perforations of the perforated tubular member.

17. The apparatus of claim 16, wherein the elastic sealing member comprises a swellable elastomeric sealing member that swells in the presence of fluidic materials.

18. The apparatus of claim 16, wherein one or more of the external seals comprise a swellable elastomeric sealing member that swells in the presence of fluidic materials.

19. The apparatus of claim 16, wherein the zonal isolation assembly further comprises:

one or more intermediate solid tubular members coupled to and interleaved among the perforated tubular members, each intermediate solid tubular member including one or more external seals;

wherein at least one of the solid tubular members, the perforated tubular members, and the intermediate solid tubular members are formed by a radial expansion process performed within the wellbore.

20. The apparatus of claim 16, wherein the zonal isolation assembly further comprises one or more valve members for controlling the flow of fluids between the solid tubular members and the perforated tubular members.

21. The apparatus of claim 19, wherein one or more of the intermediate solid tubular members include one or more valve members for controlling the flow of fluids between the solid tubular members and the perforated tubular members.

22. An apparatus, comprising:

a subterranean formation including a wellbore;

a zonal isolation assembly positioned within the wellbore comprising:

one or more primary solid tubulars, each primary solid tubular including one or more external seals;

n perforated tubulars positioned coupled to the primary solid tubulars; and n−1intermediate solid tubulars coupled to and interleaved among the perforated tubulars, each intermediate solid tubular including one or more external seals; and a shoe coupled to the zonal isolation assembly;

wherein at least one of the primary solid tubulars, the perforated tubulars, and the intermediate solid tubulars are formed by a radial expansion process performed within the wellbore; and wherein one or more of the perforated tubular members include an elastic sealing member coupled to the perforated tubular member and covering one or more of the perforations of the perforated tubular member.

23. The apparatus of claim 22, wherein the elastic sealing member comprises a swellable elastomeric sealing member that swells in the presence of fluidic materials.

24. The apparatus of claim 22, wherein one or more of the external seals comprise a swellable elastomeric sealing member that swells in the presence of fluidic materials.

25. A method of isolating a first subterranean zone from a second subterranean zone in a wellbore, comprising:

positioning one or more primary solid tubulars within the wellbore, the primary solid tubulars traversing the first subterranean zone;

positioning one or more perforated tubulars within the wellbore, the perforated tubulars traversing the second subterranean zone;

radially expanding at least one of the primary solid tubulars and perforated tubulars within the wellbore;

fluidicly coupling the perforated tubulars and the primary solid tubulars;

preventing the passage of fluids from the first subterranean zone to the second subterranean zone within the wellbore external to the primary solid tubulars and perforated tubulars; and covering one or more of the perforations of one or more of the perforated tubular members using an elastic sealing member.

26. The method of claim 25, wherein the elastic sealing member comprises a swellable elastomeric sealing member that swells in the presence of fluidic materials.

27. A method of extracting materials from a producing subterranean zone in a wellbore, at least a portion of the wellbore including a casing, comprising;

positioning one or more primary solid tubulars within the wellbore;

positioning one or more perforated tubulars within the wellbore, the perforated tubulars traversing the producing subterranean zone;

radially expanding at least one of the primary solid tubulars and the perforated tubulars within the wellbore;

fluidicly coupling the primary solid tubulars with the casing;

fluidicly coupling the perforated tubulars with the primary solid tubulars;

fluidicly isolating the producing subterranean zone from at least one other subterranean zone within the wellbore;

fluidicly coupling at least one of the perforated tubulars with the producing subterranean zone; and covering one or more of the perforations of one or more of the perforated tubular members using an elastic sealing member.

28. The method of claim 27, wherein the elastic sealing member comprises a swellable elastomeric sealing member that swells in the presence of fluidic materials.

29. The method of claim 27, further comprising:

controllably fluidicly decoupling at least one of the perforated tubulars from at least one other of the perforated tubulars.

30. An apparatus, comprising:

a subterranean formation including a wellbore;

a zonal isolation assembly positioned within the wellbore comprising:

n solid tubular members positioned within the wellbore, each solid tubular member including one or more external seals; and n−1perforated tubular members positioned within the wellbore coupled to and interleaved among the solid tubular members; and a shoe positioned within the wellbore coupled to the zonal isolation assembly;

wherein one or more of the perforated tubular members include a tubular elastic sealing member coupled to the perforated tubular member and covering one or more of the perforations of the perforated tubular member.

31. The apparatus of claim 30, wherein the elastic sealing member comprises a swellable elastomeric sealing member that swells in the presence of fluidic materials.

32. The apparatus of claim 30, wherein one or more of the external seals comprise a swellable elastomeric sealing member that swells in the presence of fluidic materials.

33. The apparatus of claim 30, wherein the zonal isolation assembly further comprises one or more valve members for controlling the flow of fluids between the solid tubular members and the perforated tubular members.

34. The apparatus of claim 30, wherein one or more of the solid tubular members include one or more valve members for controlling the flow of fluids between the solid tubular members and the perforated tubular members.

35. A system for isolating a first subterranean zone from a second subterranean zone in a wellbore, comprising:

means for positioning one or more primary solid tubulars within the wellbore, the primary solid tubulars traversing the first subterranean zone;

means for positioning one or more perforated tubulars within the wellbore, the perforated tubulars traversing the second subterranean zone;

means for fluidicly coupling the perforated tubulars and the primary solid tubulars;

means for preventing the passage of fluids from the first subterranean zone to the second subterranean zone within the wellbore external to the primary solid tubulars and the perforated tubulars; and means for sealing one or more of the perforations of one or more of the perforated tubular members.

36. A system for extracting materials from a producing subterranean zone in a wellbore, at least a portion of the wellbore including a casing, comprising;

means for positioning one or more primary solid tubulars within the wellbore;

means for fluidicly coupling the primary solid tubulars with the casing;

means for positioning one or more perforated tubulars within the wellbore, the perforated tubulars traversing the producing subterranean zone;

means for fluidicly coupling the perforated tubulars with the primary solid tubulars;

means for fluidicly isolating the producing subterranean zone from at least one other subterranean zone within the wellbore;

means for fluidicly coupling at least one of the perforated tubulars with the producing subterranean zone; and means for sealing one or more of the perforations of one or more of the perforated tubular members using an elastic sealing member.

37. The system of claim 36, further comprising:

means for controllably fluidicly decoupling at least one of the perforated tubulars from at least one other of the perforated tubulars.

38. A system for isolating a first subterranean zone from a second subterranean zone in a wellbore, comprising:

means for positioning one or more primary solid tubulars within the wellbore, the primary solid tubulars traversing the first subterranean zone;

means for positioning one or more perforated tubulars within the wellbore, the perforated tubulars traversing the second subterranean zone;

means for radially expanding at least one of the primary solid tubulars and perforated tubulars within the wellbore;

means for fluidicly coupling the perforated tubulars and the primary solid tubulars;

means for preventing the passage of fluids from the first subterranean zone to the second subterranean zone within the wellbore external to the primary solid tubulars and perforated tubulars; and means for sealing one or more of the perforations of one or more of the perforated tubular members using an elastic sealing member.

39. A system for extracting materials from a producing subterranean zone in a wellbore, at least a portion of the wellbore including a casing, comprising;

means for positioning one or more primary solid tubulars within the wellbore;

means for positioning one or more perforated tubulars within the wellbore, the perforated tubulars traversing the producing subterranean zone;

means for radially expanding at least one of the primary solid tubulars and the perforated tubulars within the wellbore;

means for fluidicly coupling the primary solid tubulars with the casing;

means for fluidicly coupling the perforated tubulars with the solid tubulars;

means for fluidicly isolating the producing subterranean zone from at least one other subterranean zone within the wellbore;

means for fluidicly coupling at least one of the perforated tubulars with the producing subterranean zone; and means for sealing one or more of the perforations of one or more of the perforated tubular members using an elastic sealing member.

40. The system of claim 39, further comprising:

means for controllably fluidicly decoupling at least one of the perforated tubulars from at least one other of the perforated tubulars.

41. A system for isolating subterranean zones traversed by a wellbore, comprising:

a tubular support member defining a first passage;

a tubular expansion cone defining a second passage fluidicly coupled to the first passage coupled to an end of the tubular support member and comprising a tapered end;

a tubular liner coupled to and supported by the tapered end of the tubular expansion cone; and a shoe defining a valveable passage coupled to an end of the tubular liner;

wherein the tubular liner comprises:

one or more expandable tubular members that each comprise:

a tubular body comprising an intermediate portion and first and second expanded end portions coupled to opposing ends of the intermediate portion; and a sealing member coupled to the exterior surface of the intermediate portion; and one or more perforated tubular members coupled to the expandable tubular members;

wherein the inside diameters of the perforated tubular members are greater than or equal to the outside diameter of the tubular expansion cone.

42. The system of claim 41, wherein the wall thicknesses of the first and second expanded end portions are greater than the wall thickness of the intermediate portions.

43. The system of claim 41, wherein each expandable tubular member further comprises:

a first tubular transitionary member coupled between the first expanded end portion and the intermediate portion; and a second tubular transitionary member coupled between the second expanded end portion and the intermediate portion;

wherein the angles of inclination of the first and second tubular transitionary members relative to the intermediate portion ranges from about 0 to 30 degrees.

44. The system of claim 41, wherein the outside diameter of the intermediate portion ranges from about 75 percent to about 98 percent of the outside diameters of the first and second expanded end portions.

45. The system of claim 41, wherein the burst strength of the first and second expanded end portions is substantially equal to the burst strength of the intermediate tubular section.

46. The system of claim 41, wherein the ratio of the inside diameters of the first and second expanded end portions to the interior diameter of the intermediate portion ranges from about 100 to 120 percent.

47. The system of claim 41, wherein the relationship between the wall thicknesses $t_1$, $t_2$, and $t_{INT}$ of the first expanded end portion, the second expanded end portion, and the intermediate portion, respectively, of the expandable tubular members, the inside diameters $D_1$, $D_2$ and $D_{INT}$ of the first expanded end portion, the second expanded end portion, and the intermediate portion, respectively, of the expandable tubular members, and the inside diameter $D_{wellbore}$ of the wellbore casing that the expandable tubular member will be inserted into, and the outside diameter $D_{cone}$ of the expansion cone that will be used to radially expand the expandable tubular member within the wellbore is given by the following expression:

$$Dwellbore - 2 * t_1 \geq D_1 \geq \frac{1}{t_1}[(t_1 - t_{INT}) * D_{cone} + t_{INT} * D_{INT}];$$

wherein $t_1 = t_2$; and wherein $D_1 = D_2$.

48. The system of claim 41, wherein the tapered end of the tubular expansion cone comprises:

a plurality of adjacent discrete tapered sections.

49. The system of claim 48, wherein the angle of attack of the adjacent discrete tapered sections increases in a continuous manner from one end of the tubular expansion cone to the opposite end of the tubular expansion cone.

50. The system of claim 41, wherein the tapered end of the tubular expansion cone comprises:

an paraboloid body.

51. The system of claim 50, wherein the angle of attack of the outer surface of the paraboloid body increases in a continuous manner from one end of the paraboloid body to the opposite end of the paraboloid body.

52. The system of claim 41, wherein the tubular liner comprises a plurality of expandable tubular members; and wherein the other tubular members are interleaved among the expandable tubular members.

53. The system of claim 41, wherein one or more of the perforated tubular members include an elastic sealing member coupled to an exterior surface of the perforated tubular member and covering one or more of the perforations of the perforated tubular member.

54. A method of isolating subterranean zones traversed by a wellbore, comprising:

positioning a tubular liner within the wellbore; and radially expanding one or more discrete portions of the tubular liner into engagement with the wellbore;

wherein the tubular liner comprises a plurality of tubular members; and wherein one or more of the tubular members are radially expanded into engagement with the wellbore and one or more of the tubular members are not radially expanded into engagement with the wellbore; and wherein the tubular liner comprises:

one or more expandable tubular members that each comprise:

a tubular body comprising an intermediate portion and first and second expanded end portions coupled to opposing ends of the intermediate portion; and a sealing member coupled to the exterior surface of the intermediate portion; and one or more perforated tubular members coupled to the expandable tubular members;

wherein the inside diameters of the perforated tubular members are greater than or equal to the maximum inside diameters of the expandable tubular members.

55. The method of claim 54, wherein the tubular liner comprises a plurality of expandable tubular members; and wherein the perforated tubular members are interleaved among the expandable tubular members.

56. The method of claim 54, wherein one or more of the perforated tubular members include an elastic sealing member coupled to an exterior surface of the perforated tubular member and covering one or more of the perforations of the perforated tubular member.

57. An apparatus for isolating subterranean zones, comprising:

a subterranean formation defining a borehole; and a tubular liner positioned in and coupled to the borehole at one or more discrete locations;

wherein the tubular liner comprises a plurality of tubular members; and wherein one or more of the tubular members are radially expanded into engagement with the borehole and one or more of the tubular members are not radially expanded into engagement with the borehole; and wherein the tubular liner is coupled to the borehole by a process that comprises:

positioning the tubular liner within the borehole; and radially expanding one or more discrete portions of the tubular liner into engagement with the borehole.

58. The system of claim 57, wherein prior to the radial expansion the tubular liner comprises:

one or more expandable tubular members that each comprise:

a tubular body comprising an intermediate portion and first and second expanded end portions coupled to opposing ends of the intermediate portion; and a sealing member coupled to the exterior surface of the intermediate portion; and one or more perforated tubular members coupled to the expandable tubular members;

wherein the inside diameters of the perforated tubular members are greater than or equal to the maximum inside diameters of the expandable tubular members.

59. The system of claim 58, wherein the tubular liner comprises a plurality of expandable tubular members; and wherein the perforated tubular members are interleaved among the expandable tubular members.

60. The apparatus of claim 57, wherein one or more of the perforated tubular members include a tubular elastic sealing member coupled to an exterior surface of the perforated tubular member and covering one or more of the perforations of the perforated tubular member.

61. A method of sealing an annulus between a wellbore and a tubular member positioned within the wellbore, comprising:

coupling a swellable elastomeric material to the exterior of the tubular member that swells in the presence of fluidic materials to sealingly engage the wellbore; and radially expanding and plastically deforming the tubular member within the wellbore.

62. The method of claim 61, wherein the tubular member defines one or more radial passages.

63. A method of sealing an annulus between a wellbore and a tubular member positioned within the wellbore, comprising:

coupling a swellable elastomeric material to the exterior of the tubular member that swells in the presence of fluidic materials to sealingly engage the wellbore;

wherein the tubular member defines one or more radial passages; and wherein the swellable elastomeric materials covers and seals one or more of the radial passages of the tubular member.

64. A method of extracting materials from a subterranean zone traversed by a wellbore, comprising:

coupling a swellable elastomeric material to the exterior of a tubular member that swells in the presence of fluidic materials to sealingly engage the wellbore;

radially expanding and plastically deforming the tubular member within the wellbore; and extracting the materials from the subterranean zone using the tubular member.

65. The method of claim 64, wherein the tubular member defines one or more radial passages.

66. The method of claim 65, wherein the swellable elastomeric materials covers and seals one or more of the radial passages of the tubular member.

67. A method of transmitting materials through a tubular member positioned within a borehole, comprising:

coupling a swellable elastomeric material to the exterior of the tubular member that swells in the presence of fluidic materials to sealingly engage the borehole;

radially expanding and plastically deforming the tubular member within the borehole; and transmitting the materials using the tubular member.

68. The method of claim 67, wherein the tubular member defines one or more radial passages.

69. The method of claim 68, wherein the swellable elastomeric materials covers and seals one or more of the radial passages of the tubular member.

* * * * *